United States Patent [19]

Morigaki et al.

[11] Patent Number: 5,068,171

[45] Date of Patent: Nov. 26, 1991

[54] SILVER HALIDE COLOR PHOTOGRAPHIC LIGHT-SENSITIVE MATERIAL CONTAINING A TWO EQUIVALENT 5-PYRAZOLONE MAGENTA COUPLER AND COLOR PHOTOGRAPH CONTAINING THE SAME

[75] Inventors: Masakazu Morigaki; Nobuo Seto, both of Kanagawa, Japan

[73] Assignee: Fuji Photo Film Co., Ltd., Kanagawa, Japan

[21] Appl. No.: 379,253

[22] Filed: Jul. 13, 1989

[30] Foreign Application Priority Data

Jul. 16, 1988 [JP] Japan ..... 63-177896

[51] Int. Cl.[5] ..... G03C 7/384; G03C 1/34

[52] U.S. Cl. ..... 430/9; 430/555

[58] Field of Search ..... 430/555, 387, 755, 551, 430/958, 9

[56] References Cited

U.S. PATENT DOCUMENTS

| | | | |
|---|---|---|---|
| 4,770,987 | 9/1988 | Takahashi et al. | 430/546 |
| 4,842,994 | 6/1989 | Sakanoue et al. | 430/543 |
| 4,853,319 | 8/1989 | Krishnamurthy et al. | 430/387 |
| 4,876,182 | 10/1989 | Buckland | 430/555 |
| 4,939,072 | 7/1990 | Morigaki et al. | 430/551 |

FOREIGN PATENT DOCUMENTS

| | | | |
|---|---|---|---|
| 0230048 | 7/1987 | European Pat. Off. . | |
| 0258662 | 3/1988 | European Pat. Off. | 430/551 |
| 0277589 | 8/1988 | European Pat. Off. . | |

*Primary Examiner*—Charles L. Bowers, Jr.
*Assistant Examiner*—Lee C. Wright
*Attorney, Agent, or Firm*—Birch, Stewart, Kolasch & Birch

[57] ABSTRACT

The present invention relates to a silver halide color photographic light sensitive material comprising a support and at least one silver halide emulsion layer on the support, wherein the material contains (1) at least one 5-pyrazolone coupler represented by formulas (II) or (III):

(II)

(III)

and (2) at least one compound selected from the group consisting of compounds represented by formulas (AI), (AII) and (AIII):

$$R_1\text{-}(A)_n X \quad \text{(AI)}$$

$$R_2\text{-}\underset{\underset{B}{|}}{C}=Y \quad \text{(AII)}$$

$$R\text{-}Z \quad \text{(AIII)}$$

wherein the substituents are as defined in the text of the specification.

9 Claims, No Drawings

SILVER HALIDE COLOR PHOTOGRAPHIC LIGHT-SENSITIVE MATERIAL CONTAINING A TWO EQUIVALENT 5-PYRAZOLONE MAGENTA COUPLER AND COLOR PHOTOGRAPH CONTAINING THE SAME

FIELD OF THE INVENTION

The present invention relates to a silver halide color photographic light-sensitive material containing a two equivalent 5-pyrazolone magenta coupler and more particularly to a method for preventing colored stain from being formed with the passage of time after the development of the photographic material.

BACKGROUND OF THE INVENTION

Silver halide color photographic materials are imagewise exposed and then developed with an aromatic amine color developing agent to form a color image by the reaction of the resulting oxidation product of the developing agent with a color image forming coupler (hereinafter referred to as coupler). Usually, a combination of a yellow coupler, a cyan coupler and a magenta coupler is used in the color photographic materials.

Known magenta couplers include pyrazolone type, pyrazolobenzimidazole type, indazolone type and pyrazolcazole type couplers including pyrazolotriazole. Four equivalent couplers are known which theoretically require 4 mol of silver halide to form one mol of a dye and two equivalent couplers are known which theoretically require 2 mol of silver halide to form one mol of a dye.

These couplers form a colored stain which is a phenomenon wherein the unexposed area is colored during the passage of time after development, irrespective of the types of couplers used. However, the difference in the degree of the colored stain varies depending upon the developing methods, the compositions of the developing solutions and the difference in the deterioration of the developing solutions. The two equivalent couplers are more liable to form the colored stain.

Stain in the unexposed area of the silver halide color photographic material has an influence on the quality of the white portion of an image. Further, stain has effects on the color muddiness and deteriorates visual sharpness. Particularly, when reflecting materials (e.g., color paper, reversal color paper) are used, the reflection density of the stain is theoretically enhanced to several times the transmission density so that the image is deteriorated even by a slight amount of stain. Hence, stain is an important factor in the quality of photographic products.

Stain in the unexposed area after development can hardly be inhibited even by the use of anti-fading agents such as hydroquinones, hindered phenols, tocopherol, chroman, coumaran, etc., unlike the type of yellow stain which is formed by the decomposition of the couplers themselves by light or heat.

U.S. Pat. No. 4,483,918 proposes a method wherein two equivalent 5-pyrazolone magenta couplers are used in combination with aniline compounds for the purpose of preventing colored stain from being formed. Further, the present inventors have previously proposed the use of compounds which are reacted with developing agents remaining in the processed photographic materials after development or with oxidized products capable of coupling with coupler to form a dye, whereby there can be formed substantially colorless compounds (see, European Patent Laid-Open Nos. 255,722, 258,662, 228,655 and 230,048 and U.S. Pat. No. 4,704,350). Particularly, magenta colored stain is remarkably visual even when a trace amount of stain is formed. When the recording and storage of the photographic materials are taken into consideration, it is extremely important to prevent a colored stain from being formed as well as to preserve the image from deterioration by light, heat and moisture over a long period of time. The previously proposed inhibitors are not always sufficient to acheive this goal.

Further, the above-described aniline compounds do not have a sufficient effect on two equivalent magenta couplers which have been newly developed. Thus, there is a demand for the development of an alternative method to reduce stain.

Furthermore, a short time for development (i.e., rapid processing, benzyl alcohol-free development, and processing requiring no or little rinsing water) has been recently demanded to meet the requirements of customers or to maintain the natural environment. It is necessary to guarantee the preservability of the color image and a sufficient color density even when the processing is carried out by using processing solutions whose composition ratio is greatly changed during operation.

SUMMARY OF THE INVENTION

A first object of the present invention is to prevent colored stain at the unexposed area from being formed during the passage of time when photographic materials containing two equivalent magenta couplers are developed, and particularly to prevent substantially colored stain from being formed when development is carried out by using running processing solutions, processing solutions requiring no or little rinsing water, color developing solutions containing substantially no benzyl alcohol, or other processing solutions which result severe in color development conditions.

A second object of the present invention is to provide a color photographic material or a color photograph which does not substantially cause the formation of colored stain even when the photographic material or the color photograph is stored over a long period of time.

A third object of the present invention is to provide a color photographic material which produces a color image having a greatly improved color fastness.

A fourth object of the present invention is to provide a color photographic material which provides a sufficient color density even in a short development time process and is substantially free from the problem of the formation of colored stain.

A fifth object of the present invention is to provide a color photographic material which provides a sufficient color density and which is substantially prevented from forming colored stain even when conducting development with a processing solution containing substantially no benzyl alcohol.

The present inventors have made studies and found that the objects of the present invention can be achieved by using magenta couplers of the newly developed 2-acylaminoarylthio elimination type 5-pyrazolone magenta couplers having a specific structure in combination with the compounds described in European Patent Laid-Open Nos. 255,722, 258,662, 228,655 and 230,048 and U.S. Pat. No. 4,704,350. The degree of improvement is unexpectedly high which can not be considered from combinations with other couplers.

The objects of the present invention can be achieved by using at least one 5-pyrazolone coupler having an elimination group at its coupling position, represented by the following formula (I) and at least one compound selected from the group consisting of compounds represented by the following formula (AI), compounds represented by the following formula (AII) and compounds represented by the following formula (AIII).

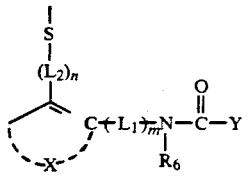

(I)

wherein $L_1$ and $L_2$ are the same or different groups and each represents a substituted or an unsubstituted methylene or ethylene group; m and n each represents 0 or 1; Y represents $R_1$ or $ZR_2$; $R_1$ represents a substituted or unsubstituted aryl group, a substituted or unsubstituted heterocyclic group or a secondary or tertiary alkyl group of the formula

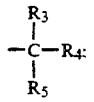

$R_3$ and $R_4$ each represents a halogen atom (preferably, Cl, Br or F; the same hereinafter), $R_2$ or $Z_1R_b$; Z represents an oxygen atom, a sulfur atom or $—NR_a$; $Z_1$, represents an oxygen atom, a sulfur atom or $—NR_c$; $R_2$ represents a substituted or an unsubstituted alkyl, aryl or heterocyclic group; $R_5$ represents a hydrogen atom, a halogen atom, a substituted or an unsubstituted alkyl, aryl or heterocyclic group or $Z_1R_b$; $R_6$, $R_a$ and $R_c$ each represents a hydrogen atom or those described above in the definition of $R_2$; $R_b$ represents a substituted or an unsubstituted alkyl, aryl or heterocyclic group;

$R_3$ may be combined together with at least one of $R_4$ and $R_5$ to form one or two carbon rings or heterocyclic rings which may have optionally one or more substituent groups;

X represents an atomic group composed of atoms selected from the group consisting of carbon, oxygen and sulfur atoms, which is required for forming an unsaturated five-membered to seven-membered ring. The ring may have optionally one or more substituent groups, or may be condensed with another ring to form a ring containing X;

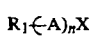

(AI)

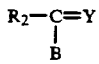

(AII)

wherein $R_1$ and $R_2$ each represents an aliphatic group, an aromatic group or a heterocyclic group; X is a group which is eliminated by the reaction with aromatic amine developing agents, preferably at a pH of not higher than 8; A is a group which forms a chemical bond by the reaction with the aromatic developing agents; n represents 0 or 1; B represents a hydrogen atom, an aliphatic group, an aromatic group, a heterocyclic group, an acyl group or a sulfonyl group; and Y represents a group which accelerates the addition of the aromatic amine developing agents to the compounds having the formula (AII).

$R_1$ and X, or Y and $R_2$ or B may be combined together to form a ring;

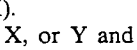

(AIII)

wherein R represents an aliphatic group, an aromatic group or a heterocyclic group; and Z represents a nucleophilic group or a group which is decomposed in the photographic material to release a nucleophilic group.

An embodiment of the present invention is a silver halide color photographic light-sensitive material comprising a support, at least one silver halide emulsion layer on the support, at least one of the above-described 5-pyrazolone couplers, and at least one of the compounds represented by formulas (AI), (AII) and (AIII).

Another embodiment of the present invention is a color photograph comprising a magenta dye formed by an oxidation reaction of at least one of the above-described 5-pyrazolone couplers with a color developing agent and at least one of the compounds represented by formulas (AI), (AII) and (AIII).

DETAILED DESCRIPTION OF THE INVENTION

Now, the couplers which can be used in the present invention will be illustrated in more detail hereinbelow.

The pyrazolone couplers may be in the form of a monomer, oligomer or polymer coupler. The coupler moiety may be bonded to the polymer chain through a substituent group on the pyrazolone skeleton or through a substituent group of an elimination group.

In the present invention, where groups are not specifically defined, an acyl group, an acylamino group, a sulfonyl group, a sulfamido group, a sulfonamido group, etc., are preferably aliphatic or aromatic groups thereof, a heterocyclic group is preferably a 5- to 7-membered heterocyclic group containing at least one of N, O and S atoms as a hetero atom, a halogen atom is preferably Cl, Br or F, and an aryl group is preferably a phenol or naphthyl group.

Preferred pyrazolone couplers are compounds represented by the following formula (II).

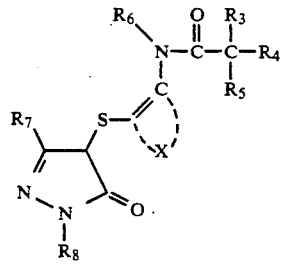

(II)

In formula (II), $R_3$, $R_4$, $R_5$, $R_6$ and X are as defined in the formula (I) above; $R_7$ represents an anilino group, an acylamino group, an ureido group, a carbamoyl group, an alkoxy group, an aryloxycarbonyl group, an alkoxycarbonyl group or a N-heterocyclic group and these groups are preferably groups having an oil-soluble group; and $R_8$ represents a substituted or an unsubstituted aryl group, preferably a substituted phenyl group, more preferably a 2,4,6-trichlorophenyl group.

Other preferred pyrazolone couplers are compounds represented by the following formula (III):

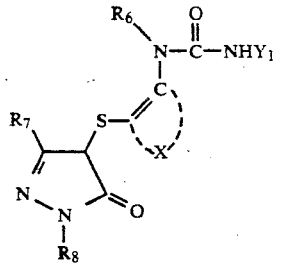

(III)

In formula (III), $Y_1$ represents a substituted or an unsubstituted alkyl, aryl or heterocyclic group; $R_6$, $R_7$ and $R_8$ are as defined in formula (I) above and preferably $R_7$ is a group of —NH—$Y_3$ and preferably $R_8$ is a 2,4,6-trichlorcphenyl group; and $Y_3$ is a substituted or an unsubstituted aryl, arylcarbonyl or arylaminocarbonyl group. For example, $R_7$ is a group having the following formula:

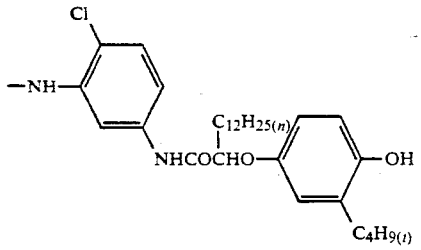

The term "coupler" as used hereinafter refers to the whole compound containing both coupler moiety and coupling elimination group. The "coupler moiety" (abbreviated as COUP) as used hereinafter refers to a moiety obtained by removing the coupling elimination group.

The coupler moiety (COUP) is reacted with an oxidized color developing agent to form a dye, particularly a magenta dye.

Examples of pyrazolone couplers which are known in the photographic industry and which are used are described in U.S. Pat. Nos. 4,413,054, 4,443,536, 4,522,915, 4,336,325, 4,199,361, 4,351,897 and 4,385,111, JP-A-60-170854 (the term "JP-A" as used herein means an "unexamined published Japanese patent application"), JP-A-60-194452, JP-A-60-194451, U.S. Pat. Nos. 4,407,936, 3,419,391 and 3,311,476, U.K. Patent 1,357,372, U.S. Pat. Nos. 2,600,788, 2,908,573, 3,062,653, 3,519,429, 3,152,896, 2,311,082, 2,343,703 and 2,369,489 and patents cited in these patent specifications. When the pyrazolone coupler moiety in these patents is substituted by a coupling elimination group, it can be replaced with the coupling elimination group in formula (I) according to the present invention. The pyrazolone couplers of the present invention can be used in combination with other pyrazolone couplers described in, for example, the above-described patents.

The preferred COUP can be seen in the following formula (IV):

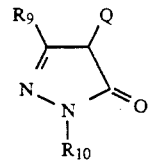

(IV)

In formula (IV), Q is the coupling elimination group of the present invention; $R_9$ represents an anilino group, an acylamino group, an ureido group, a carbamoyl group, an alkoxy group, an aryloxycarbonyl group, an alkoxycarbonyl group or a N-heterocyclic group; and $R_{10}$ represents a substituted or unsubstituted aryl group, preferably a phenyl group having at least one substituent group selected from the group consisting of a halogen atom, an alkyl group, an alkoxy group, an alkoxycarbonyl group, an acylamino group, a sulfamido group, a sulfonamido group and a cyano group. Carbon atoms and nitrogen atom of these substituent groups may be unsubstituted or may be substituted by a group which does not have an adverse effect on the couplers. $R_9$ is preferably an anilino group, more preferably an anilino group having the following formula:

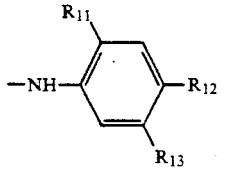

In the above formula, $R_{11}$ represents an alkoxy group having from 1 to 30 carbon atoms, an aryloxy group or a halogen atom (preferably chlorine); and $R_{12}$ and $R_{13}$ are each a hydrogen atom, a halogen atom (e.g., chlorine, bromine, fluorine), an alkyl group (e.g., an alkyl group having from 1 to 30 carbon atoms), an alkoxy group (e.g., an alkoxy group having 1 to 30 carbon atoms), an acylamino group, a sulfonamide group, a sulfamoyl group, a sulfamide group, a carbamoyl group, a diacylamino group, an aryloxycarbonyl group, an alkoxycarbonyl group, an alkoxysulfonyl group, an aryloxy sulfonyl group, an alkanesulfonyl group, an arylsulfonyl group, an alkylthio group, an arylthio group, an alkoxycarbonylamino group, an alkylureido group, an acyl group, a nitro group or a carboxyl group. For example, $R_{12}$ and $R_{13}$ each may be a hydrogen atom or a ballast group.

Preferably, $R_{10}$ is a substituted phenyl group. Examples of substituent groups are a halogen atom (e.g., chlorine, bromine, fluorine), an alkyl group having from 1 to 22 carbon atoms (e.g., methyl, ethyl, propyl, t-butyl, tetradecyl), an alkoxy group having from 1 to 22 carbon atoms (e.g., methoxy, ethoxy, dodecyloxy), an alkoxycarbonyl group having from 1 to 23 carbon atoms (e.g., methoxycarbonyl, ethoxycarbonyl, tetradecyloxycarbonyl), an acylamino group (e.g., α-[3-pentadecylphenoxy]-butylamido group) and/or a cyano group. More preferably, $R_{10}$ is 2,4,6-trichlorophenyl group.

In more detail, $R_{12}$ and $R_{13}$ each represents a hydrogen atom, a halogen atom (e.g., chlorine, bromine, fluorine), a straight-chain or branched alkyl group having from 1 to 30 carbon atoms (e.g., methyl, trifluoromethyl, ethyl, t-butyl, tetradecyl), an alkoxy group having from 1 to 30 carbon atoms (e.g., methoxy, ethoxy, 2-ethylhexyloxy, tetradecyloxy), an acylamino group (e.g., acetamido, benzamido, butylamido, tetradecaneamido, α-(2,4-di-t-pentylphenoxy)acetamido), α -(2,4-di-t-pentylphenoxy)butylamido, α-(4-hydroxy-3-t-butylphenoxy)tetradecaneamido, 2-oxo-pyrrolidine-1-yl, 2-oxy-5-tetradecyl-pyrroline-1-yl, N-methyltetradecane amido, t-butylcarbonamido), a sulfonamido group (e.g., methanesulfonamido, benzenesulfonamido, p-toluenesulfonamido, p-dodecylbenzenesulfonamido, N-methyltetradecylsulfonamido, hexadecanesulfonamido), a sulfamoyl group methylsulfamoyl, N-[3-(dodecyloxy)propyl]sulfamoyl, N-[4-(2,4-di-t-pentylphenoxy)butyl]sulfamoyl, N-methyl-N-tetradecylsulfamoyl, N-dodecylsulfamoyl), a sulfamido group (e.g., N-methylsulfamido, N-octadecylsulfamido), a carbamoyl group (e.g., N-methylcarbamoyl, N-octadecylcarbamoyl, N-[4-(2,4-di-t-pentylphenoxy)butyl]carbamoyl, N-methyl-N-tetradecylcarbamoyl, N,N-di-octylcarbamoyl), a diacylamino group (e.g., N-succinimido, N-phthalimido, 2,5-dioxo-1-oxazolydinyl, 3-dodecyl-2,5 dioxo-1-imidazolyl, N-acetyl-N-dodecylamino), an aryloxycarbonyl group (e.g., phenoxycarbonyl, p-dodecyloxyphenoxycarbonyl), an alkoxycarbonyl group having from 2 to 30 carbon atoms (e.g., methoxycarbonyl, tetradecyloxycarbonyl, ethoxycarbonyl, benzyloxycarbonyl, dodecyloxycarbonyl, an alkoxysulfonyl group having from 1 to 30 carbon atoms (e.g., methoxysulfonyl, octyloxysulfonyl, tetradecyloxysulfonyl, 2-ethylhexyloxysulfonyl), an aryloxysulfonyl group (e.g., phenoxysulfonyl, 2,4-di-t-pentyloxysulfonyl), an alkanesulfonyl group (e.g., methanesulfonyl, octanesulfonyl, 2-ethylhexanesulfonyl), an arylsulfonyl group (e.g., benzenesulfonyl, 4-nonylbenzenesulfonyl, p-toluenesulfonyl, an alkylthio group having from 1 to 22 carbon atoms (e.g., ethylthio, octylthio, benzylthio, tetradecylthio, 2-(2,4-di-t-pentylphenoxy)ethylthio), an arylthio group (e.g., phenylthio, p-tolylthio), an alkoxycarbonylamino group (e.g., ethoxycarbonylamino, benzyloxycarbonylamino, hexadecyloxycarbonylamino), an alkylureido group (e.g., N-methylureido, N,N-dimethylureido, N-methyl-N-dodecylureido, N-hexadecylureido, acyl group (e.g., acetyl, benzoyl, octadecanoyl, p-dodecaneamidobenzoyl, cyclohexanecarbonyl), a nitro group, a cyano group and a carboxyl group.

Examples of the alkoxy group represented by $R_{11}$ include methoxy, ethoxy, propoxy, butoxy, 2-methoxyethoxy, sec-butoxy, hexyloxy, 2 ethylhexyloxy, 2-(2,4-di-t-pentylphenoxy)ethoxy and 2-dodecyloxyethoxy. Examples of the aryloxy group represented by $R_{11}$ include phenoxy, α- or β-naphthyloxy and 4-tolyloxy.

Examples of the coupling elimination group Q of the compounds having formula (I) include, but are not limited to, the following groups:

Q-1)

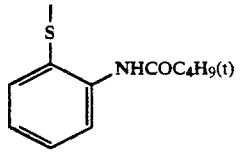

-continued

Q-2)

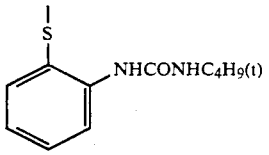

Q-3)

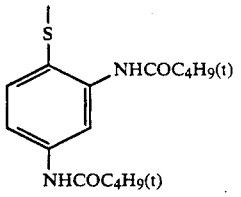

Q-4)

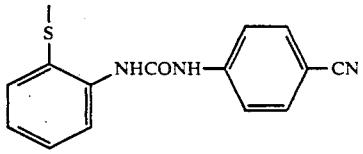

Q-5)

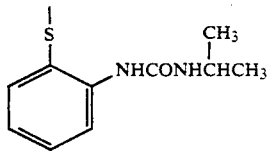

Q-6)

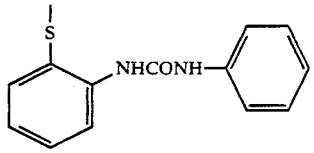

Q-7)

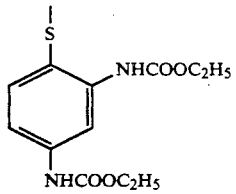

Q-8)

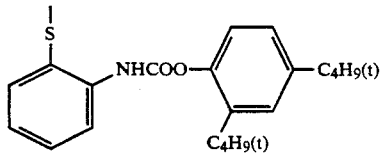

Q-9)

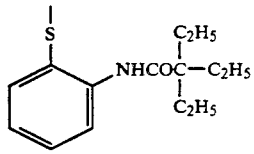

-continued
Q-10)
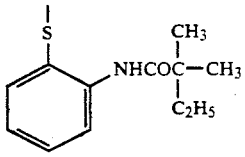
Q-11)
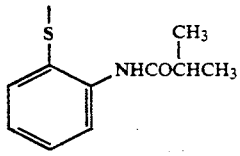
Q-12)
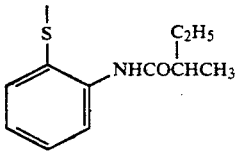
Q-13)
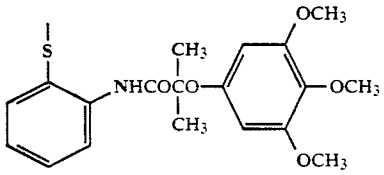
Q-14)
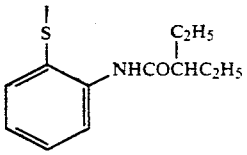
Q-15)
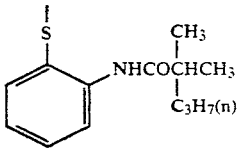
Q-16)
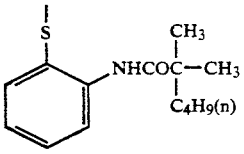
Q-17)
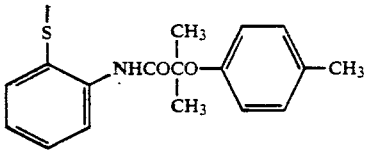
Q-18)
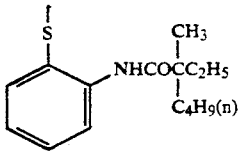
-continued
Q-19)
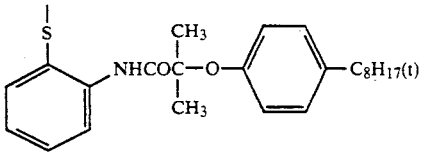
Q-20)
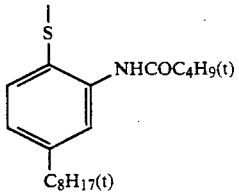
Q-21)
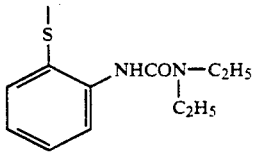
Q-22)
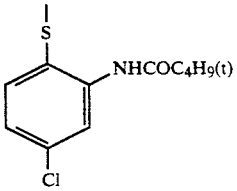
Q-23)
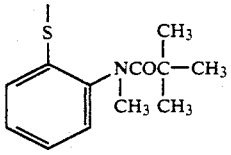
Q-24)
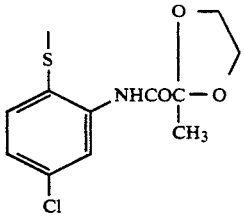
Q-25)
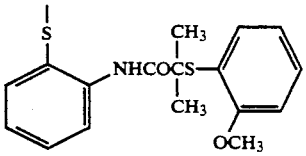
Q-26)
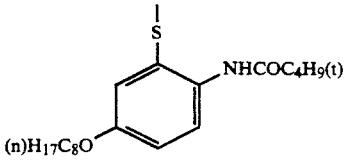

-continued
Q-27)
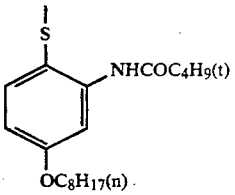
Q-28)
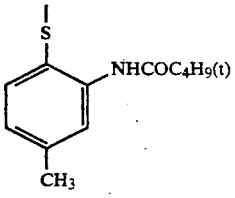
Q-29)
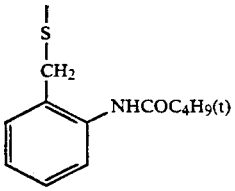
Q-30)
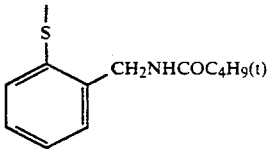
Q-31)
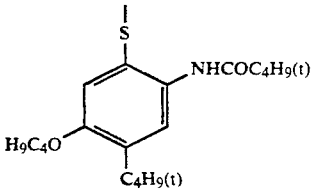
Q-32)
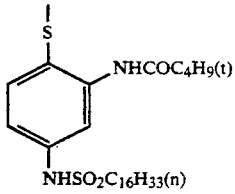
Q-33)
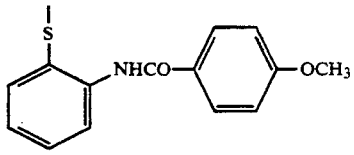
Q-34)
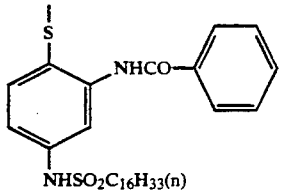
-continued
Q-35)
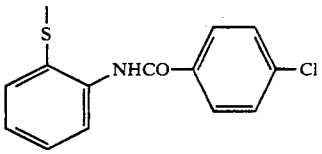
Q-36)
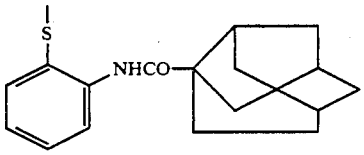
Q-37)
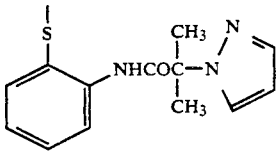
Q-38)
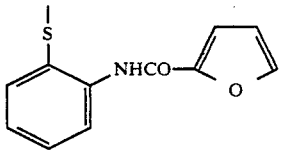
Q-39)
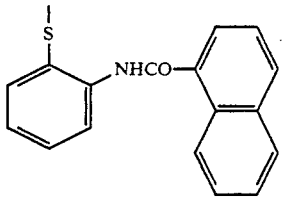
Q-40)
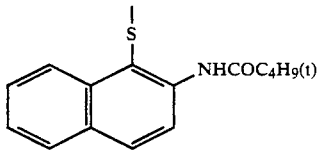
Q-41)
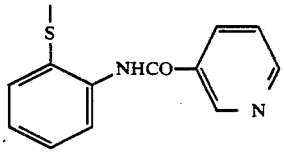
Q-42)
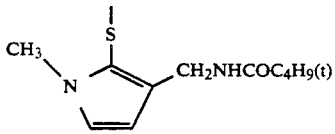
Q-43)
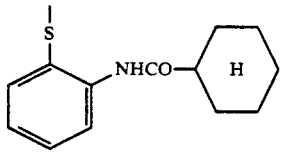

-continued
Q-44)
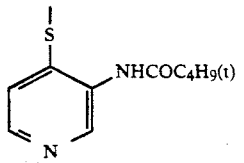
Q-45)
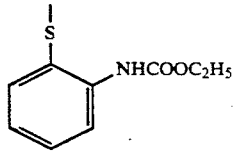
-continued
Q-46)
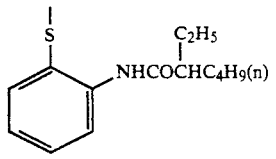
Examples of the couplers of the present invention include, but are not limited to, the following compounds.
(M-1)
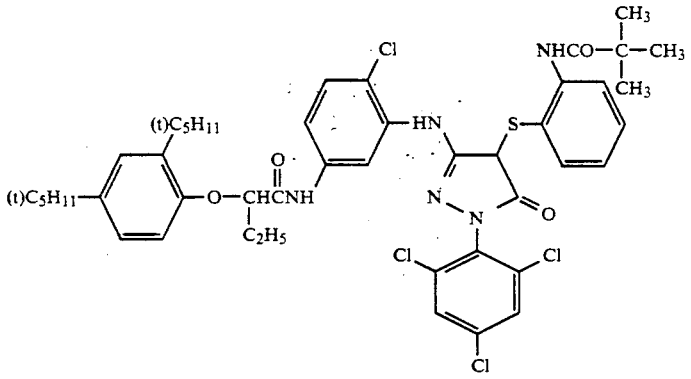
(M-2)
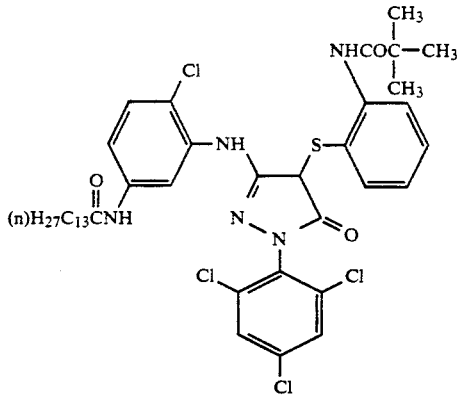
(M-3)
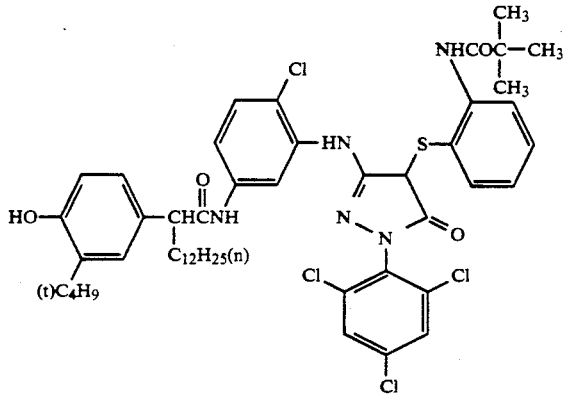

-continued
(M-4)
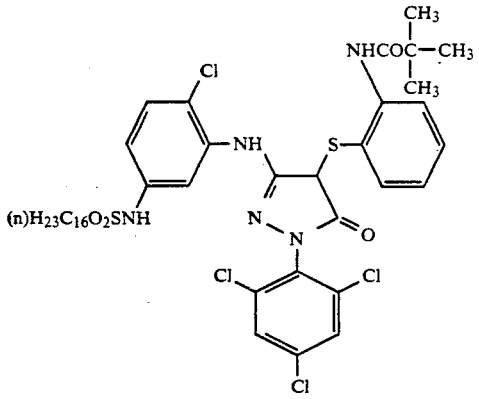
(M-5)
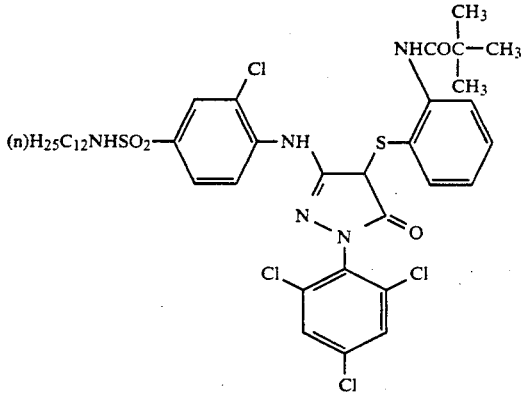
(M-6)
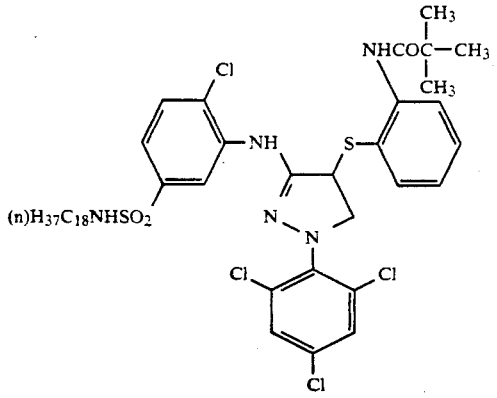
(M-7)
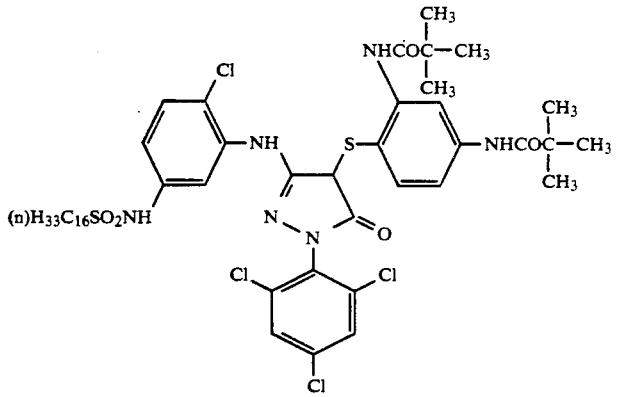

-continued
(M-8)
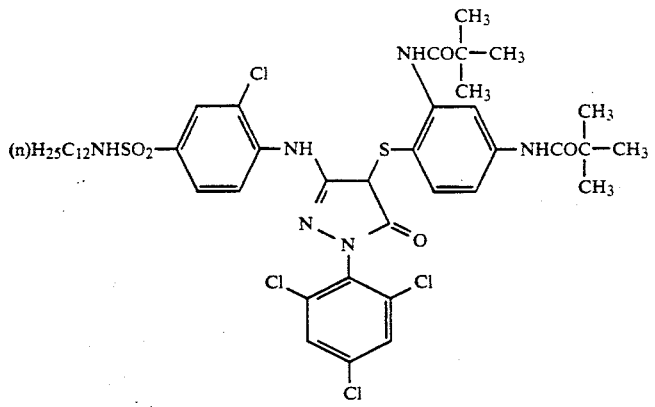
(M-9)
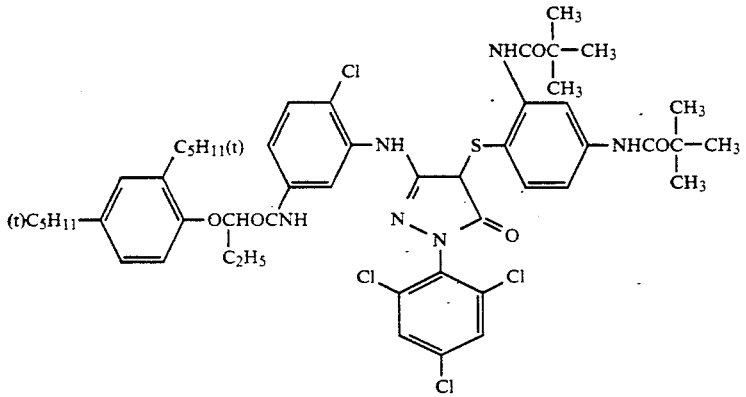
(M-10)
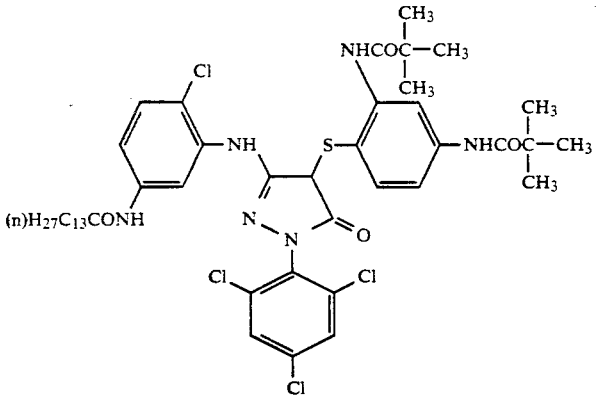
(M-11)
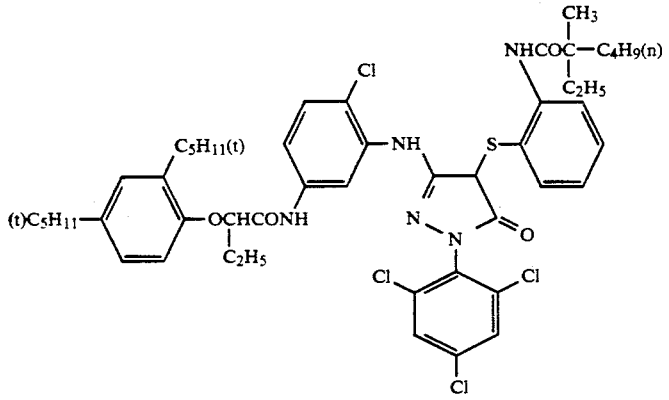

-continued
(M-12)
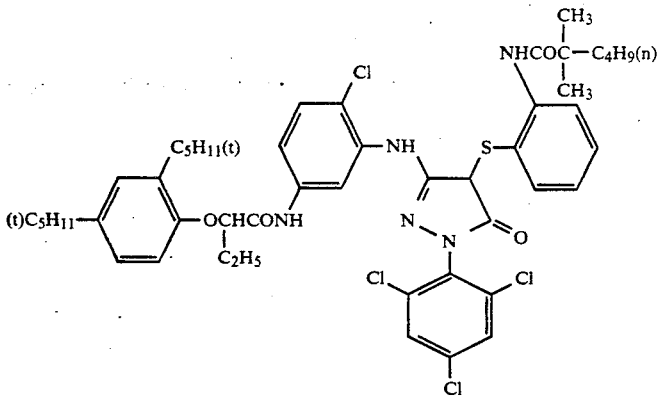
(M-13)
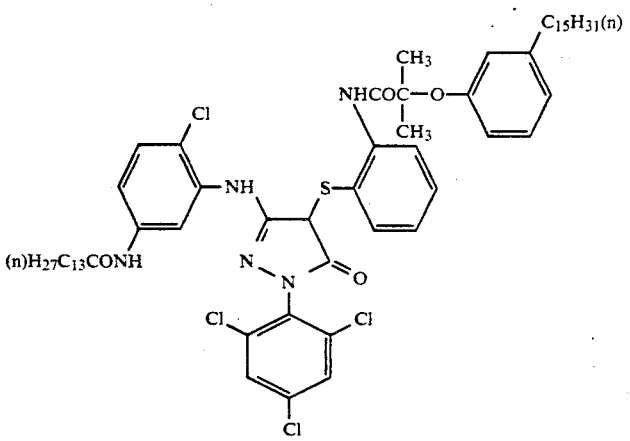
(M-14)
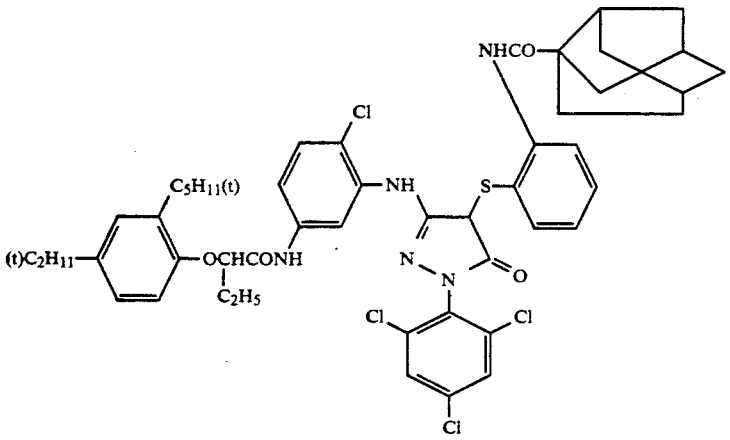

-continued
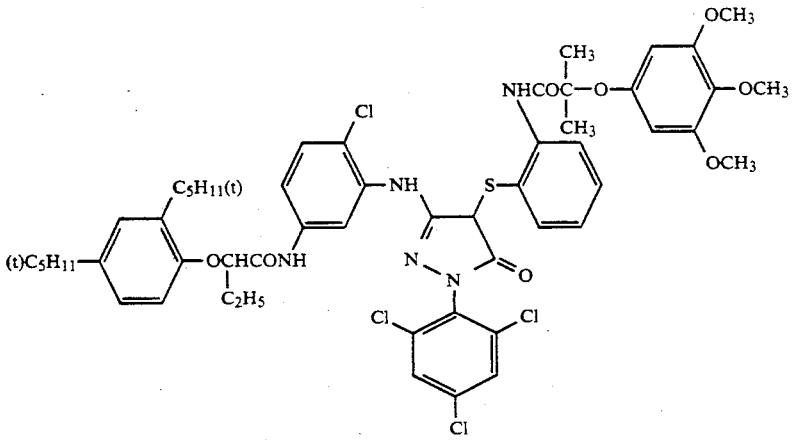
(M-15)
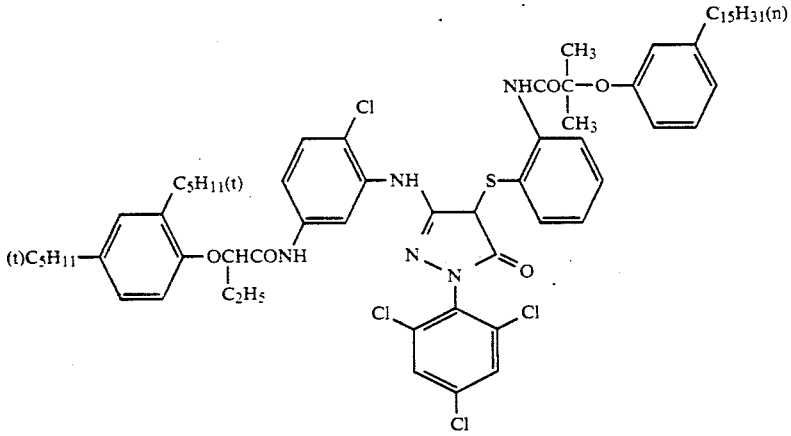
(M-16)
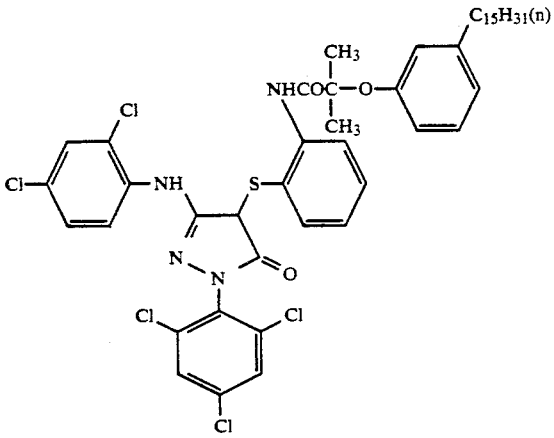
(M-17)

-continued
(M-18)
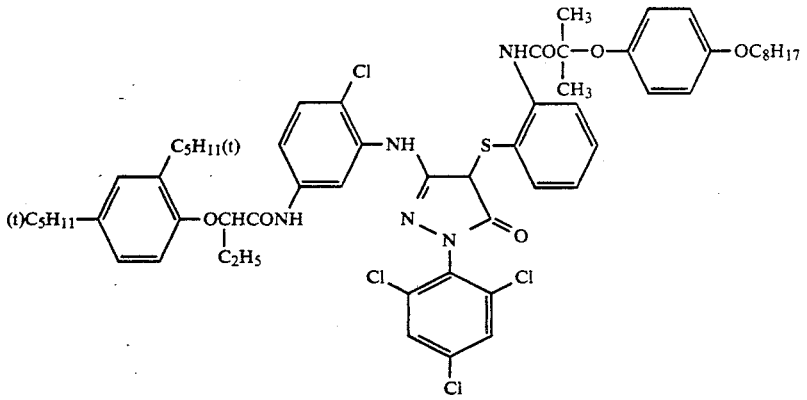
(M-19)
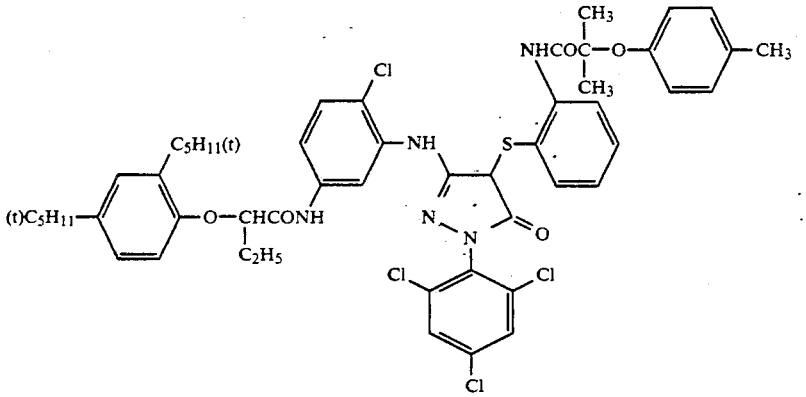
(M-20)
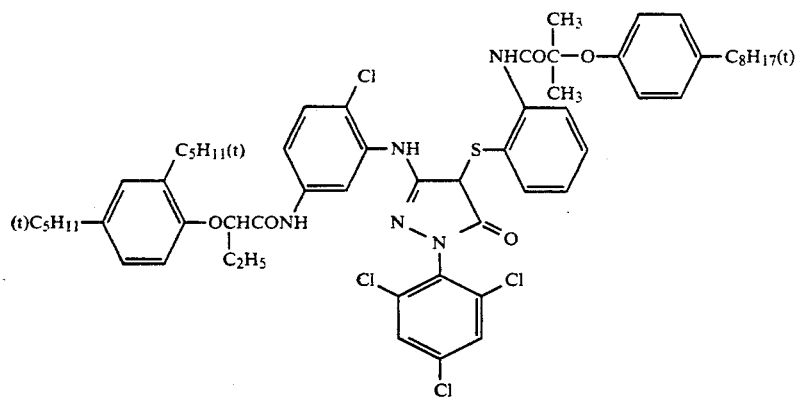
(M-21)
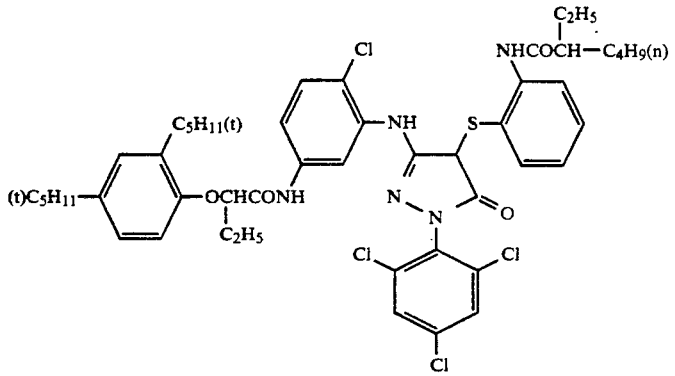

-continued
(M-22)
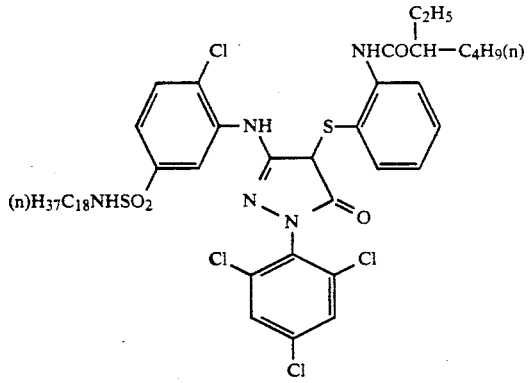
(M-23)
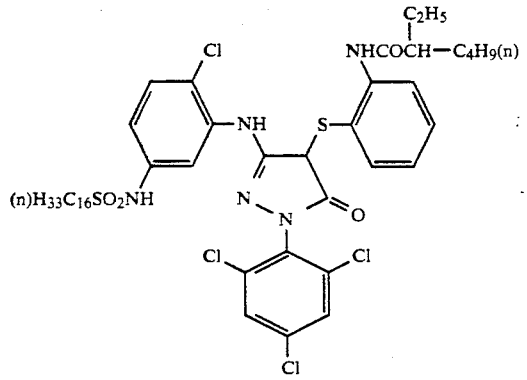
(M-24)
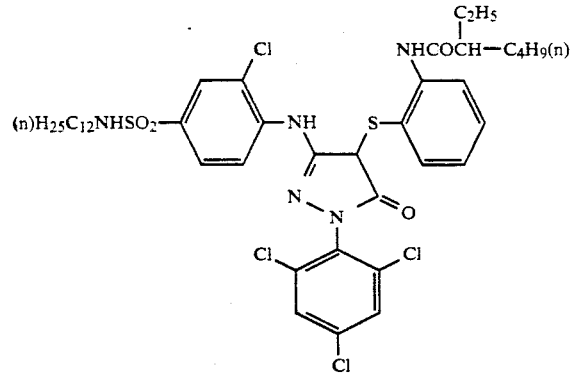
(M-25)
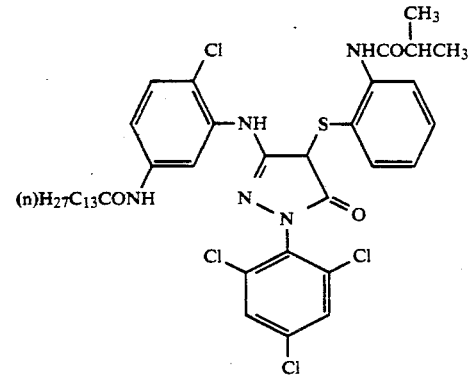

-continued
(M-26)
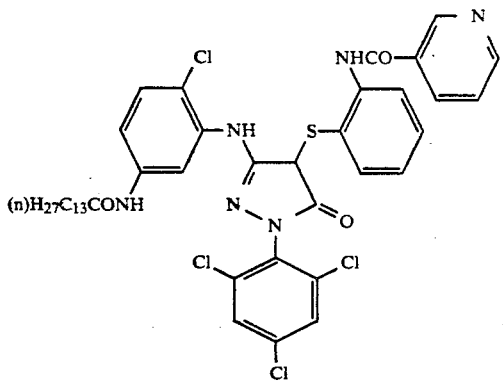
(M-27)
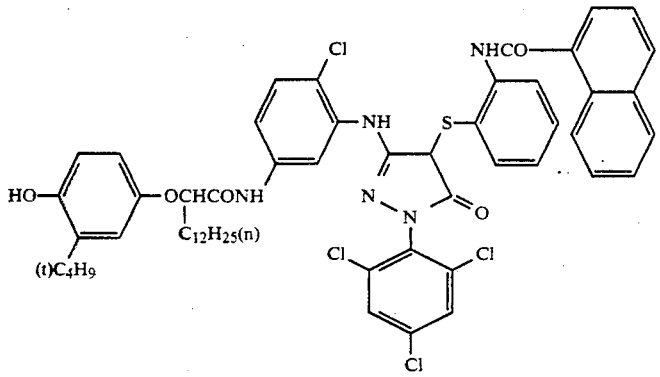
(M-28)
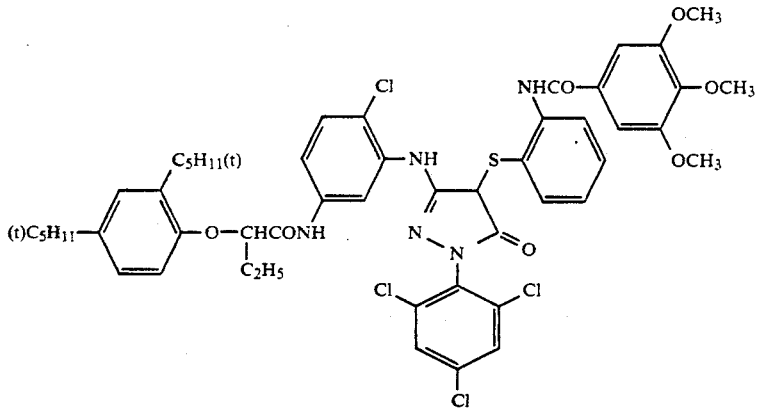
(M-29)
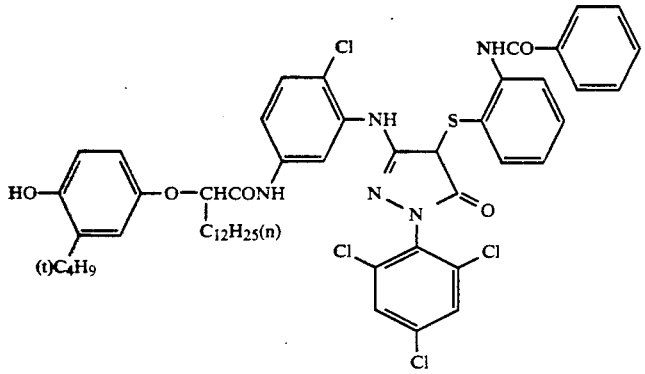

-continued
(M-30)
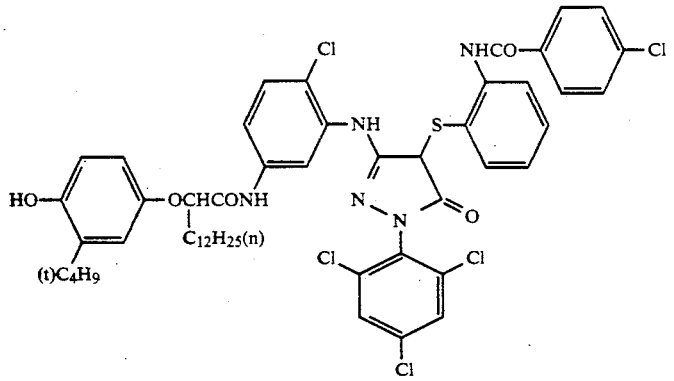
(M-31)
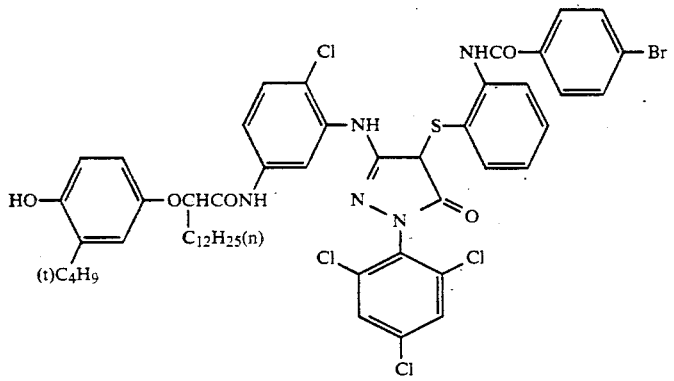
(M-32)
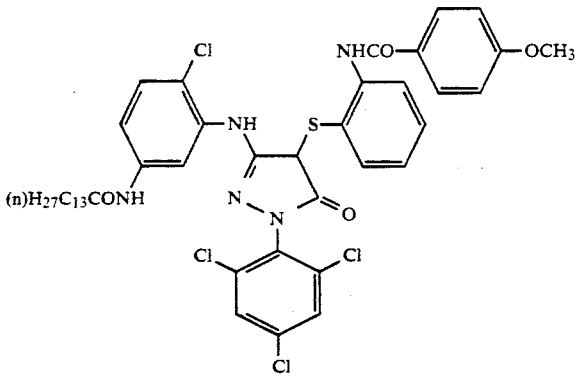
(M-33)
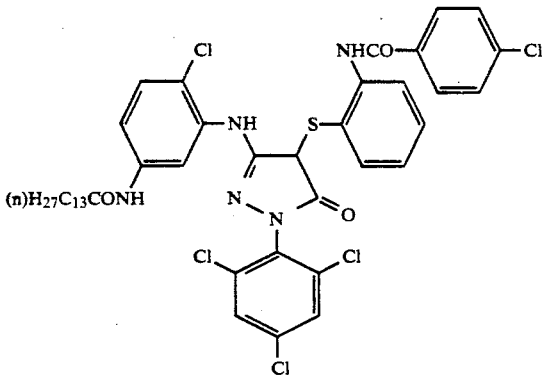

-continued
(M-34)
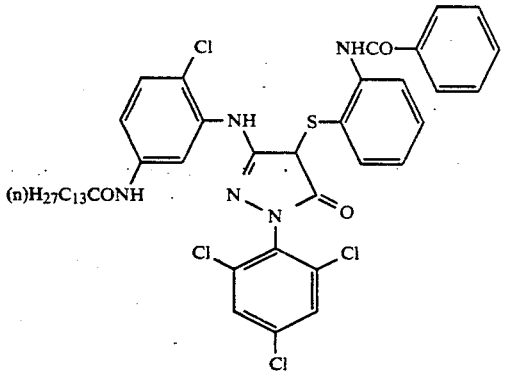
(M-35)
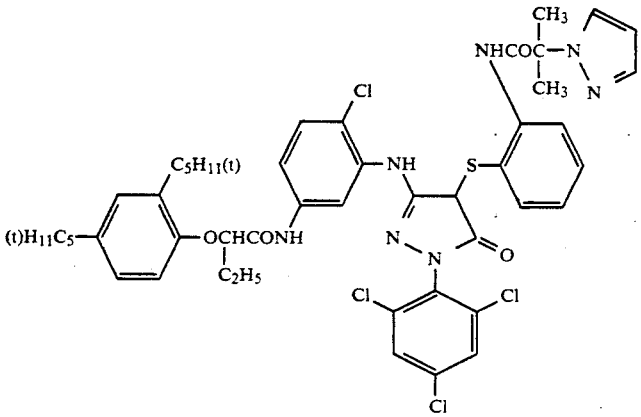
(M-36)
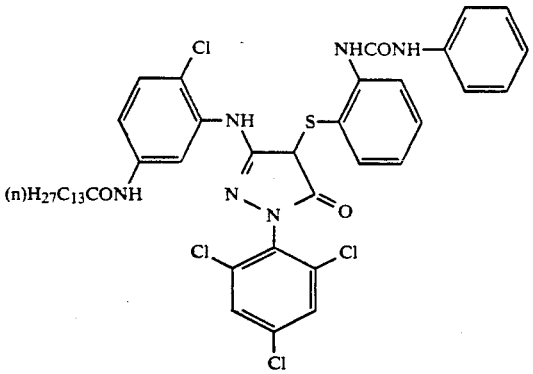
(M-37)
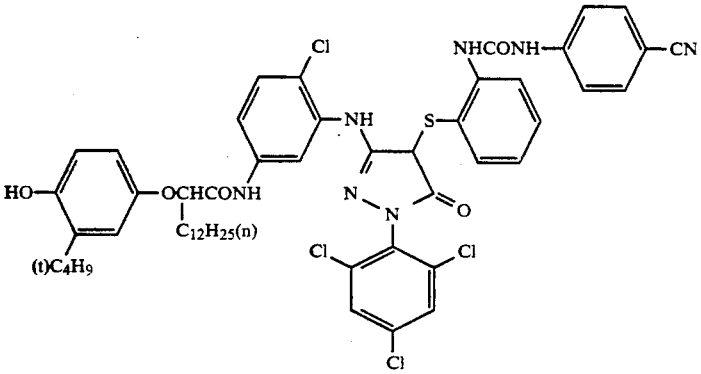

-continued
(M-38)
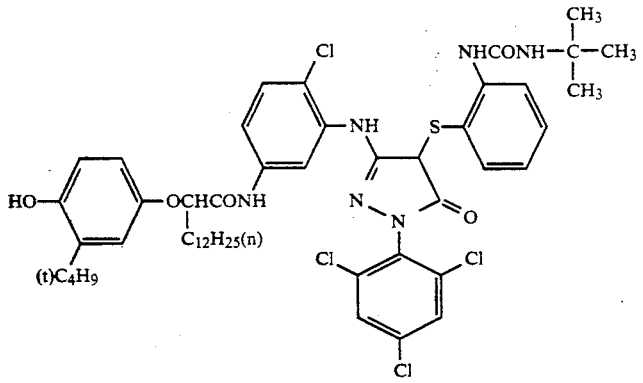
(M-39)
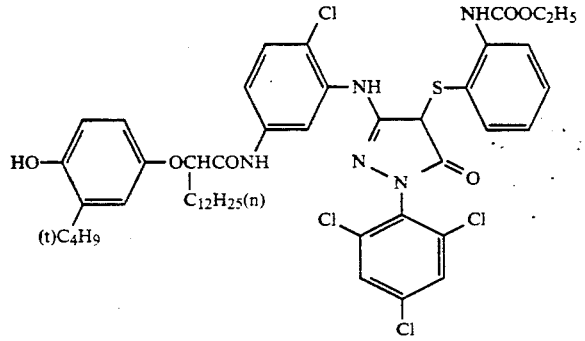
(M-40)
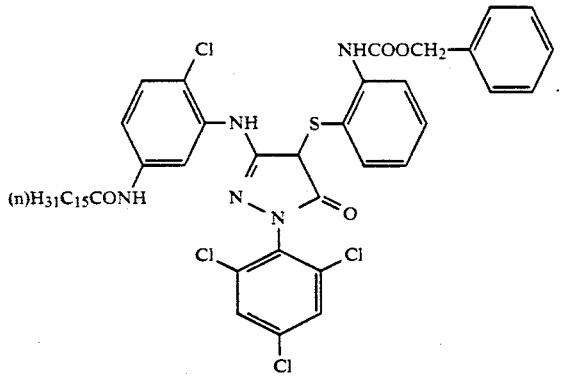
(M-41)
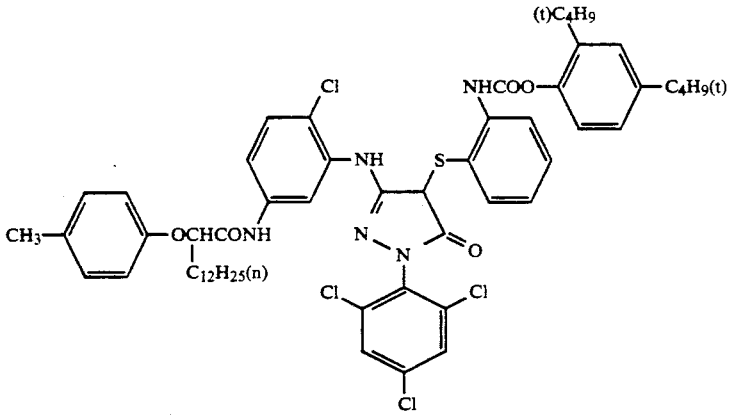

-continued
(M-42)
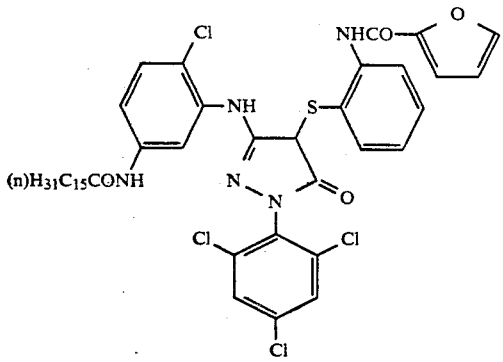
(M-43)
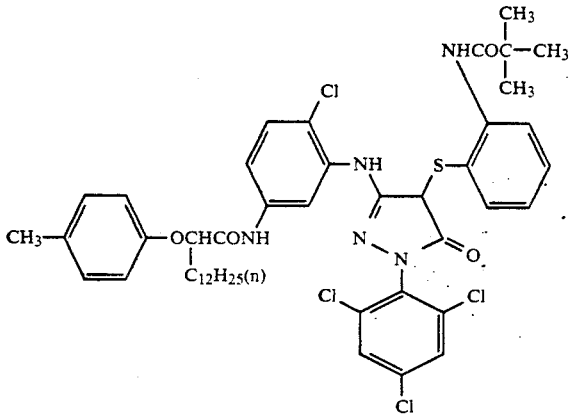
(M-44)
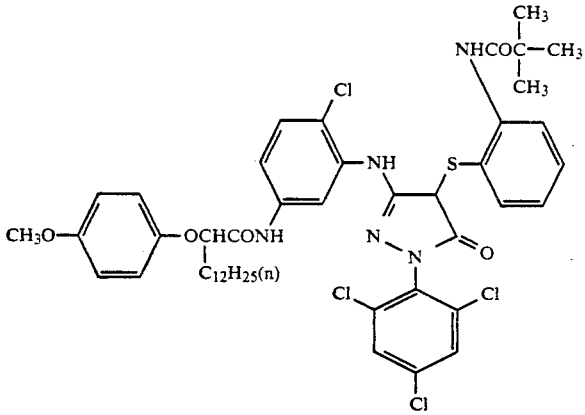
(M-45)
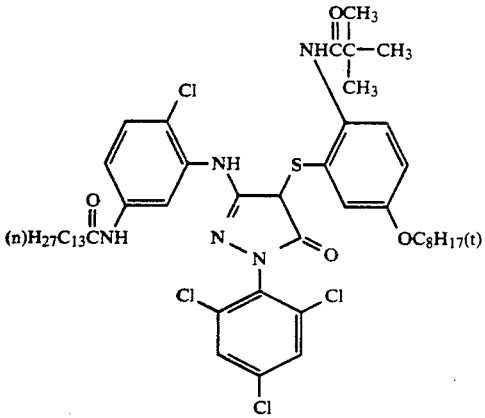

-continued (M-46)

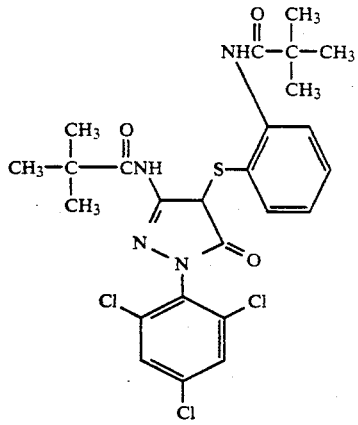

(M-47)

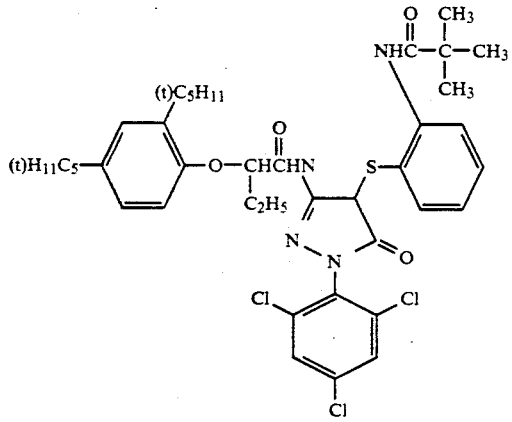

(M-48)

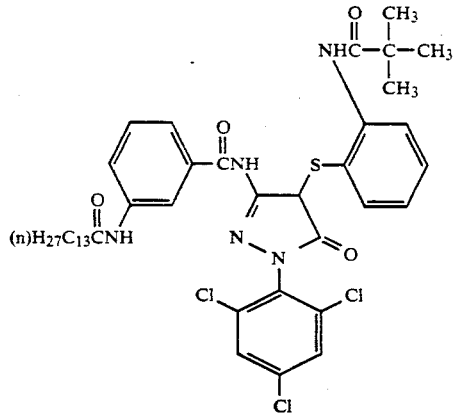

The magenta couplers having an elimination group, represented by formula (I) according to the present invention, can be synthesized according to the method described in WO-88-4795 or the corresponding methods.

Now, the compounds represented by the formulas (AI), (AII) and (AIII) will be illustrated in more detail hereinbelow.

With regard to the compounds having the formulas (AI) and (AII), there are preferred compounds having a second-order reaction constant $k_2$ (80° C.) (in terms of the reaction with p-anisidine) of from 1.0 to $1\times10^{-5}$ l/mol.sec as measured by the method described in JP-A-63-158545, from the viewpoint of the effect of the present invention. With regard to the compounds having the formula (AIII), there are preferred compounds where Z is a group derived from a nucleophilic functional group having a Pearson's nucleophilic "$CH_3I$ value [R. G. Pearson, et al., J. Am. Chem. Soc., 90319 (1968)] of 5 or above.

Among the compounds having the formulas (AI), (AII) and (AIII), it is preferred that the compounds having the formula (AI) or (AII) are used together with the compound having the formula (AIII).

The aliphatic group represented by $R_1$, $R_2$, B and R is a straight-chain, branched or cyclic alkyl, alkenyl or alkinyl group. These groups may be optionally substituted. The aromatic group represented by $R_1$, $R_2$, B and R is a carbon ring type aromatic group (e.g., phenyl, naphthyl) or a heterocyclic type aromatic group (e.g., furyl, thienyl, pyrazolyl, pyridyl, indolyl). These groups may be a monocyclic type or a condensed ring type (e.g., benzofuryl, phenanthridinyl). The aromatic ring of these groups may be optionally substituted. The heterocyclic group represented by $R_1$, $R_2$, B and R is preferably a group having a three-membered to ten-membered ring structure composed of carbon atoms, oxygen atoms, nitrogen atoms, sulfur atoms and hydrogen atoms (e.g., coumanyl, pyrrolidyl, pyrrolinyl, morpholinyl). The heterocyclic ring itself may be a saturated ring or an unsaturated ring, or may be optionally substituted. (In the present invention, these definitions may be applied to other such groups recited herein and which are not specifically defined.)

The group X of the formula (AI) is a group which is eliminated by the reaction with aromatic amine developing agents, preferably a group attached to A through an oxygen atom, a sulfur atom or a nitrogen atom (e.g., 3-pyrazolyloxy group, 3H-1,2,4-oxadiazolin-5-oxy group, aryloxy group, alkoxy group, alkylthio group, arylthio group, substituted N-oxy group, etc.) or a halogen atom.

The group A of the formula (AI) is a group which forms a chemical bond by the reaction with aromatic amine developing agents, containing an atom having a low electron density such as

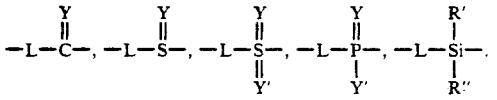

When X is a halogen atom, n is 0. In the above formulas, L is a single bond, an alkylene group,

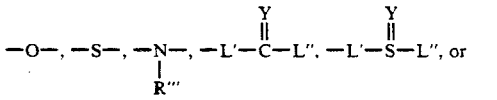

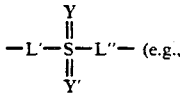

carbonyl group, sulfonyl group, sulfinyl group, oxycarbonyl group, phosphonyl group, thiocarbonyl group, aminocarbonyl group, silyloxy group, etc.).

Y has the same meaning as in formula (AII) and Y' has the same meaning as Y.

R' and R'' may be the same or different groups and each is a group of —L'''—$R_0$.

$R_0$ has the same meaning as $R_1$. R''' is a hydrogen atom, an aliphatic group (e.g., methyl, isobutyl, t-butyl, vinyl, benzyl, octadecyl, cyclohexyl, etc.), an aromatic group (e.g., phenyl, pyridyl, naphthyl, etc.), a heterocyclic group (e.g., piperidinyl, pyranyl, furanyl, chromanyl, etc.), an acyl group (e.g., acetyl, benzoyl, etc.) or a sulfonyl group (e.g., methanesulfonyl, benzenesulfonyl, etc.).

L', L'' and L''' are each —O—,

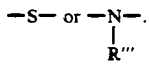

Among the groups represented by A, there are preferred bivalent groups represented by

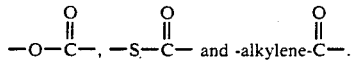

Among the compounds having the formula (AI), there are preferred compounds having a second-order reaction constant $k_2$ (80° C.) (in terms of the reaction with p-anisidine) of from $1\times10^{-1}$ l/mol.sec to $1\times10^{-5}$ l/mol.sec, represented by the following formulas (AI-a), (AI-b), (AI-c) and (AI-d):

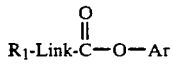

(AI-a)

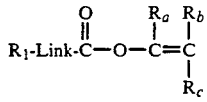

(AI-b)

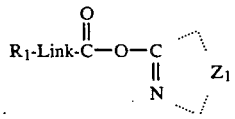

(AI-c)

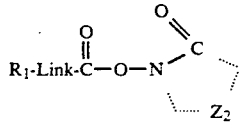

(AI-d)

In the above formulas, $R_1$ is the same as those set forth for $R_1$ of formula (AI); "Link" is a single bond or —O—; Ar is an aromatic group (the aromatic group is not a group useful as a photographic reducing agent such as hydroquinone derivative, catechol derivative, etc. as a result of the reaction with the aromatic amine developing agent); $R_a$, $R_b$ and $R_c$ may be the same or different groups and each is a hydrogen atom, an aliphatic group, an aryloxy group, a heterocyclic oxy group, a carboxyl group, an alkylthio group, an arylthio group, a heterocyclic thio group, an amino group, an alkylamino group, an acylamino group, a sulfonamide group, an acyl group, a sulfonyl group, an alkoxycarbonyl group, a sulfo group, a hydroxy group, an ureido group, a urethane group, a carbamoyl group or a sulfamoyl group. $R_a$ and $R_b$, or $R_b$ and $R_c$, may be combined together to form a five-membered to a seven-membered heterocyclic ring. The heterocyclic ring may be optionally substituted, it may form a spiro ring, a bicyclo ring, etc., or it may be condensed with an aromatic ring. $Z_1$ and $Z_2$ are each a non-metallic atomic group required for forming a five-membered to a seven-membered heterocyclic ring. The heterocyclic ring may be optionally substituted, may form a spiro ring, a bicyclo ring, etc., or may be condensed with an aromatic ring.

Among the compounds having formulas (AI-a) to (AI-d), the second-order reaction constant $k_2$ (80° C.) (in terms of the reaction with p-anisidine) of particularly the compounds having the formula (AI-a) can be adjusted by substituent groups to a value of from $1\times10^{-1}$ l/mol.sec to $1\times10^{-5}$ l/mol.sec when Ar is a carbon ring type aromatic group. In this case, the sum total of Hammett's $\rho$ values of the substituent groups is preferably at least 0.2, more preferably at least 0.4, particularly at least 0.6, though the value varies depending on the type of the substituent groups.

When the compounds having formulas (AI-a) to (AI-d) are to be added during the course of the preparation of the photographic materials, the sum total of the carbon atoms of the compound itself is preferably at least 13 and the larger the number of the carbon atoms, the more preferable.

For the purpose of achieving the objects of the present invention, compounds which are decomposed during development are not preferred.

Y in the formula (AII) is preferably an oxygen atom, a sulfur atom or a group of $=N-R_4$ or

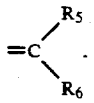

$R_4$, $R_5$ and $R_6$ are each a hydrogen atom, an aliphatic group (e.g., methyl, isopropyl, t-butyl, vinyl, benzyl, octadecyl, cyclohexyl), an aromatic group (e.g., phenyl, pyridyl, naphthyl), a heterocyclic group (e.g., piperidyl, pyanyl, furanyl, chromanyl), an acyl group (e.g., acetyl, benzoyl) or a sulfonyl group (e.g., methanesulfonyl, benzenesulfonyl). $R_5$ and $R_6$ may be combined together to form a ring structure.

The group Z in the formula (AIII) is a nuclephilic group or a group which is decomposed in the photographic materials or the photograph during storage thereof to release a nucleophilic group. There are preferred nucleophilic groups where the atom which is chemically bonded directly to the oxidized product of the aromatic amine developing agent is an oxygen atom, a sulfur atom or a nitrogen atom. Preferred examples of the nucleophilic groups are a benzenesulfinyl group, primary amines, etc.

Among the compounds having the formula (AIII), compounds having the following formula (AIII-a) are preferred:

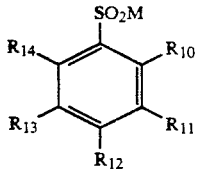

(AIII-a)

In the above formula, M is an atom or an atomic group capable of forming an inorganic salt (e.g., Li, Na, k, Ca, Mg, etc.) or an inorganic salt (e.g., triethylamine, methylamine, ammonium, etc.), or a group of the following formulas:

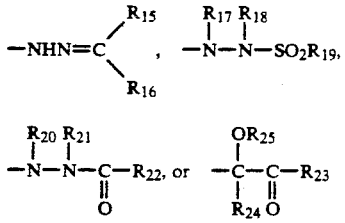

wherein $R_{15}$ and $R_{16}$ may be the same or different groups and each is independently a hydrogen atom, an aliphatic group, an aromatic group or a heterocyclic group, or $R_{15}$ and $R_{16}$ may be combined together to form a five-membered to a seven-membered ring; $R_{17}$, $R_{18}$, $R_{20}$ and $R_{21}$ may be the same or different groups and each is independently a hydrogen atom, an aliphatic group, an aromatic group, a heterocyclic group, an acyl group, an alkoxycarbonyl group, a sulfonyl group, an ureido group or a urethane group with the proviso that at least one of $R_{17}$ and $R_{18}$ and at least one of $R_{20}$ and $R_{21}$ are a hydrogen atom; and $R_{19}$ and $R_{22}$ are each a hydrogen atom, an aliphatic group, an aromatic group or a heterocyclic group, and $R_{19}$ is further an alkylamino group, an arylamino group, an alkoxy group, an aryloxy group, an acyl group, an alkoxycarbonyl group or an aryloxycarbonyl group. At least two groups of $R_{17}$, $R_{18}$ and $R_{19}$ may be combined together to form a five-membered to a seven-membered ring. At least two groups of $R_{20}$, $R_{21}$ and $R_{22}$ may be combined together to form a five membered to a seven membered ring. $R_{23}$ is a hydrogen atom, an aliphatic group, an aromatic group or a heterocyclic group; $R_{24}$ is a hydrogen atom, an aliphatic group, an aromatic group, a halogen atom, an acyloxy group or a sulfonyl group; and $R_{25}$ is a hydrogen atom or a hydrolyzable group.

$R_{10}$, $R_{11}$, $R_{12}$, $R_{13}$ and $R_{14}$ may be the same or different groups and each is a hydrogen atom, an aliphatic group (e.g., methyl, isopropyl, t-butyl, vinyl, benzyl, octadecyl, cyclohexyl), an aromatic group (e.g., phenyl, pyridyl, naphthyl), a heterocyclic group (e.g., piperidyl, pyranyl, furanyl, chromanyl), a halogen atom (e.g., chlorine, bromine), $-SR_{26}-$, $-OR_{26}$,

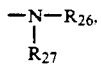

an acyl group (e.g., acetyl, benzoyl), an alkoxycarbonyl (e.g., methoxycarbonyl, butoxycarbonyl, cyclohexylcarbonyl, octyloxycaronbyl), an aryloxycaronbyl group (e.g., phenyloxycarbonyl, naphthyloxycarbonyl), a sulfonyl group (e.g., methanesulfonyl, benzenesulfonyl), a sulfamido group (e.g., methanesulfonamido, benzenesulfonamido), a sulfamoyl group, an ureido group, a urethane group, a carbamoyl group, a sulfo group, a carboxyl group, a nitro group, a cyano group, an alkoxalyl group (e.g., methoxalyl, isobutoxalyl, octyloxalyl, benzoyloxalyl), an aryloxalyl group (e.g., phenoxalyl, naphthoxalyl), a sulfonyloxy group (e.g., methanesulfonyloxy, benzenesulfonyloxy), $-P(R_{26})_2$,

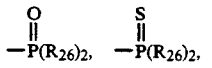

$-P(OR_{26})_2$ or a formyl group. $R_{26}$ and $R_{27}$ are each a hydrogen atom, an aliphatic group, an alkoxy group or an aromatic group. Among these groups, it is preferred that the total of Hammett's $\rho$ values to the $-SO_2M$ group is 5 or above from the viewpoint of the effect of the present invention.

Among the compounds having the formulas (AI) to (AIII), the preferred compounds having each of the formulas (AI) to (AIII) have been described above. On the whole, the compounds having the formulas (AI) and (AIII) are preferred.

Typical examples of these compounds include, but are not limited to, the following compounds:

(I-1)
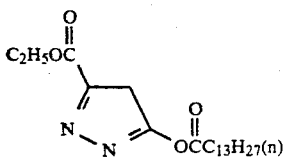
(I-2)
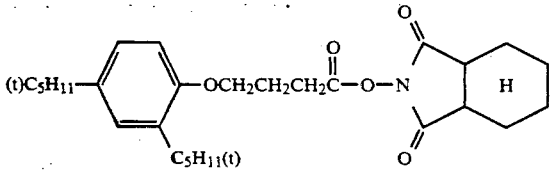
(I-3)
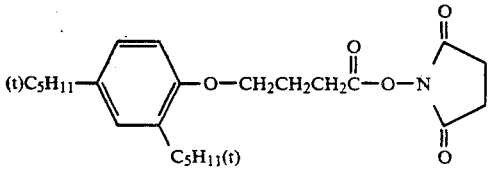
(I-4)
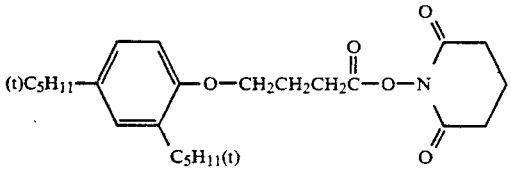
(I-5)
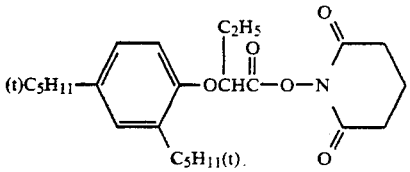
(I-6)
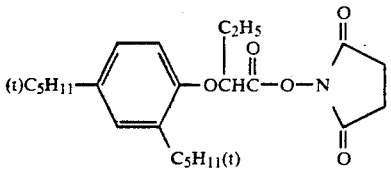
(I-7)
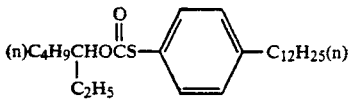
(I-8)
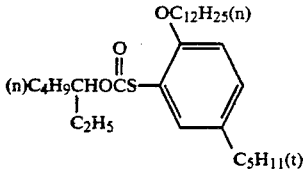
(I-9)
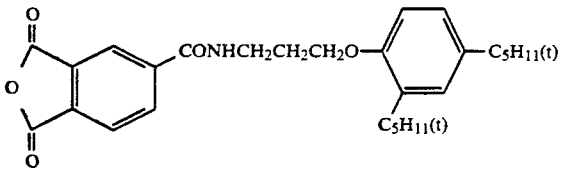

-continued
(I-10)
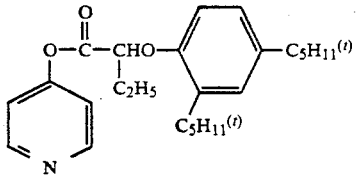
(I-11)
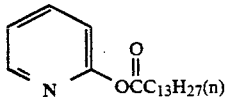
(n)$C_{18}H_{37}I$ (I-12)
(n)$C_{18}H_{37}Br$ (I-13)
(I-14)
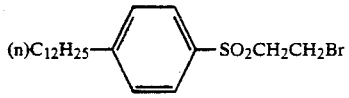
(I-15)
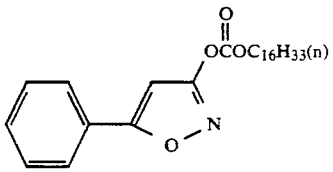
(I-16)
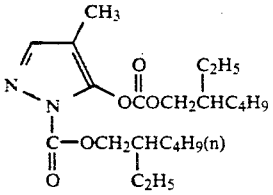
(I-17)
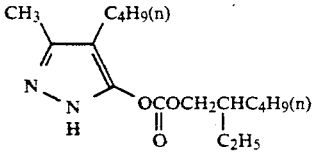
(I-18)
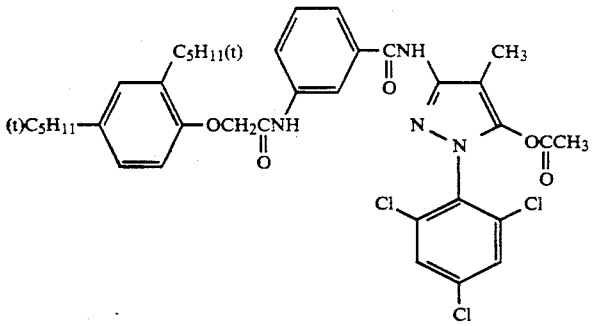
(I-19)
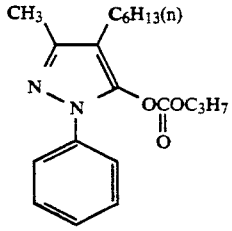

-continued
(I-20)
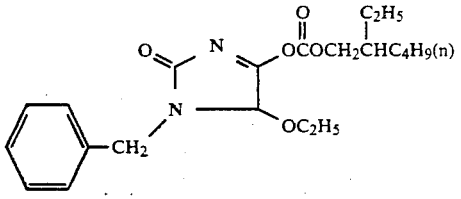
(I-21)
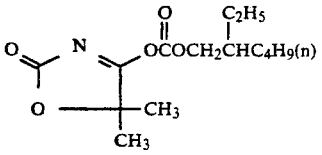
(I-22)
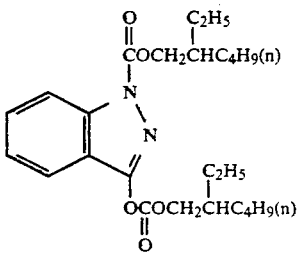
(I-23)
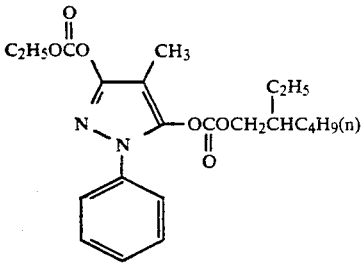
(I-24)
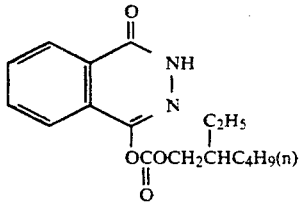
(I-25)
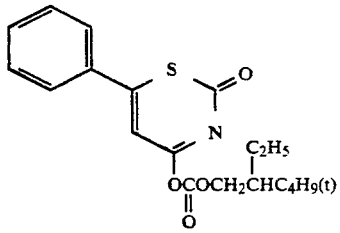
(I-26)
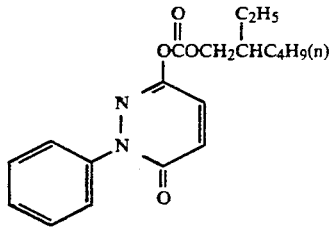

-continued
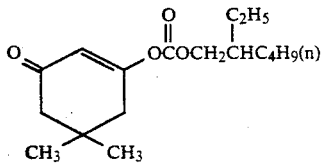
(I-27)
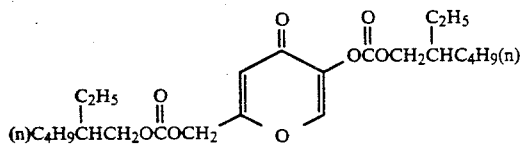
(I-28)
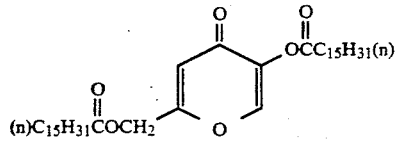
(I-29)
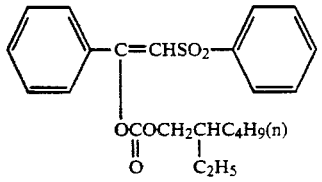
(I-30)
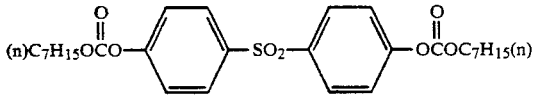
(I-31)
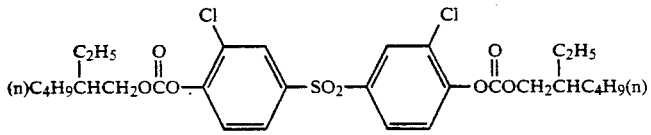
(I-32)
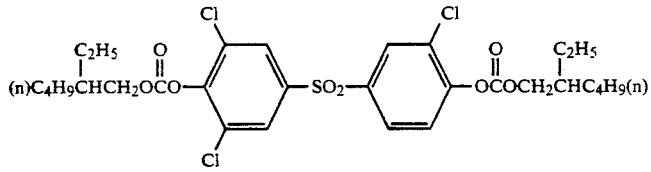
(I-33)
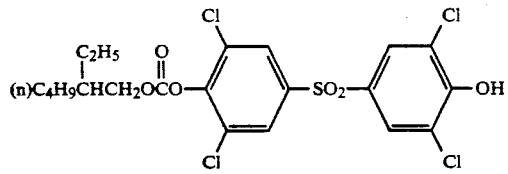
(I-34)
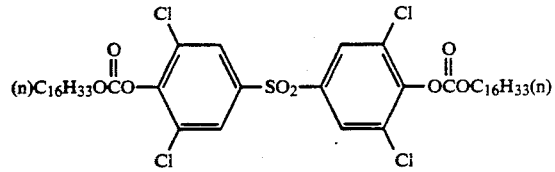
(I-35)
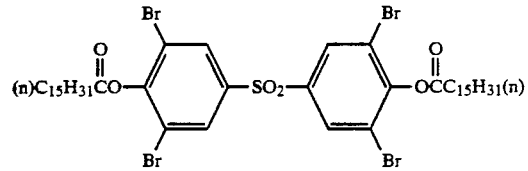
(I-36)

-continued
(I-37)
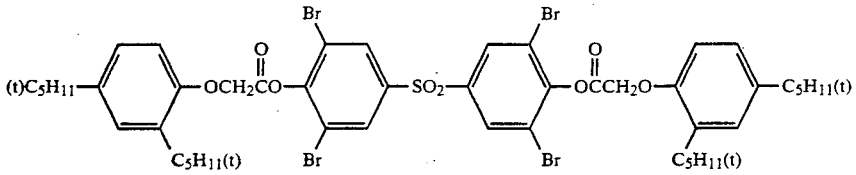
(I-38)
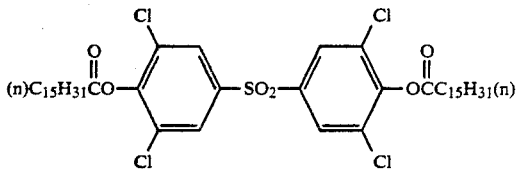
(I-39)
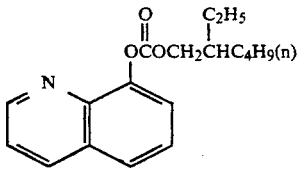
(I-40)
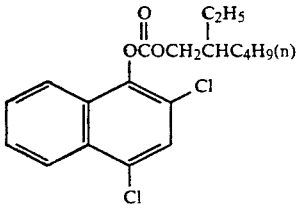
(I-41)
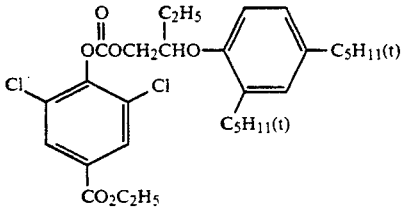
(I-42)
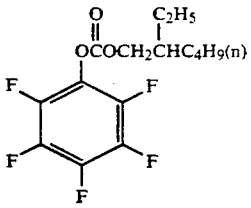
(I-43)
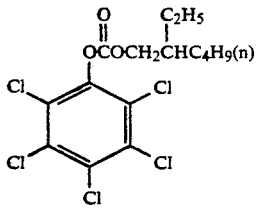
(I-44)
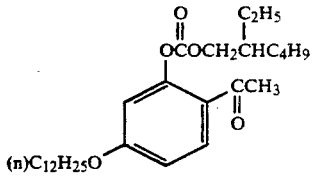

-continued
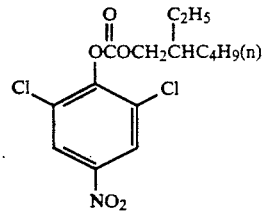
(I-45)
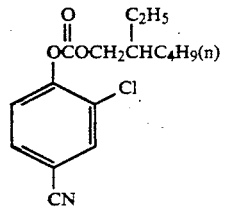
(I-46)
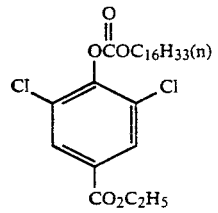
(I-47)
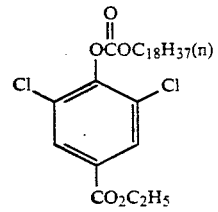
(I-48)
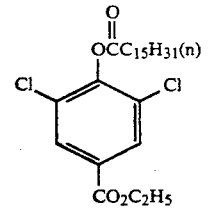
(I-49)
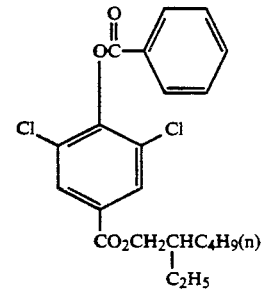
(I-50)

-continued
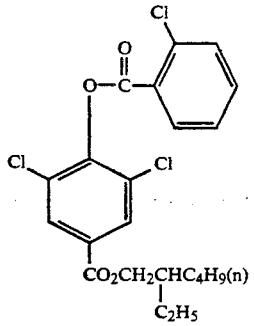
(I-51)
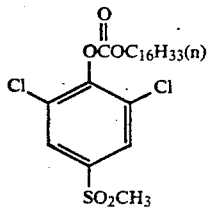
(I-52)
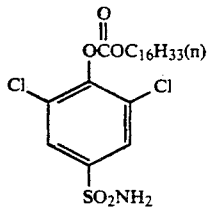
(I-53)
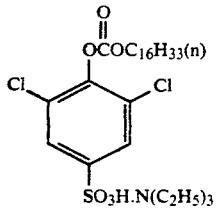
(I-54)
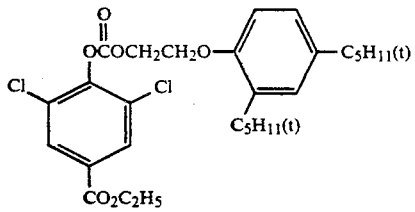
(I-55)
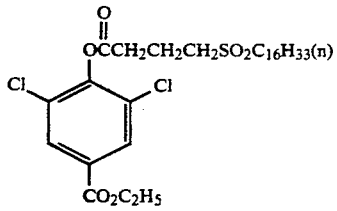
(I-56)
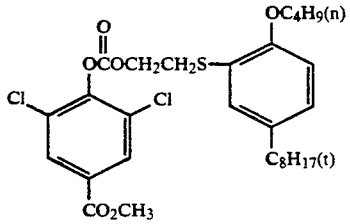
(I-57)

-continued
(I-58)
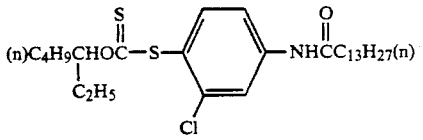
(I-59)
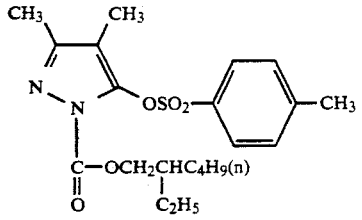
(I-60)
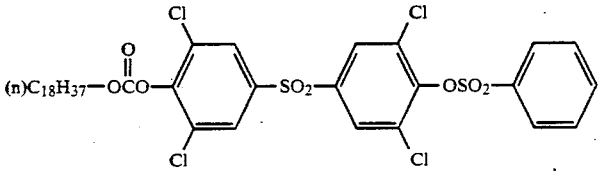
(I-61)
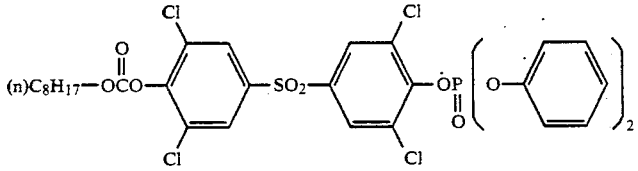
(I-62)
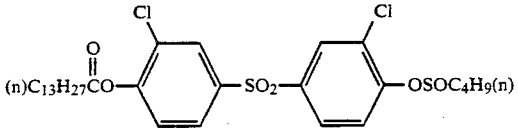
(I-63)
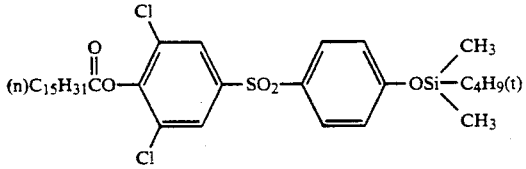
(I-64)
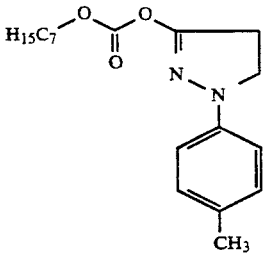
(I-65)
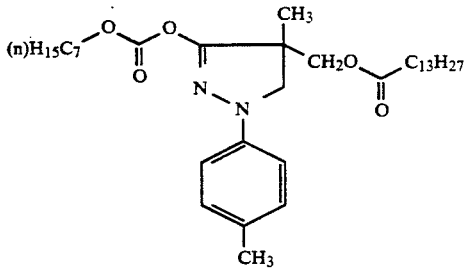

-continued
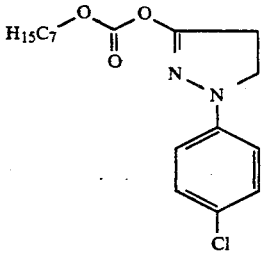
(I-67)
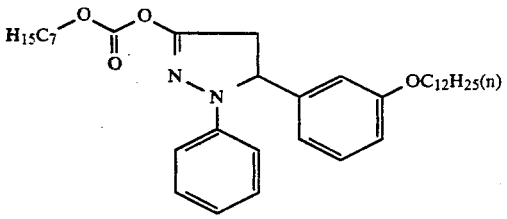
(I-68)
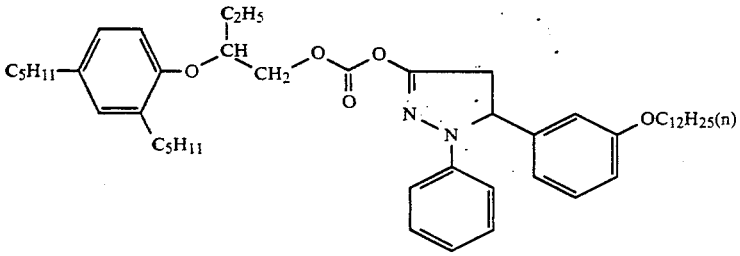
(I-69)
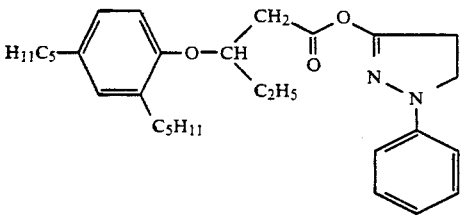
(I-70)
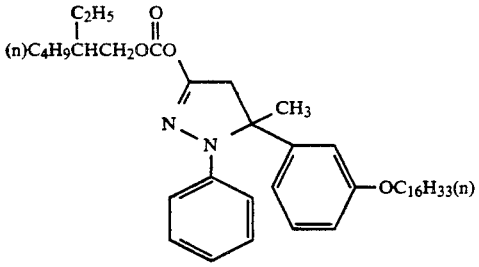
(I-71)
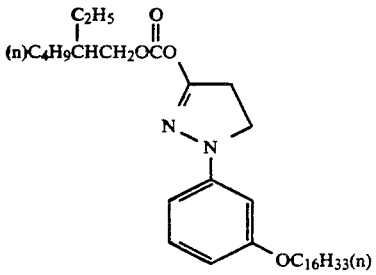
(I-72)

-continued
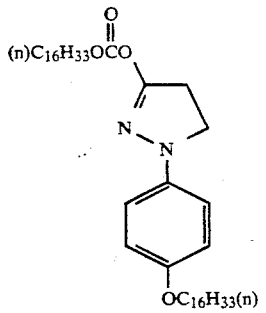
(I-73)
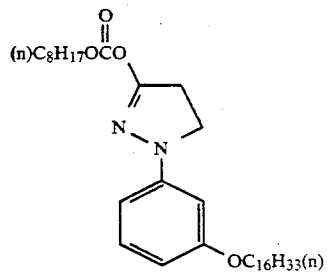
(I-74)
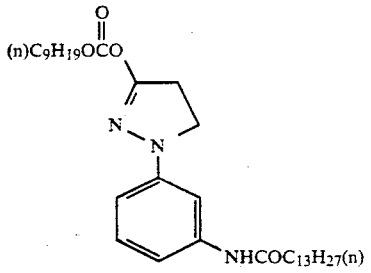
(I-75)
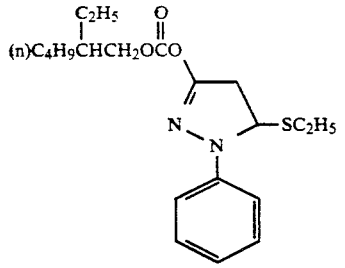
(I-76)
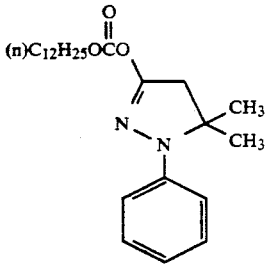
(I-77)

-continued
(I-78)
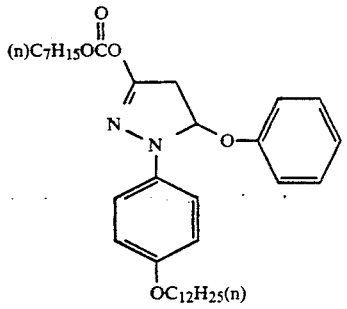
(I-79)
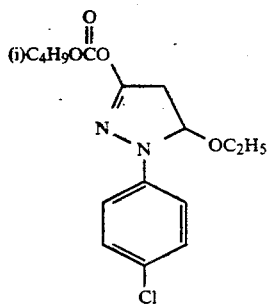
(I-80)
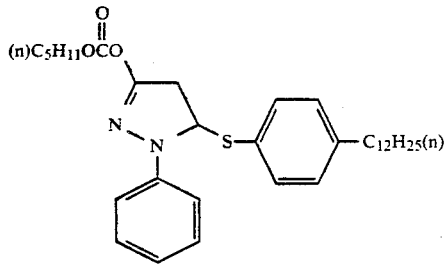
(I-81)
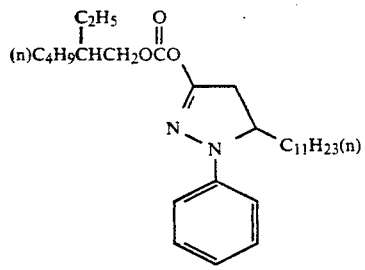
(I-82)
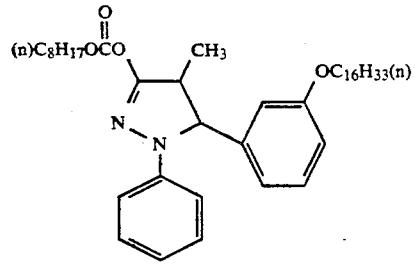
(I-83)
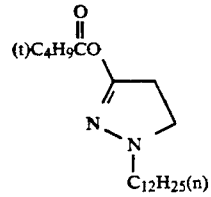

-continued
(I-84)
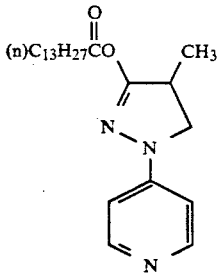
(I-85)
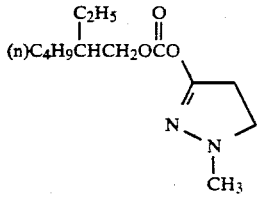
(I-86)
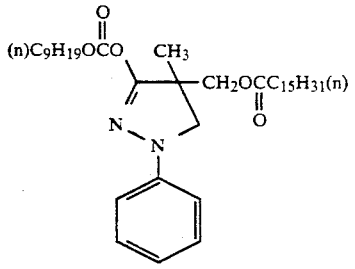
(I-87)
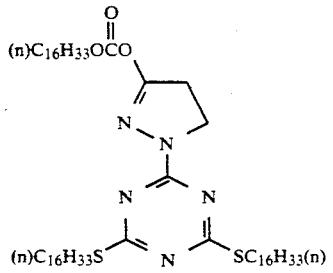
(I-88)
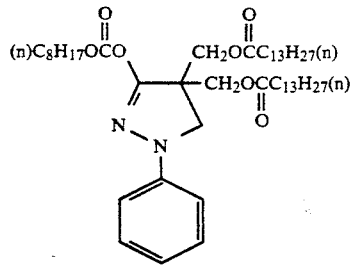
(I-89)
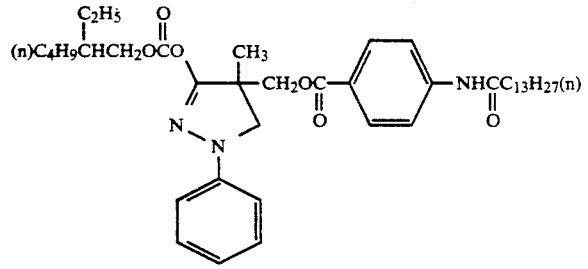

-continued
(I-90)
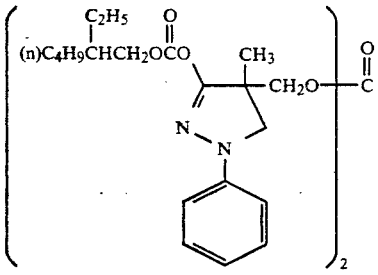
(II-1)
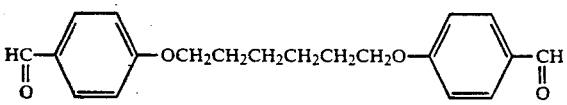
(II-2)
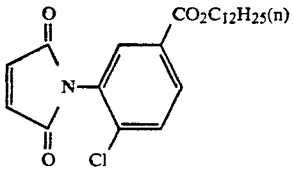
(II-3)
$CH_2{=}CH{-}SO_2{-}C_{18}H_{37}(n)$
(II-4)
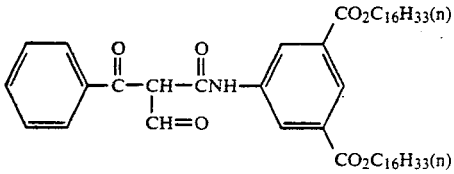
(II-5)
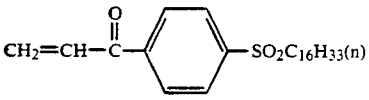
(III-1)
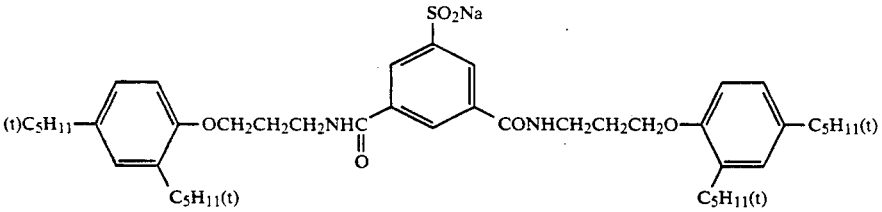
(III-2)
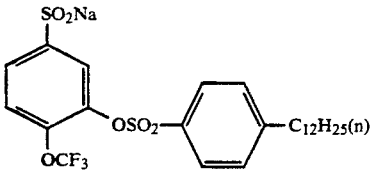
(III-3)
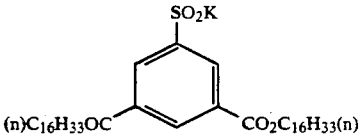
(III-4)
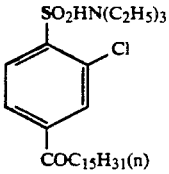

-continued
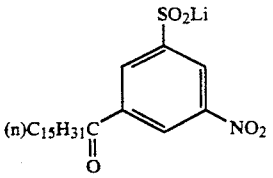
(III-5)
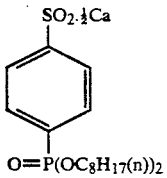
(III-6)
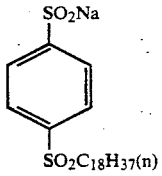
(III-7)
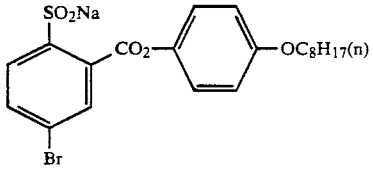
(III-12)
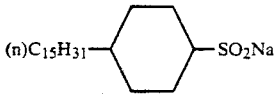
(III-13)
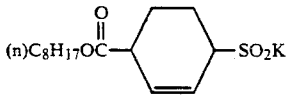
(III-14)
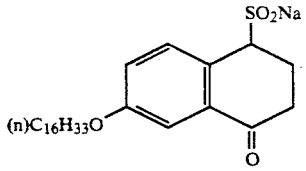
(III-15)
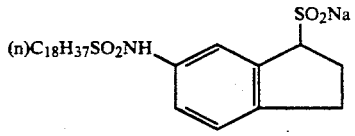
(III-16)
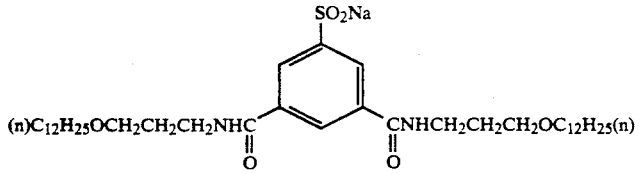
(III-17)
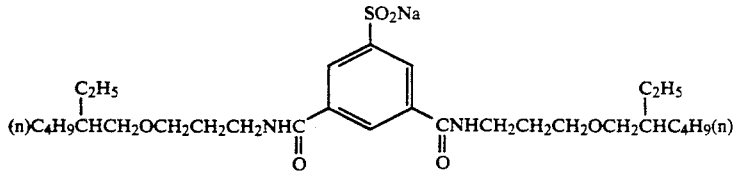
(III-18)

-continued
(III-19)
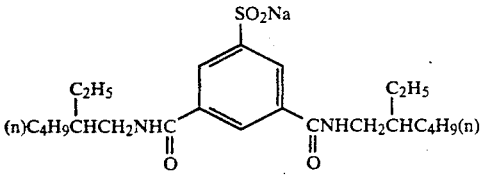
(III-20)
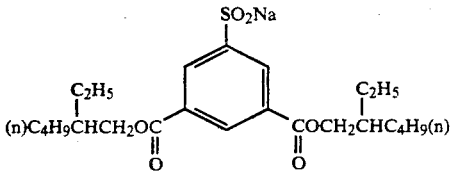
(III-22)
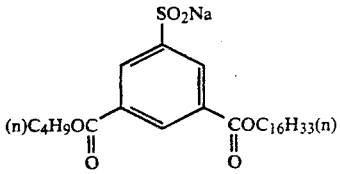
(III-23)
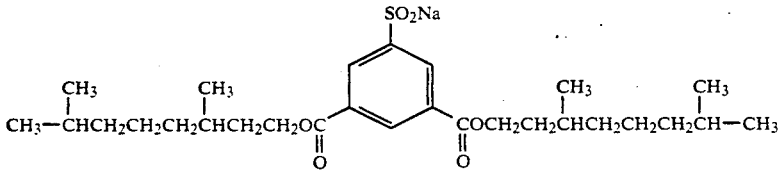
(III-24)
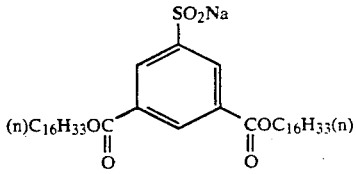
(III-25)
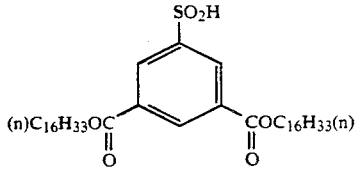
(III-26)
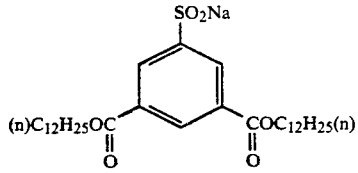
(III-27)
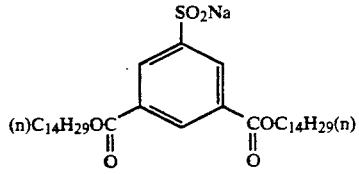
(III-28)
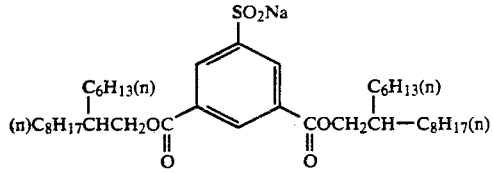

-continued
(III-29)
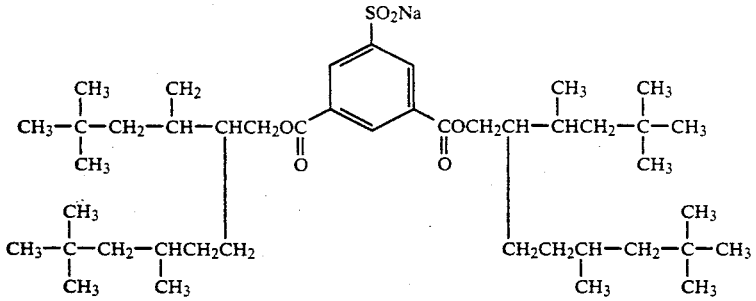
(III-30)
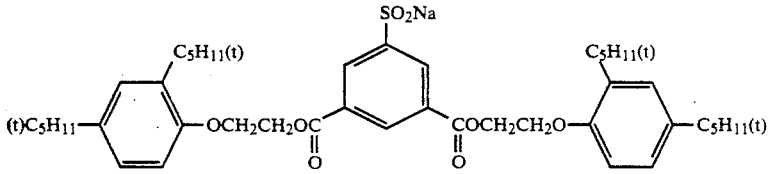
(III-31)
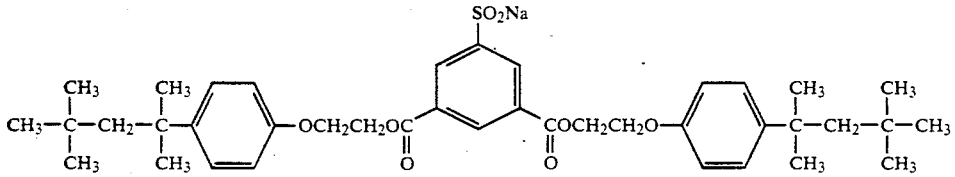
(III-32)
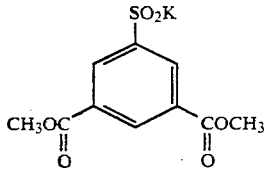
(III-33)
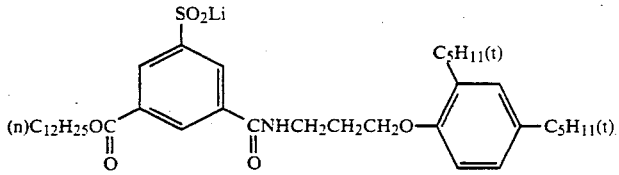
(III-34)
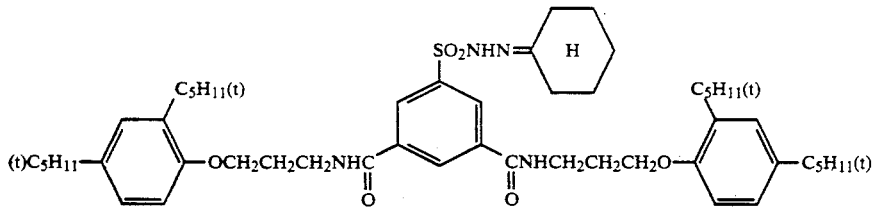
(III-35)
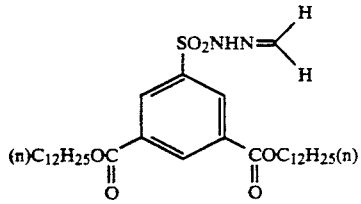
(III-36)
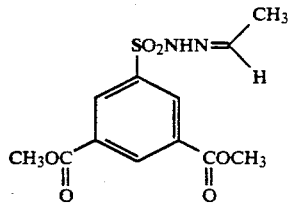

-continued
(III-37)
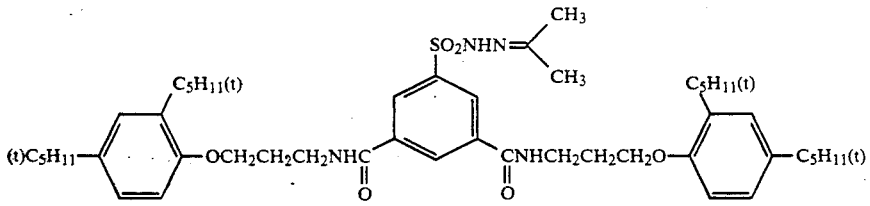
(III-38)
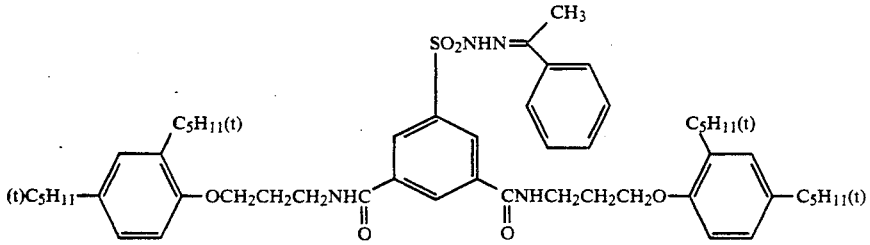
(III-39)
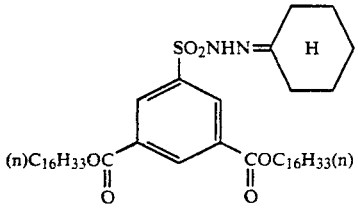
(III-40)
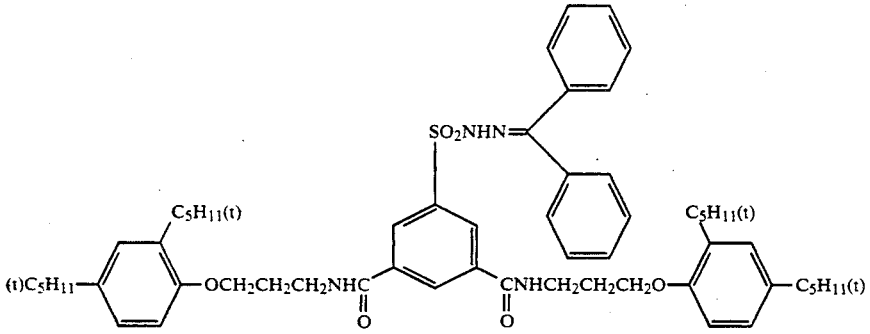
(III-41)
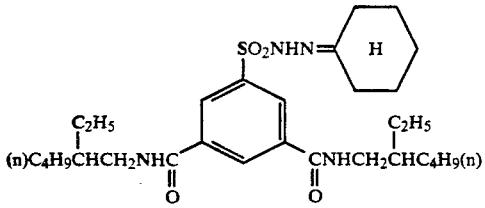
(III-42)
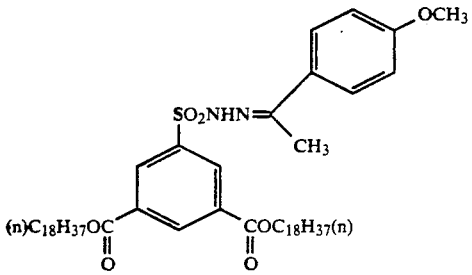

-continued
(III-43)
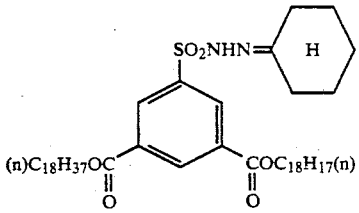
(III-44)
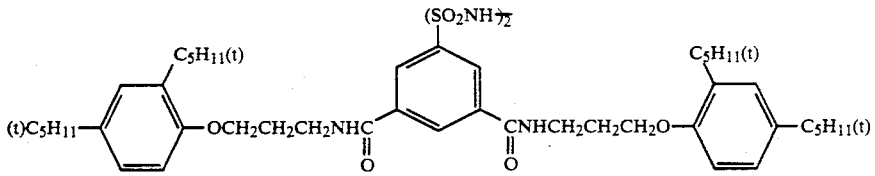
(III-45)
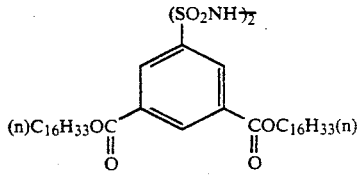
(III-46)
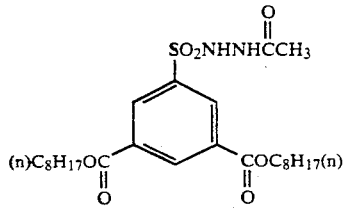
(III-47)
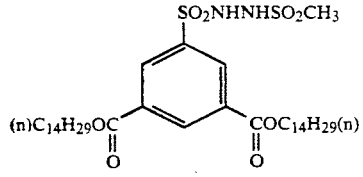
(III-48)
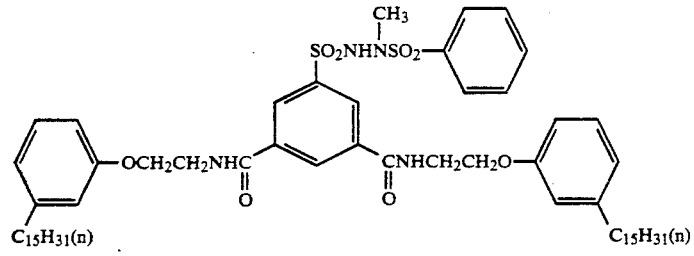
(III-49)
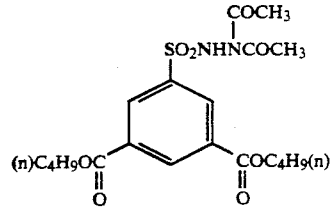

-continued
(III-50)
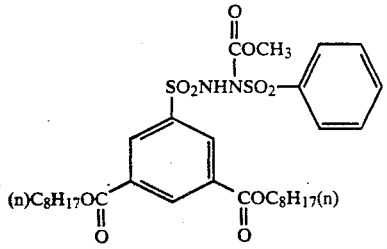
(III-51)
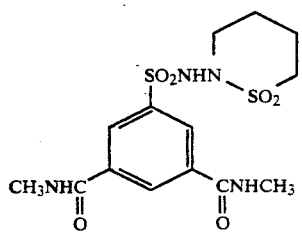
(III-52)
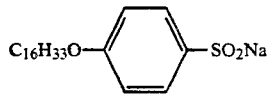
(III-53)
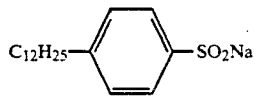
(III-54)
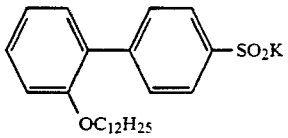
(III-55)
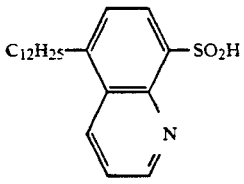
(III-56)
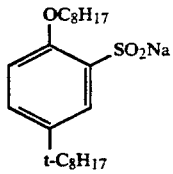
(III-57)
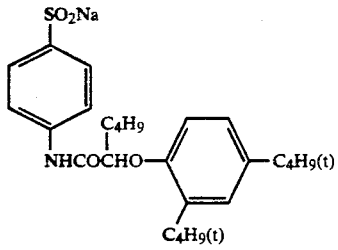

-continued
(III-58)
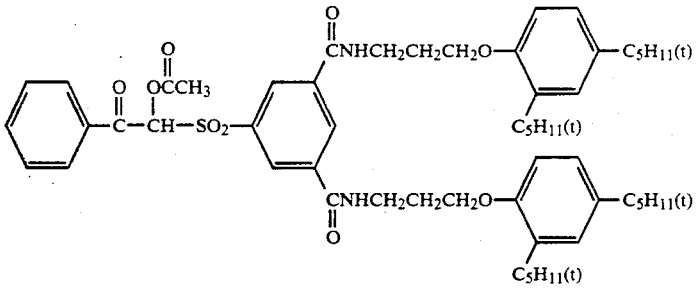
(III-59)
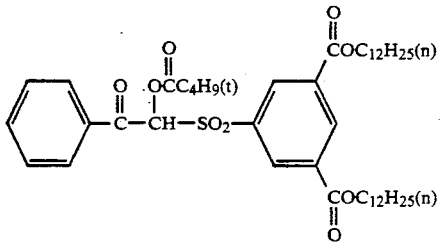
(III-60)
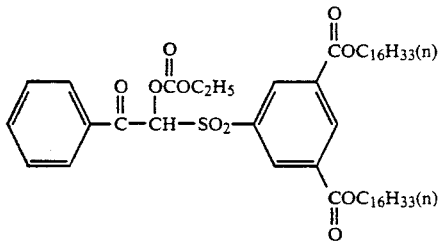
(III-61)
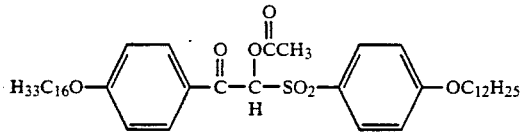
(III-62)
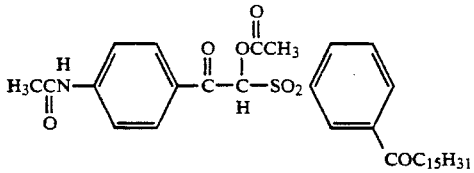
(III-63)
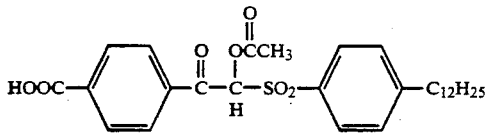
(III-64)
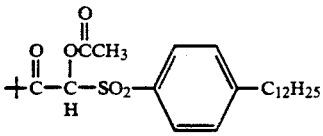
(III-65)
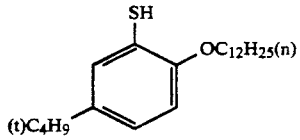

-continued

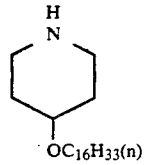

(III-66)

These compounds can be synthesized according to the methods described in JP-A-63-158545, JP-A-62-283338, European Patent Laid-Open Nos. 298321, 277589 and 255722, JP-A-62-143048, 62-229145, Japanese Patent Application Nos. 63-136724 and 62-215681.

The magenta couplers having an elimination group represented by the formula (I) are used in an amount of $2\times10^{-3}$ to $5\times10^{-1}$ mol, preferably $1\times10^{-2}$ to $5\times10^{-1}$ mol per mol of silver in the emulsion.

The compounds having the formulas (AI), (AII) and (AIII) are used in an amount of $1\times10^{-2}$ to 10 mol, preferably $3\times10^{-2}$ to 5 mol per mol of said magenta coupler. The compounds having the formulas (AI), (AII) and (AIII) may be incorporated in the photographic material at an any stage during the preparation of the photographic material, during development processings or after development processing (so that the compounds are incorporated into a color photograph). It is preferred that when the compounds have a low molecular weight or are easily soluble in water, they are added to a processing solution or water and incorporated in the photographic material during the development processings or after the processings. The compounds may be incorporated into any hydrophilic colloid layer in the photographic material or the color photograph.

The compounds having the formulas (AI), (AII) and (AIII) may be used in substitution for high-boiling solvents for the dispersion of couplers.

It is preferred that the color photographic material of the present invention comprises a blue-sensitive silver halide emulsion layer, a green-sensitive silver halide emulsion layer and a red-sensitive silver halide emulsion layer in this order or in an arbitrary order provided on a support.

Any of silver chloride, silver bromide, silver chlorobromide, silver chloroiodobromide and silver iodobromide can be used as the silver halide of the present invention. Among them, silver chloride, silver chlorobromide and silver chloroiodobromide are preferred. Preferably, the silver halide grains in the emulsion layer have such a halogen composition that at least 90 mol % of the entire silver halide constituting the silver halide grains is composed of silver chloride, and the silver halide is composed of silver chlorobromide containing substantially no silver iodide. The term "containing substantially no silver iodide" as used herein means that the content of the silver iodide is not higher than 1.0 mol %. It is particularly preferred that the silver halide grains have such a halogen composition that at least 95 mol % of the entire silver halide constituting the silver halide grains is composed of silver chloride, and the silver halide is composed of silver chlorobromide containing substantially no silver iodide.

Further, it is preferred that the silver halide grains of the present invention have a silver bromide-localized phase having a silver bromide content of from more than 10% to less than 70 mol %. The silver bromide-localized phase may be arbitrarily arranged according to the intended purpose. The phase may exist in the interior of the silver halide grains, on the surfaces thereof, or on the sub-surfaces thereof, or may exist partly in the interior thereof and partly on the surfaces or sub-surfaces thereof. The localized phase may have a layer, structure surrounding the silver halide grain in the interior thereof or on the surface thereof. Alternatively, the localized phase may have a discontinuously isolated structure. In a preferred embodiment of the arrangement of the localized phase, more than at least 10 mol %, preferably at least 20 mol % (in terms of silver bromide content) of the localized phase is formed by locally epitaxial growth on the surfaces of the silver halide grains (particularly, on the corners of the grains).

It is preferred that the silver bromide content of the localized phase exceeds 20 mol %. However, when the silver bromide content is too high, there is a possibility that when pressure is applied to the photographic material, desensitization is caused and the sensitivity and the gradation are greatly varied by a change in the composition of the processing solution. As a result, the photographic material is deteriorated. When this is taken into consideration, the silver bromide content is in the range of preferably 20 to 60 mol %, most preferably 30 to 50 mol %. Silver chloride is preferred as the other silver halide which constitutes the localized phase. The silver bromide content of the localized phase can be analyzed by X-ray diffractometry (e.g., described in New Experimental chemical Lecture 6, structure Analysis, edited by Japanese Chemical Society, published by Maruzen) or the XPS method (e.g., *Surface Analysis, "IMA, Application of O. J. electron, photoelectron spectroscopy"* published by Kodansha). The localized phase comprises preferably 0.1 to 20%, more preferably 0.5 to 7% of the total amount of silver of the silver halide grains.

The interface between the silver bromide localized phase and the other phase may be a clear phase boundry or may have a short transfer zone where the halogen composition is gradually changed. The position of the silver bromide localized phase can be confirmed by electron microscope or by the method described in European Patent Laid-Open No. 273,430A2.

The silver bromide localized phase can be formed by various methods. For example, the localized phase can be formed by reacting a soluble silver salt with a soluble halide salt according to a single jet process or a double jet process, or by a conversion method including a stage where an already formed silver halide is converted to silver halide having a smaller solubility product. Alternatively, the localized phase can be formed by adding fine silver bromide grains to silver chloride grains to recrystallize fine silver bromide grains on the surfaces of the silver chloride grains.

These methods are described in said European Patent Laid-Open No. 273,430A2.

It is preferred from the viewpoint of further enhancing the effect of the present invention that a metal ion (e.g., Group VIII (in the Periodic Table) metal ion, Group II (in the Periodic Table) transition metal ion, lead ion, thallium ion) or its complex ion other than a silver ion is incorporated in the localized phase of the silver halide grain or in the substrate thereof.

Iridium ion, rhodium ion, iron ion, etc. or complex ions thereof can be used mainly for the localized phase. Metal ions selected from osmium, iridium, rhodium, platinum, ruthenium, palladium, cobalt, nickel, iron, etc. or complex ions thereof can be used mainly for the substrate. The types and concentrations of the metal ions in the localized phase may be different from those in the substrate.

The metal ions can be incorporated in the localized phase and/or other grain part (substrate) by adding the metal ion before or during the formation of the grains or during physical ripening. For example, the metal ions are added to an aqueous gelatin solution, an aqueous halide solution, an aqueous silver salt solution or other aqueous solutions to form silver halide grains.

Alternatively, the metal ions can be introduced by previously incorporating the metal ions in fine grains of silver halide, adding them to a host silver halide emulsion and dissolving the fine grains of silver halide thereby to incorporate the metals to silver halide grains in the host emulsion. This method is suitable for use in introducing the metal ions into the silver bromide localized phase present on the surfaces the of silver halide grains. Methods for adding the metal ions can be changed by the position where the ions are allowed to exist.

It is particularly preferred that the localized phase is deposited together with at least 50% of the total amount of iridium to be added during the preparation of the silver halide grains.

The description "the localized phase is deposited together with iridium ion" as used herein means that an iridium compound is fed simultaneously with the supply of silver and/or halogen for the formation of the localized phase or immediately before or immediately after the supply of silver and/or halogen.

Any of the silver halide grains having the {100} plane on the outer surfaces thereof, grains having the {111} plane and grains having both the {100} and the {111} planes can be used in the present invention. Further, grains having planes of higher order can be used.

The silver halide grains of the present invention may have a regular crystalline form such as a cube, a tetradecahedron or an octahedron, an irregular crystalline form such as a sphere or a tabular or a composite form of these crystalline forms. A mixture of grains having various crystalline forms can be used, but it is preferred that grains have such a crystal form distribution that at least 50%, preferably 70%, more preferably 90% thereof is composed of grains having said regular crystalline forms.

The silver halide emulsion of the present invention may be an emulsion wherein tabular grains having an aspect ratio (a ratio of length to thickness) of not lower than 5, preferably not lower than 8 account for at least 50% of the entire projected area of grains.

The size of the silver halide grains of the present invention may be in a range conventionally used. Preferably, the grains have a mean grain size of 0.1 to 1.5 μm. The grain size distribution thereof may be any of a polydisperse system and a monodisperse system, but monodisperse system is preferable. The grain size distribution representing the degree of monodispersity is preferably not more than 20%, more preferably not statiscal value S/d obtained by dividing standard deviation S by diameter d when a projected area approaches a circle).

Two or more of the tabular grain emulsions and the monodisperse emulsions may be mixed. It is preferred that at least one of the emulsions has a coefficient of variation in the range defined above when the emulsions are mixed. It is particularly preferred that the mixed emulsion has a coefficient of variation in the range defined above.

The substrate of the silver halide grains excluding the localized phase may be composed of a uniform phase or different phases comprising an interior phase and a surface layer.

The silver halide emulsions of the present invention are usually subjected to physical ripening, chemical ripening and spectral sensitization. Preferred chemical sensitizing agents for use in chemical ripening are described in JP-A-62-215272, pages 18, the fourth column to page 22, the second column and preferred spectral sensitizing agents are described in said JP-A-62-215272, pages 22, the second column to page 38.

Preferred antifogging agents or stabilizers which are used during the preparation of the silver halide emulsions or during the storage thereof are also described in said patent publication (see page 39 to page 72, the second column).

The color photographic materials generally contain yellow couplers forming a yellow color, magenta couplers forming a magenta color and a cyan couplers forming cyan color, each of them forming a color by coupling with the oxidized product of the aromatic amine developing agents.

As yellow couplers for use in the present invention, acylacetamide derivatives such as benzoylacetanilides or pivaloylacetanilides are preferred.

Above all, yellow couplers represented by the following formula (Y-1) or (Y-2) are particularly preferred for use in the present invention.

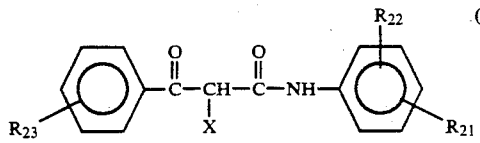

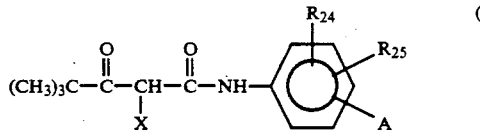

In the formulae, X represents a hydrogen atom or a coupling-releasing group. $R_{21}$ represents a non-diffusing group having a total of from 8 to 32 carbon atoms, and $R_{22}$ represents hydrogen or one or more (preferably from 1 to 4) halogen atoms, lower alkyl groups preferably having from 1 to 4 carbon atoms, lower alkoxy groups preferably having from 1 to 4 carbon atoms and/or non-diffusing groups having a total of from 8 to carbon atoms. $R_{23}$ represents hydrogen or a substituent. When the formula has two or more $R_{23}$ groups, the $R_{23}$ groups may be same or different. $R_{24}$ represents a halogen atom, an alkoxy group, a trifluoromethyl group, or an aryl group. $R_{25}$ represents a hydrogen atom, a halogen atom or an alkoxy group. A represents —NH-$COR_{26}$, —$NHSO_2R_{26}$, —$SO_2NHR_{26}$, —$COOR_{26}$, $$-SO_2N(R_{27})-R_{26},$$

wherein $R_{26}$ and
$R_{27}$ each represents an alkyl group, an aryl group or an acyl group.

Pivaloylacetanilide yellow couplers for use in the present invention are described in U.S. Pat. No. 4,622,287, from column 3, line 15 to column 8, line 39, and in U.S. Pat. No. 4,623,616, from column 14, line 50 to column 19, line 41.

Benzoylacetanilide yellow couplers for use in the present invention are described in U.S. Pat. Nos. 3,408,194, 3,933,501, 4,046,575, 4,133,958 and 4,401,752.

Preferred examples of pivaloylacetanilide yellow couplers for use in the present invention include the compounds (Y-1) to (Y-39) described in the aforesaid U.S. Pat. No. 4,622,287, columns 37 to 54. Above all, compounds (Y-1), (Y-4), (Y-6), (Y-7), (Y-15, (Y-21), (Y-22), (Y-23), (Y-26), (Y 35), (Y-36), (Y-37), (Y-38) and (Y-39) are particularly preferred.

In addition, the compounds (Y-1) to (Y-33) described in the aforesaid U.S Pat. No. 4,623,616, columns 19 to 24 are also preferred, and compounds (Y-2), (Y-7), (Y-8), (Y-12), (Y-20), (Y-21), (Y-23) and (Y-29) are particularly preferred.

Other preferred compounds include compound (34) described in U.S. Pat. No. 3,408,194, column 6; compounds (16) and (19) described in U.S. Pat. No. 3,933,501; compound (9) described in U.S. Pat. No. 4,046,575, columns 7 and 8; compound (1) described in U.S. Pat. No. 4,133,958, columns 5 and 6; compound (1) described in U.S. Pat. No. 4,401,752, column 5; and the following compounds (a) to (h):

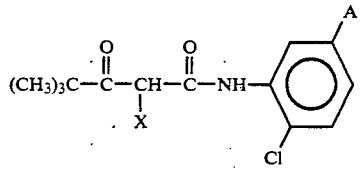

| Compound | A | X |
|---|---|---|
| a | $-COOCH(CH_3)COOC_{12}H_{25}$ | 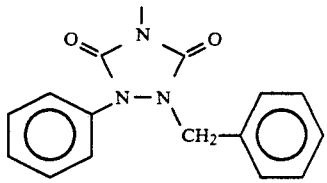 |
| b | $-COOCH(C_4H_9)COOC_{12}H_{25}$ | " |
| c | 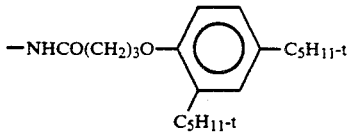 | 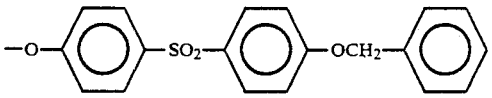 |
| d | 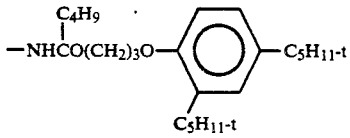 | 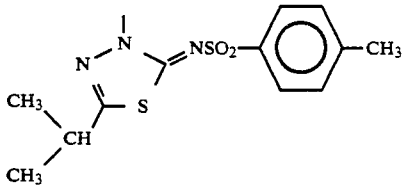 |
| e | " | 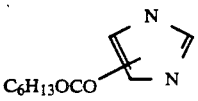 |
| f | $-NHSO_2C_{12}H_{25}$ | 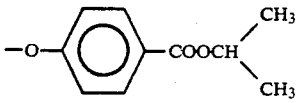 |

-continued

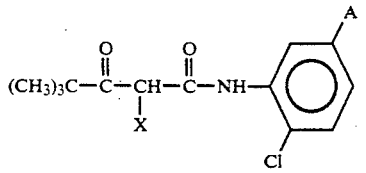

| Compound | A | X |
|---|---|---|
| g | $-NHSO_2C_{16}H_{33}$ <br> $CH_3$ | 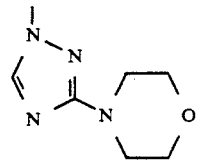 |
| h | $-NHC(=O)CH(CH_3)CH_2SO_2C_{12}H_{25}$ | 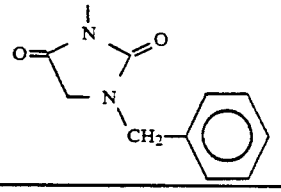 |

Among the above-mentioned couplers, those having a nitrogen atom as a releasing atom are particularly preferred.

Magenta couplers for use in the present invention include oil-protected indazoline or cyanoacetyl compounds, preferably 5-pyroazolone, or pyrazoloazole couplers such as pyrazolotriazoles. As 5-pyrazolone couplers, those having an arylamino or acylamino group in the 3-position are preferred from the viewpoint of the hue and density of the colors formed therefrom. Specific examples of such couplers are described in U.S. Pat. Nos. 2,311,082, 2,343,703, 2,600,788, 2,908,573, 3,062,653, 3,152,896 and 3,936,015.

As the releasing group in 2-equivalent pyrazolone couplers, the nitrogen atom-releasing groups described in U.S. Pat. No. 4,310,619 as well as the arylthio groups described in U.S. Pat. No. 4,351,897 are preferred. Ballast group-containing 5-pyrazolone couplers as described in European Patent 73,636 are preferred as providing colors having a high density.

Pyrazoloazole couplers for use in the present invention include pyrazolobenzimidazoles as described in U.S. Pat. No. 3,369,879, and preferably pyrazolo[5,1-c]-[1,2,4]triazoles as described in U.S. Pat. No. 3,725,067, pyrazolotetrazoles as described in *Research Disclosure* (Item 24220, June, 1984) and pyrazolopyrazoles as described in *Research Disclosure* (Item 24230, June, 1984). The above-mentioned couplers may be in the form of a polymer coupler.

The above-noted couplers can be represented by the following general formula (M 1), (M-2) or (M-3):

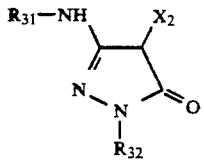

(M-1)

continued

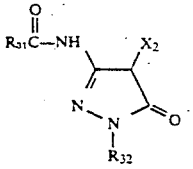

(M-2)

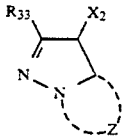

(M-3)

In these formulas, $R_{31}$ represents a non-diffusing group having a total of from 8 to 32 carbon atoms, and $R_{32}$ represents a phenyl group or a substituted phenyl group. $R_{33}$ represents a hydrogen atom or a substituent. Z represents a non-metallic atomic group necessary for forming a 5-membered azole ring containing from 2 to 4 nitrogen atoms, and the azole ring may be substituted or condensed with other rings.

$X_2$ represents a hydrogen atom or a releasing group. Substituents for $R_{33}$ or the substituents for the azole ring are described, for example, in U.S. Pat. No. 4,540,654, from column 2, line 41 to column 8, line 27.

Among the pyrazoloazole couplers, imidazo[1,2-b]pyrazoles as described in U.S. Pat. No. 4,500,630 are preferred as providing dyes having a small yellow side absorption and high light-fastness, and the pyrazolo-[1,5-b][1,2,4]triazoles as described in U.S. Pat. No. 4,540,654 are particularly preferred.

In addition, pyrazolotriazole couplers having a branched alkyl group directly bonded to the 2-, 3- or 6-position of the pyrazolotriazole ring, as described in JP-A-61-65245; pyrazoloazole couplers having a sulfonamido group, as described in JP-A-61-65246; pyrazoloazole couplers having an alkoxyphenylsulfonamido ballast group as described in JP-A-61-147254; as well as pyrazolotriazole couplers having an alkoxy or aryloxy group at the 6-position, as described in European Patent Laid-Open No. 226,849 are preferably used in the present invention.

Specific, non-limiting examples of these couplers are given below.

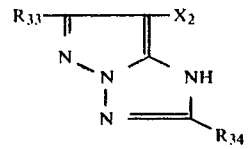
| Compound | $R_{33}$ | $R_{34}$ | $X_2$ |
|---|---|---|---|
| $M_1$-1 | $CH_3$— | 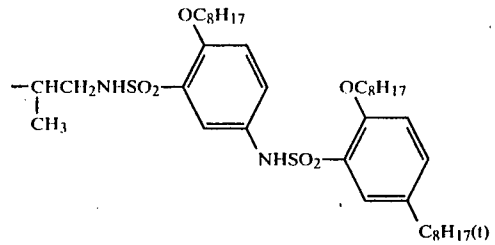 | Cl |
| $M_1$-2 | " | 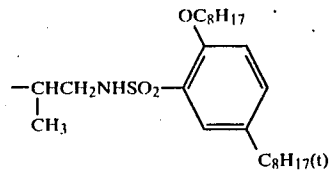 | " |
| $M_1$-3 | " | 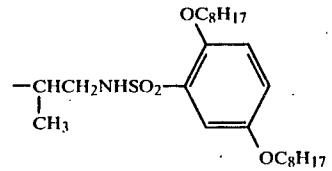 | 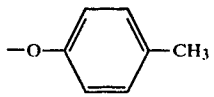 |
| $M_1$-4 | 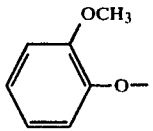 | 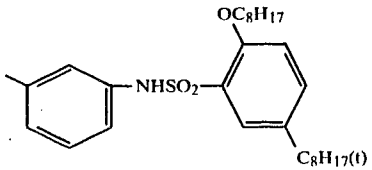 | 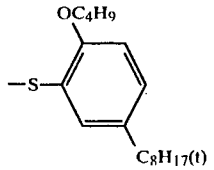 |

-continued
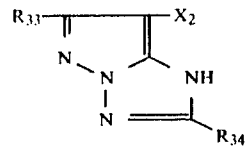
| Compound | $R_{33}$ | $R_{34}$ | $X_2$ |
|---|---|---|---|
| $M_1$-5 | $CH_3$— | 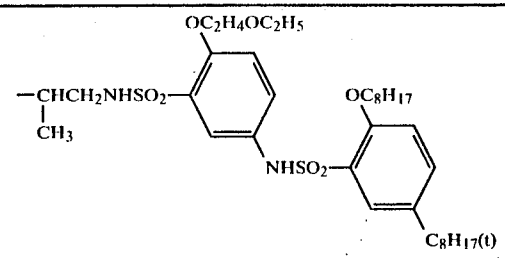 | Cl |
| $M_1$-6 | $CH_3$— | 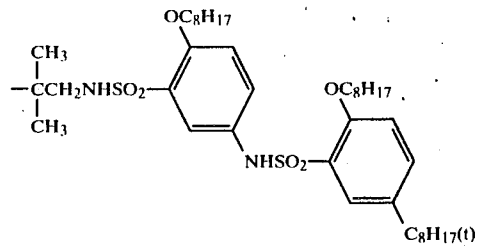 | Cl |
| $M_1$-7 | 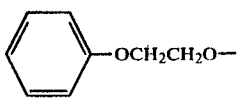 | 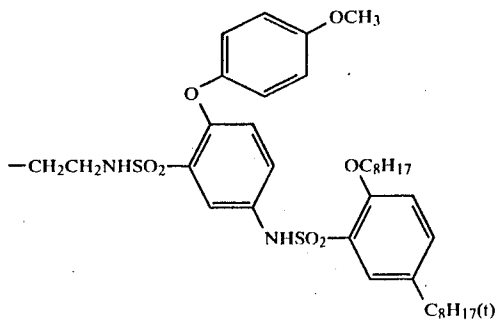 | 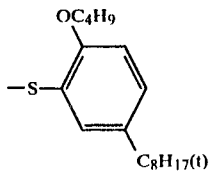 |
| $M_1$-8 | $CH_3CH_2O$— | " | " |

-continued
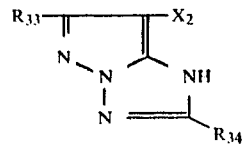
| Compound | $R_{33}$ | $R_{34}$ | $X_2$ |
|---|---|---|---|
| $M_1$-9 | 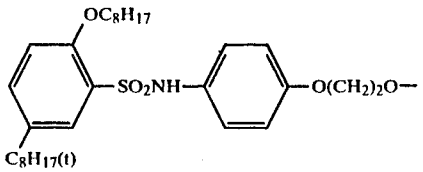 | 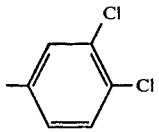 | 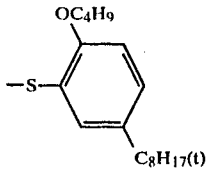 |
| $M_1$-10 | 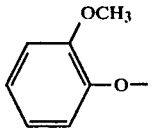 | 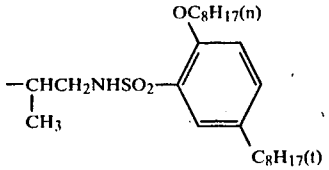 | Cl |
| $M_1$-11 | $CH_3$— | 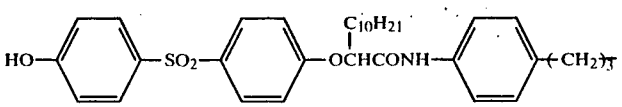 | Cl |
| $M_1$-12 | " | 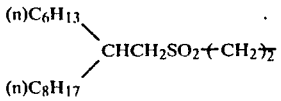 | " |
| $M_1$-13 | 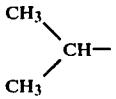 | 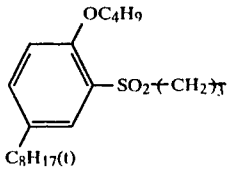 | " |

-continued
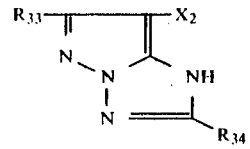
| Compound | $R_{33}$ | $R_{34}$ | $X_2$ |
|---|---|---|---|
| $M_1$-14 | $\leftarrow CH(COOCH_2CH_2OCH_3)-CH_2\rightarrow_{50}\leftarrow CH_2-C(CH_3)(CONH-)\rightarrow_{50}$ (the proportion of monomers is shown by weight ratio) | $CH_3-CH(CH_2NHSO_2CH_3)-$ | " |
| $M_1$-15 | 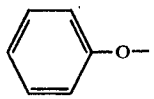 | 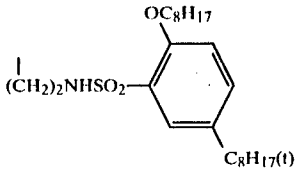 | Cl |
| $M_1$-16 | 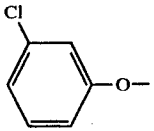 | 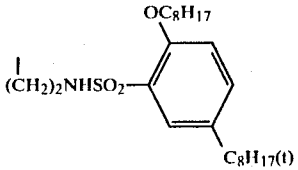 | 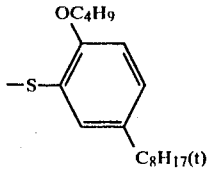 |

Cyan couplers for use in the present invention include phenol cyan couplers and naphthol cyan couplers.

Phenol cyan couplers for use in the present invention include those having an acylamino group at the 2-position and an alkyl group at the 5-position of the phenol nucleus (including polymer couplers), as described, for example, in U.S. Pat. Nos. 2,369,929, 4,518,687, 4,511,647 and 3,772,002. Examples of such compounds include the coupler of Example 2 in Canadian Patent 625,822, the compound (1) described in U.S. Pat. No. 3,772,002, the compounds (I-4) and (I-5) described in U.S. Pat. No. 4,564,590, the compounds (1), 2), (3) and (24) described in JP-A-61-39045 and the compound (C-2) described in JP-A-62-70846.

Phenol cyan couplers for use in the present invention further include the 2,5-diacylaminophenol couplers described in U.S. Pat. Nos. 2,772,162, 2,895,826, 4,334,011 and 4,500,653 and JP-A-59 164555. Specific examples of such compounds include the compound (V) described in U.S. Pat. No. 2,895,826, the compound (17) described in U.S. Pat. No. 4,557,999, the compounds (2) and (12) described in U.S. Pat. No. 4,565,777, the compound (4) described in U.S. Pat. No. 4,124,396 and the compound (I-19) described in U.S. Pat. No. 4,613,564.

Phenol cyan couplers for use in the present invention further include the nitrogen-containing heterocyclic ring-condensed phenol couplers described in U.S. Pat. Nos. 4,327,173, 4,564,586 and 4,430,423, JP-A-61-390441 and JP-A-62-257158. Specific examples of such couplers include the couplers (1) and (3) described in U.S. Pat. No. 4,327,173, the compounds (3) and (16) described in U.S. Pat. No. 4,564,586, the compounds (1) and (3) described in U.S. Pat. No. 4,430,423 and the following compounds:

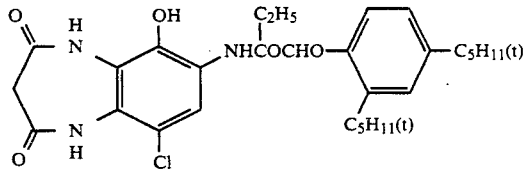

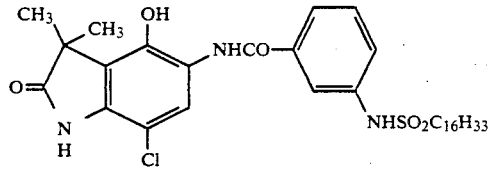

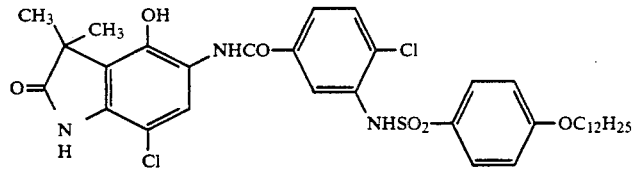

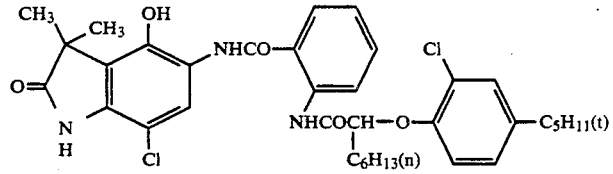

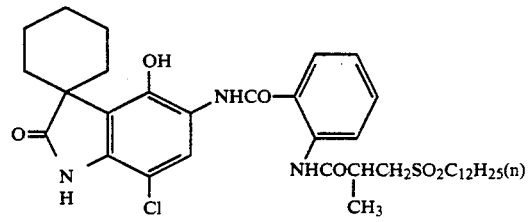

-continued
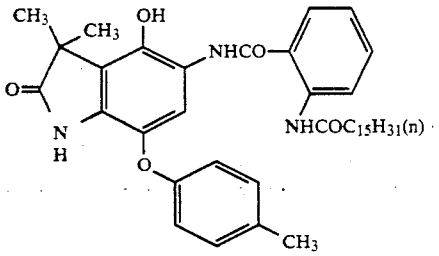
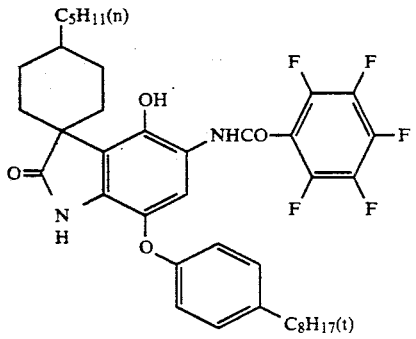
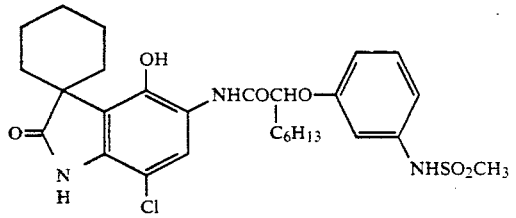
In addition to the above couplers, the following diphenylmiidazole cyan couplers described in European Patent Laid-Open No. 0,249,453A2 can be used:
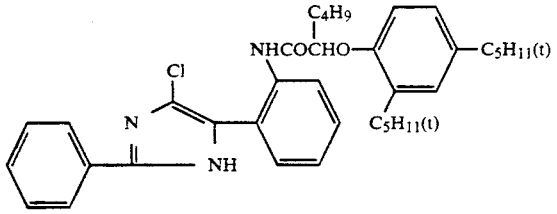
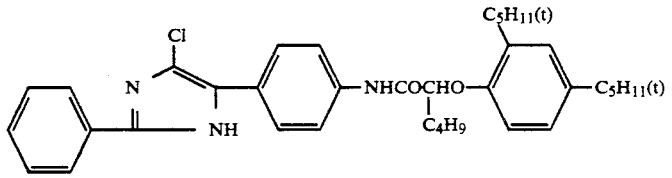
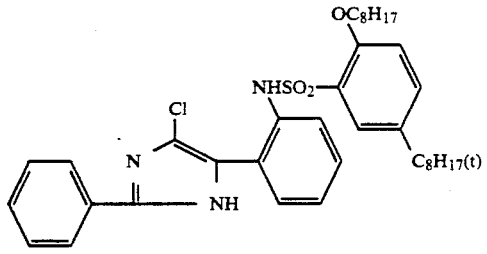

-continued

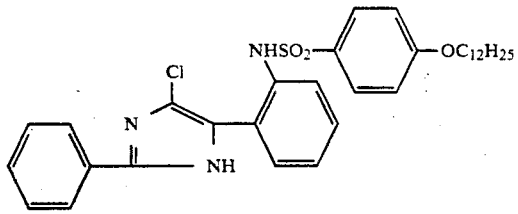

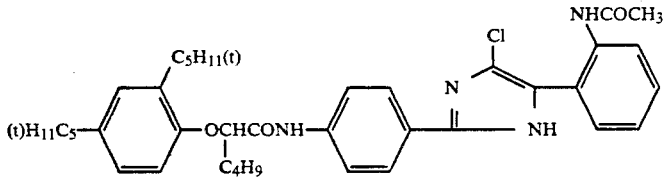

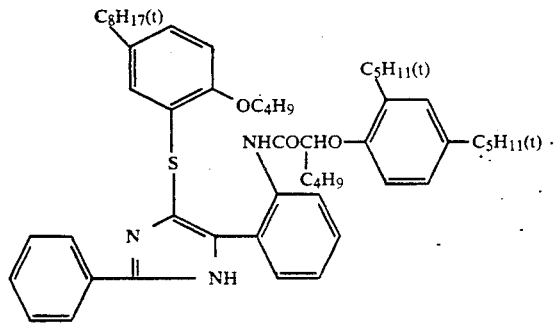

Other examples of the phenol cyan couplers include ureido couplers described in U.S. Pat. Nos. 4,333,999, 4,451,559, 4,444,872, 4,427,767 and 4,579,813 and European Patent 067,689B1. Typical examples thereof include coupler (7) described in U.S. Pat. No. 4,333,999, coupler (1) described in U.S. Pat. No. 4,451,559, coupler (14) described in U.S. Pat. No. 4,444,872, coupler (3) described in U.S. Pat. No. 4,427,767, couplers (6) and (24) described in U.S. Pat. No. 4,609,619, couplers (1)

and (11) described in U.S. Pat. No. 4,579,813, couplers (45) and (50) described in European Patent 067,689B1 and coupler (3) described in JP-A-61-42658.

Examples of the naphthol cyan couplers include compounds having an N-alkyl-N arylcarbamoyl group at the 2-position of naphthol nucleus (e.g., described in U.S. Pat. No. 2,313,586), compounds having an alkylcarbamoyl group at the 2-position (e.g., described in U.S. Pat. Nos. 2,474,293 and 4,282,312), compounds having an arylcarbamoyl group at the 2-position [e.g., described in JP-B-50-14523 (the term "JP-B" as used herein means an "examined Japanese patent publication")], compounds having a carbonamido group or a sulfonamido group at the 5-position (e.g., described in JP-A-60-237448, JP-A-61-145557, JP-A-61-153640), compounds having an aryloxy elimination group (e.g., described in U.S. Pat. No. 3,476,563) compounds having a substituted alkoxy elimination group (e.g., described in U.S. Pat. No. 4,296,199) and compounds having a glycolic acid elimination group (e.g., JP-B-60-39217).

These couplers can be allowed to coexist with at least one high-boiling organic solvent and the couplers can be dispersed and incorporated in emulsion layers. Preferably, high-boiling organic solvents represented by the following formulas (A) to (E) are used:

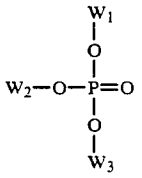

(A)

$W_1-COO-W_2$ (B)

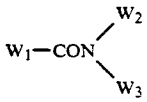

(C)

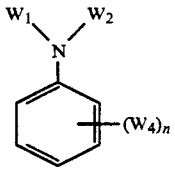

(D)

$W_1-O-W_2$ (E)

In the above formulas, $W_1$, $W_2$ and $W_3$ are each a substituted or an unsubstituted alkyl, cycloalkyl, alkenyl, aryl or heterocyclic group; $W_4$ is $W_1$, $OW_1$ or $SW_1$; and n is an integer of from 1 to 5. When n is 2 or greater, $W_4$ may be the same or different groups. In the formula (E), $W_1$ and $W_2$ may be combined together to form a condensed ring.

The couplers are impregnated with a loadable latex polymer (e.g., described in U.S. Pat. No. 4,203,716) in the presence or absence of the high-boiling organic solvent, or dissolved in a water-insoluble, but organic solvent-soluble polymer and can be emulsified in an aqueous solution of hydrophilic colloid. Preferably, homopolymers or copolymers described in WO 88/00723 (pages 12 to 30) are used. Particularly, acrylamide polymers are preferred from the viewpoint of dye image stability.

The photographic material of the present invention can contain hydroquinone derivatives, aminophenol derivatives, amines, gallic acid derivatives, catechol derivatives, ascorbic acid derivatives, colorless couplers and sulfonamidophenol derivatives, as color-fogging inhibitors or as color mixing preventing agents.

The photographic material of the present invention can contain various anti-fading agents. Specific examples of useful organic anti-fading agents for a cyan, magenta and/or yellow image include hindered phenols such as hydroquinones, 6-hydroxychromans, 5-hydroxycoumarans, spirochromans, p-alkoxyphenols and bisphenols; gallic acid derivatives, methylenedioxybenzenes, aminophenols and hindered amines; as well as ether or ester derivatives formed by silylating or alkylating the phenolic hydroxyl group of the compounds. In addition, metal complexes such as (bis-salicylaldoximato)nickel ccmplexes and (bis-N,N-dialkyldithiocarbamato)nickel complexes can also be used as anti-fading agents.

Specific examples of organic anti-fading agents are described in the following patent publications.

Specifically, hydroquinones are described in U.S. Pat. Nos. 2,360,290, 2,418,613, 2,700,453, 2,701,197, 2,728,659, 2,732,300, 2,735,765, 3,982,944, 4,430,425, British Patent 1,363,921, U.S. Pat. Nos. 2,710,801 and 2,816,028; 6-hydroxychromans, 5-hydroxycoumarans and spirochromanes are described in U.S. Pat. Nos. 3,432,300, 3,573,050, 3,574,627, 3,698,909, 3,764,337 and JP-A-52-152225; spiroindanes are described in U.S. Pat. No. 4,360,589; p-alkoxyphenols are described in U.S. Pat. Nos. 2,735,765, British Patent 2,066,975, JP-A-59-10539 and JP-B 57-19764; hindered phenols are in U.S. Pat. No. 3,700,455, JP-A-52-72225, U.S. Pat. No. 4,228,235 and JP-B-52-6623; gallic acid derivatives, methylenedioxybenzenes and aminophenols are described in U.S. Pat. Nos. 3,457,079, 4,332,886 and JP-B-56-21144; hindered amines are described in U.S. Pat. Nos. 3,336,135, 4,268,593, British Patent 1,326,889, 1,354,313, 1,410,846, JP-B-51-1420, JP-A-58-114036, JP-A-59-53846 and JP-A-59-78344; phenolic hydroxyl-ester or ether derivatives are described in U.S. Pat. Nos. 4,155,765, 4,174,220, 4,254,216, 4,264,720, JP-A-54-145530, JP-A-55-6321, JP-A-58-105147, JP-A-59-10539, JP-B 57 37856, U.S. Pat. No. 4,279,990 and JP-B-53-3263; and metal complexes are described in U.S. Pat. Nos. 4,050,938, 4,241,155 and British Patent 2,027,731(A). The compounds are added to the light-sensitive layer by co-emulsifying with a corresponding coupler generally in an amount of from 5 to 100% by weight of the coupler, as required to provide the anti-fading property. In order to protect cyan color images against heat, especially against light, it is effective to incorporate an ultraviolet absorbent to adjacent layers above and below the cyan coloring layer.

Among the above-noted anti-fading agents, spiroindanes and hindered amines are especially preferred.

The light-sensitive material may contain an ultraviolet absorbent in the hydrophilic colloid layer. For instance, aryl-substituted benzotriazoles (for example, those described in U.S. Pat. No. 3,533,794), 4-thiazolidone compounds (for example, those described in U.S. Pat. Nos. 3,314,794 and 3,352,681), benzophenone compounds (for example, those described in JP-A-46-2784), cinnamic acid ester compounds (for example, those described in U.S. Pat. Nos. 3,705,805 and 3,707,375), butadiene compounds (for example, those described in U.S. Pat. No. 4,045,229) and benzoxidol compounds (for absorbing couplers (for example α-naphthol cyan dye-forming couplers) as well as ultraviolet absorbing polymers may also be used. The ultraviolet absorbents may be mordanted in a particular layer.

The photographic material of the present invention can contain water-soluble dyes in the hydrophilic colloid layer as a filter dye or for the purpose of anti-irradiation or for other various purposes. Such dyes include oxonole dyes, hemioxonole dyes, styryl dyes, merocyanine dyes, cyanine dyes and azo dyes. Above all, oxonole dyes, hemioxonole dyes and merccyanine dyes are preferred.

Gelatin is advantageously used as the binder or protective colloid in the emulsion layer of the photographic material of the present invention, but any other hydrophilic colloid can also be used alone or together with gelatin.

The gelatin for use in the present invention may be either a lime-processed or an acid-processed gelatin. Methods of preparing gelatin are described, for example, in A. Vais, *The Macromolecular Chemistry of Gelatin* (published by Academic Press, 1964).

Any of transparent films such as cellulose nitrate film and polyethylene terephthalate film and reflection type support can be used as supports in the present invention. For the purpose of the present invention, the reflection type support is preferable.

The "reflective support" for use in the present invention is a support having an elevated reflectivity so as to sharpen the color image formed on the silver halide emulsion layer thereon. Such reflective supports include a support coated with a hydrophobic resin containing a dispersed light-reflecting substance such as titanium oxide, zinc oxide, calcium carbonate or calcium sulfate as well as a support containing a dispersion of such light-reflecting substance therein. Supports for use in the present invention include baryta paper, polyethylene-coated paper, polypropylene-type synthetic paper, as well as reflective layer-coated or reflecting substance-containing transparent supports of, for example, glass plate, polyethylene terephthalate, cellulose triacetate, cellulose nitrate or the like polyester film, or polyamide film, polycarbonate film, polystyrene film or vinyl chloride resin. The support is properly selected in accordance with the use and the object of the photographic material.

The light-reflecting substance is preferably a blend formed by well kneading a white pigment in the presence of a surfactant. In addition, pigment grains surface-treated with a 2- to 4-hydric alcohol are also preferred.

The possessory area ratio (%) of fine white pigment grains per a defined unit area is calculated by dividing the observed area into the adjacent 6 μm×6 μm unit areas and determining the possessory area ratio (%) ($R_i$) of the fine grains as projected in the said unit area. The variation coefficient of the possessory area ratio (%) is calculated as a ratio of $s/\overline{R}$, where s is the standard deviation of $R_i$ and $\overline{R}$ is the mean value of $R_i$. The number (n) of the objective unit area is preferably 6 or more. Accordingly, the variation coefficient $s/\overline{R}$ is calculated from the following formula:

$$\text{Variation Coefficient} = \sqrt{\frac{\sum_{i=1}^{n} (R_1 - R)^2}{n-1}} \Big/ \frac{\sum_{i=1}^{n} R_i}{n}$$

The possessory area ratio of the fine pigment grains to use in the present invention is preferably 0.15 or less, and more preferably 0.12 or less. When the ratio is 0.08 or less, the dispersion degree of the grains is considered to be substantially "uniform".

It is preferred that the color photographic materials of the present invention are subjected to color development, bleaching-fixing and rinsing treatment (or stabilizing treatment). Bleaching and fixing may be carried out with one bath or separately.

When continuous processing is conducted, a lower rate of replenishment is preferred from the viewpoint of resource saving and low-level pollution.

The replenishment rate of the color developing solution is preferably not more than 200 ml, more preferably not more than 120 ml, still more preferably not more than 100 ml per $m^2$ of the photographic material. The term "replenishment rate" as used herein means an amount of the color developing solution to be replenished, exclusive of the amounts of additives for the replenishment of amounts lost by condensation or deteriorated with time. The additives include water for the dilution of condensate, preservative which is liable to be deteriorated with time, an alkaline agent for raising pH, etc.

The color developing solutions which can be used in the present invention are preferably aqueous alkaline solutions mainly composed of aromatic primary amine color developing agents. Aminophenol compounds are useful as the color developing agents and p-phenylenediamine compounds are preferred as the color developing agents. Typical examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β -methoxyethylaniline and salts thereof such as sulfate, hydrochloride and p-toluenesulfonate.

These compounds may be used either alone or in combination of two or more.

Generally, the color developing solutions contain pH buffering agents such as alkali metal carbonates, borates and phosphates, development restrainers such as bromides, iodides, benzimidazoles, benzothiazoles and mercapto compounds and anti-fogging agents. If desired, the color developing solutions may optionally contain preservatives such as hydroxylamine, diethylhydroxylamine, hydrazine sulfites, phenyl semicarbazides, triethanolamine, catecholsulfonic acids and triethylenediamine (1,4-diazabicyclo[2,2,2]octane); organic solvents such as ethylene glycol and diethylene glycol; development accelerators such as benzyl alcohol, polyethylene glycol, quaternary ammonium salts and amines; color forming couplers, competitive couplers and fogging agents such as sodium boron hydride; auxiliary developing agents such as 1-phenyl-3-pyrazolidone; tackifiers; and chelating agents such as polyaminocarboxylic acids, polyaminophosphonic acids, alkylphosphonic acids and phosphonocarboxylic acids, for example, ethylenediaminetetraacetic acid, nitrilotriacetic acid, diethylenetriaminepentaacetic acid, cyclohexanediaminetetraacetic acid, hydroxyethylimidinoacetic acid, 1-hydroxyethylidene-1,1-diphosphonic acid, nitrilo-N,N,N-trimethylenephosphonic acid, ethylenediamine-N,N,N',N'-tetramethylenephosphonic acid and ethylenediamine-di(o-hydroxyphenylacetic acid) and salts thereof.

Generally, when reversal processing is to be conducted, black-and-white development is first carried out and color development is then carried out. Black-and-white developing solutions may contain conventional developing agents such as dihydroxybenzenes (e.g., hydroquinones), 3-pyrazolidones (e.g., 1-phenyl-3-pyrazolidone) and aminophenols (e.g., N-methyl-p-aminophenol). These developing agents may be used either alone or in combination of two or more.

The pH of the color developing solutions and the black-and-white developing solutions is generally in the range of 9 to 12. The replenishment rate of these developing solutions varies depending on the types of the color photographic materials, but is usually not more than 3 l per $m^2$ of the photographic material. The replenishment rate can be reduced to 500 ml or less when the concentration of the bromide ion in the replenisher is reduced. When the replenishment rate is to be reduced, it is desirable that the contact area of the layer to be processed with air is reduced to prevent the solution from being evaporated or oxidized by the air. The replenishment rate can be reduced by using a means for inhibiting the accumulation of the bromide ion in the developing solution.

After being color development, the photographic emulsion layer of the photographic material of the present invention is generally bleached. Bleaching may be carried out simultaneously with fixation (bleach-fixation) or separately from the latter. In order to accelerate the photographic processing, bleaching may be followed by bleach-fixation. In addition, bleach-fixation in continuous two processing tanks, fixation prior to bleach-fixation or bleach-fixation followed by bleaching may also be applied to the photographic materials of the present invention, in accordance with the object thereof. Bleaching agents for use in processing the photographic material of the present invention include, for example, compounds of polyvalent metals such as iron(III), cobalt(III), chromium(VI) or copper(II), as well as peracids, quinones and nitro compounds. Specific examples of the bleaching agent include ferricyanides; bichromates; organic complexes of iron(III) or cobalt(III), for example, complexes with aminopolycarboxylic acids such as ethylenediaminetetraacetic acid, diethylenetriamine-pentaacetic acid, cyclohexanediaminetetraacetic acid, methylimino-diacetic acid, 1,3-diaminopropane-tetraacetic acid or glycolether-diamine-tetraacetic acid, as well as with citric acid, tartaric acid or malic acid; persulfates; bromates; permanganates; and nitrobenzenes. Among them, aminopolycarboxylic acid/iron(III) complexes such as ethylenediamine-tetraacetic acid/iron(III) complex as well as persulfates are preferred in view of the rapid processability and for prevention of environmental pollution. The aminopolycarboxylic acid/iron(III) complexes are especially useful, both in the bleaching solution and in the bleach-fixation solution. The bleaching solution or bleach-fixation solution containing such aminopolycarboxylic acid/iron(III) complexes generally has a pH value of from 5.5 to 8, but the solution may have a lower pH value to provide rapid processing.

The bleaching solution, bleach fixation solution and a pre-bath may contain a bleach accelerating agent, if desired. Various bleach accelerating agents are known, and examples of the agents which are advantageously used in the present invention include the mercapto group or disulfide group-containing compounds described in U.S. Pat. No. 3,893,858, West German Patent 1,290,812, JP-A-53-95630 and *Research Disclosure,* item 17129 (July, 1978); the thiazolidine derivatives described in JP-A-50-14029; the thiourea derivatives described in U.S. Pat. No. 3,706,561; the iodides described in JP-A-58-16235; the polyoxyethylene compounds described in West German Patent 2,748,430; the polyamine compounds described in JP-B 45-8836; and bromide ion. Among them, the mercapto group or disulfido group-having compounds are preferred due to their high accelerating effect, and in particular, the compounds described in U.S. Pat. No. 3,893,858, West German Patent 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426 and *Research Disclosure* No. 17129 (July 1978); thiazolidine derivatives described in JP-A-50-140129; thiourea derivatives described in JP-B-45-8506, JP-A-52-20832, JP-A-53-32735 and U.S. Pat. No. 3,706,561; iodides described in West German Patent 1,127,715 and JP-A-58-16235; polyoxyethylene compounds described in West German Patents 996,410 and 2,748,430; polyamine compounds described in JP-B-45-8836; compounds described in JP-A-49-42434, JP-A-49-59644, JP-A-53-94927, JP-A-54-35727, JP-A-55-26506 and JP-A-58-163940; and bromide ions. Among them, the compounds having a mercapto group or a disulfide group are preferred from the viewpoint of a high accelerating effect. Particularly, the compounds described in U.S. Pat. No. 3,893,858, West German Patent 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426 and *Research Disclosure* No. 17129 (July 1978); thiazolidine derivatives described in JP-A-50-140129; thiourea derivatives described in JP-B-45-8506, JP-A-52-20832, JP-A-53-32735 and U.S. Pat. No. 3,706,561; iodides described in West German Patent 1,127,715 and JP-A-58-16235; polyoxyethylene compounds described in West German Patents 996,410 and 2,748,430; polyamine compounds described in JP-B-45-8836; compounds described in JP-A-49-42434, JP-A-49-59644, JP-A-53-94927, JP-A-54-35727, JP-A-55-26506 and JP-A-58-163940; and bromide ions. Among them, the compounds having a mercapto group or a disulfide group are preferred from the viewpoint of a high accelerating effect. Particularly, the compounds described in U.S. Pat. No. 3,893,858, West German Patent 1,290,812 and JP-A-53-95630 are preferred. Further, the compounds described in U.S. Pat. No. 4,552,834 are preferred. These bleaching accelerators may be incorporated into the photographic materials. These bleaching accelerators are particularly effective in conducting the bleach fix treatment of the color photographic materials for photography.

The fixing agent for use in the present invention includes thiosulfates, thiocyanates, thioether compounds, thioureas and iodides in a large quantity. Among them, thiosulfates are generally used, and in particular, ammonium thiosulfate is most widely used. Preservatives for the bleach-fixation solution of the present invention include sulfites, bisulfites and carbonyl-bisulfite adducts are preferred.

The silver halide color photographic materials of the present invention are generally rinsed in water and/or stabilized, after being desilvered. The amount of the water to be used in the rinsing step is set in a broad range, depending on the characteristic of the photographic material being processed (for example, depending upon the raw material components, such as the coupler, etc.) or the use of the material, as well as the temperature of the rinsing water, the number of the rinsing tanks (the number of the rinsing stages), the wash water replenishment system being either normal current or countercurrent, and other processing conditions. The relation between the number of the rinsing tanks and the amount of the rinsing water to be used in a multi-stage countercurrent rinsing system can be calculated by the method described in *Journal of the Society of Motion Picture and Television Engineers,* Vol. 64, pages 248 to 253 (May, 1955).

According to the multi-stage countercurrent system described in the above-noted reference, the amount of the rinsing water to be used can be markedly reduced, but due to, the increase of the residence time of the water in the rinsing tank, bacteria readily propagates in the tank. As a result, floating matter generated by the propagation of bacteria tends to adhere to the surface of the photographic material during processing. In the practice of processing the photographic materials of the present invention, a method of reducing calcium and magnesium ions, as described in JP-A-62-288838, effectively overcomes the problem of floating matter. In addition, the isothiazolone compounds and thiabendazoles described in JP-A-57-8542; chlorine-containing bactericides such as chlorinated sodium isocyanurates; and benzotriazoles and other bactericides described in H. Horiguchi, *Chemistry of Bactericidal and Fungicidal Agents,* and *Bactericidal and Fungicidal Techniques to Microorganisms and Antimolding Technique,* edited by Association of Sanitary Technique, Japan, and *Encyclopedia of Bactericidal and Antimolding Agents,* edited by Nippon Antimolding Association, can also be used.

The pH value of the rinsing water for use in processing the photographic materials of the present invention is from 4 to 9, and preferably from 5 to 8. The temperature of the rinsing water and the rinsing time is set depending on the characteristics of the photographic material being processed, as well as the use thereof. In general, the temperature is from 15° to 45° C. and the time is from 20 seconds to 10 minutes, and preferably the temperature is from 25° to 40° C. and the time is from 30 seconds to 5 minutes. Alternatively, the photographic materials of the present invention may also be processed directly with a stabilizing solution in place of being rinsed with water. For the stabilization, any known methods, as described, for example, in JP-A-57-8543, JP-A-58-14834 and JP-A-60-220345, can be employed.

In addition, the photographic material of the present invention can also be stabilized, following the rinsing step. One example thereof is a stabilizing bath containing formaldehyde and a surfactant, which is used as a final bath for picture-taking color photographic materials. The stabilizing bath may also contain various chelating agents and antimolding agents.

The overflow from the rinsing and/or stabilizing solutions due to addition of replenishers thereto may be re-used in the other steps such as the previous desilvering step.

The silver halide color photographic materials of the present invention may contain a color developing agent for the purpose of simplifying and accelerating the processing of the materials. For incorporation of color developing agents into the photographic materials, various precursors of the agents are preferably used. For example, the indoaniline compounds described in U.S. Pat. No. 3,342,597, the Schiff base compounds described in U.S. Pat. No. 3,342,599 and *Research Disclosure* Items 14850 and 15159, the aldole compounds described in *Research Disclosure* Items 13924, the metal complexes described in U.S. Pat. No. 3,719,492 and the urethane compounds described in JP-A-53-135628, may be used as the precursors.

The silver halide color photographic material of the present invention can contain various 1-phenyl-3-pyrazolidones, if desired, for the purpose of accelerating the color development thereof. Specific examples of these compounds are described in JP-A-56-64339, JP-A-57-144547 and JP-A-58-115438.

The processing solutions for the photographic materials of the present invention are used at a temperature of from 10° C. to 50° C. A processing temperature of from 33° C. to 38° C. is standard, but the temperature may be increased to accelerate the processing or to shorten the processing time, or on the contrary, the temperature may be lowered to improve the quality of images formed and to improve the stability of the processing solutions used. For the purpose of economization of silver in the photographic materials, the cobalt intensification or hydrogen peroxide intensification as described in West German Patent 2,226,770 and U.S. Pat. No. 3,674,499 may be employed in the processing the photographic material of the present invention.

The excellent characteristics of the silver halide photographic materials of the present invention can be exhibited by carrying out processing with the color developing solutions containing not more than 0.002 mol of bromine ion per liter and substantially no benzyl alcohol for development time of not longer than 150 seconds.

The term "containing substantially no benzyl alcohol" as used herein means not more than 2 ml, preferably not more than 0.5 ml per liter of the color developing solution. It is most preferred that the developing solutions are completely free from benzyl alcohol.

The present invention is now illustrated in greater detail by reference to the following examples which, however, are not to be construed as limiting the invention in any way.

EXAMPLE 1

Both sides of a paper support were laminated with polyethylene. The resulting support was coated with the following layers to prepare a multi-layer color photographic paper having the layer structure described hereinbelow. Coating solutions were prepared in the following manner.

Preparation of coating solution for first layer 19.1 g of yellow coupler (ExY), 4.4 g of color image stabilizer (Cpd-1) and 0.7 g of color image stabilizer (Cpd-7) were dissolved in 27.2 cc of ethyl acetate and 8.2 g of solvent (Solv-3). The resulting solution was emulsified and dispersed in 185 cc of a 10% aqueous gelatin solution containing 8 cc of 10% sodium dodecylbenzenesulfonate. $2.0\times10^{-4}$ mol (per mol of silver) of each of the following two blue-sensitive sensitizing dyes was added to a silver chlorobromide emulsion (cube, grain size: 0.85 μm, a coefficient of variation: 0.07, 1 mol% of silver bromide based on the entire amount of grains being localized on part of the surface of grain) and the mixture was subjected to sulfur sensitization. The resulting emulsion and the above emulsified dispersion were mixed, and dissolved. A coating solution for the first layer was prepared so as to give the following composition. Coating solutions for the second layer to the seventh layer were prepared in the same way as in the coating solution for the first layer. Sodium salt of 1-oxy-3,5-dichloro-S-triazine as the hardening agent for gelatin in each layer.

The following spectral sensitizing dyes were used for the following layers:

Blue-sensitive emulsion layer

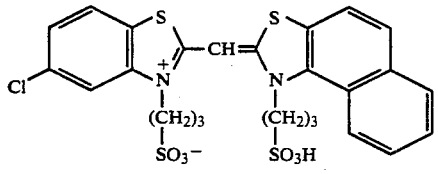

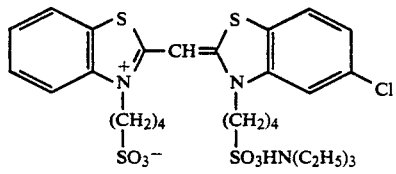

($2.0\times10^{-4}$ mol (per mol of silver halide) of each of the above two dyes))

Green-sensitive emulsion layer

-continued

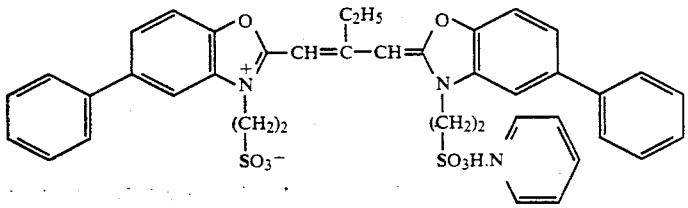

(4.0 × $10^{-4}$ mol per mol of silver halide)

and

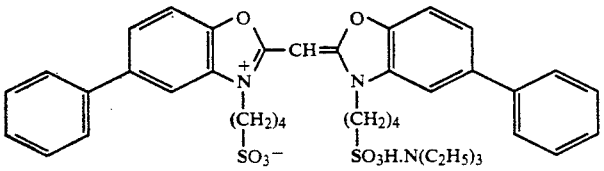

(7.0 × $10^{-5}$ mol per mol of silver halide)

Red-sensitive emulsion layer

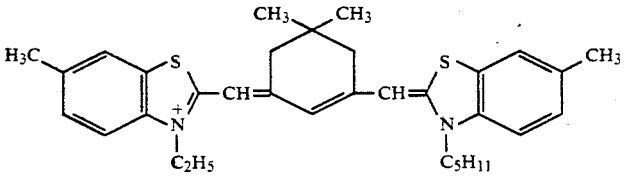

(0.9 × $10^{-4}$ mol per mol of silver halide)

$2.6\times10^{-3}$ mol of the following compound per mol of silver halide was added to the red-sensitive emulsion layer:

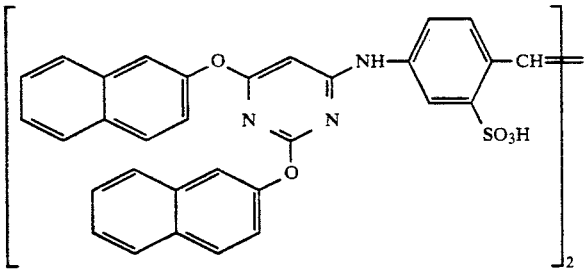

$8.5\times10^{-5}$ mol, $7.7\times10^{-4}$ mol, and $2.5\times10^{-4}$ mol of 1-(5-methylureidophenyl)-5-mercaptotetrazole per mol of silver halide were added to the blue-sensitive emulsion layer, the green-sensitive emulsion layer and the red-sensitive emulsion layer, respectively.

The following dyes were added to the emulsion layer to prevent irradiation:

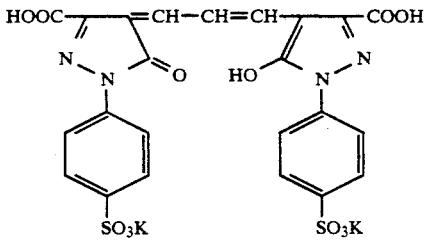

and

-continued

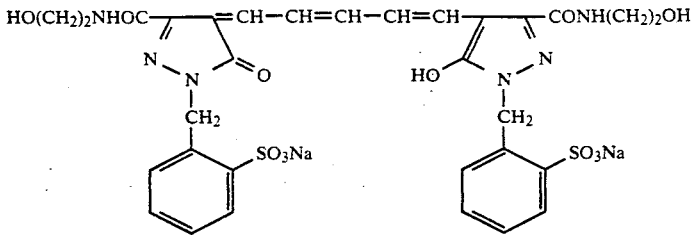

Layer structure

Each layer had the following composition. Numerals represent coating weight (g/m$^2$). The amount of the silver halide emulsions are coating weight in terms of silver.

Support

Polyethylene-laminated paper

[Polyethylene on the side of the first layer contains white pigment ($TiO_2$) and bluish dye (ultramarine)].

| | |
|---|---|
| First layer (blue-sensitive layer) | |
| The above-described silver chlorobromide emulsion | 0.30 |
| Gelatin | 1.86 |
| Yellow coupler (ExY) | 0.82 |
| Dye image stabilizer (Cpd-1) | 0.19 |
| Dye image stabilizer (Cpd-7) | 0.03 |
| Solvent (Solv-3) | 0.35 |
| Second layer (color mixing inhibiting layer) | |
| Gelatin | 0.99 |
| Color mixing inhibitor (Cpd-5) | 0.08 |
| Solvent (Solv-1) | 0.16 |
| Solvent (Solv-4) | 0.08 |
| Third layer (green-sensitive layer) | |
| Silver chlorobromide emulsion (grain size: 0.40μ, a coefficient of variation: 0.09, cube, 1 mol % of silver bromide based on the total amount of grains being localized on part of the surfaces of grains) | 0.20 |
| Gelatin | 1.24 |
| Magenta coupler (Comparative coupler (a)) | 0.29 |
| Dye image stabilizer (Cpd-3) | 0.09 |
| Dye image stabilizer (Cpd-4) | 0.06 |
| Solvent (Solv-2) | 0.32 |
| Fourth layer (ultraviolet light absorbing layer) | |
| Gelatin | 1.58 |
| Ultraviolet light absorber (UV-1) | 0.47 |
| Color mixing inhibitor (Cpd-5) | 0.05 |
| Solvent (Solv-5) | 0.24 |
| Fifth layer | |
| Silver chlorobromide emulsion (grain size: 0.36μ, a coefficient of variation: 0.11, cube, 1.6 mol % of silver bromide based on the total amount of grains being localized on part of the surfaces of grains) | 0.21 |
| Gelatin | 1.34 |
| Cyan coupler (ExC) | 0.34 |
| Color image stabilizer (Cpd-6) | 0.17 |
| Color image stabilizer (Cpd-7) | 0.34 |
| Color image stabilizer (Cpd-9) | 0.04 |
| Solvent (Solv-4) | 0.37 |
| Sixth layer (ultraviolet light absorbing layer) | |
| Gelatin | 0.53 |
| Ultraviolet light absorber (UV-1) | 0.16 |
| Color mixing inhibitor (Cpd-5) | 0.02 |
| Solvent (Solv-5) | 0.08 |
| Seventh layer (protective layer) | |
| Gelatin | 1.33 |
| Acrylic-modified copolymer of polyvinyl alcohol (a degree of modification: 17%) | 0.17 |
| Liquid paraffin | 0.03 |

(ExY) Yellow coupler

-continued
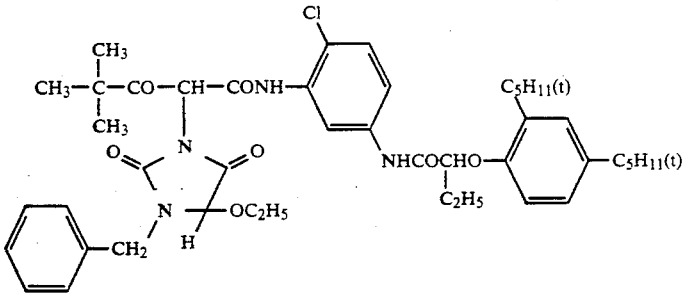
(ExC) Cyan coupler
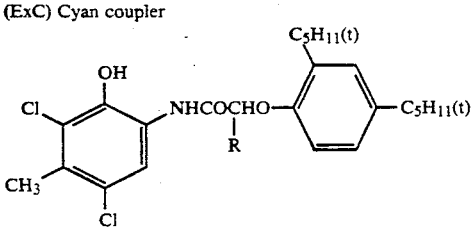
1:3:6 (by weight) mixture of R = H, $C_2H_5$, $C_4H_9$
(Cpd-1) Color image stabilizer
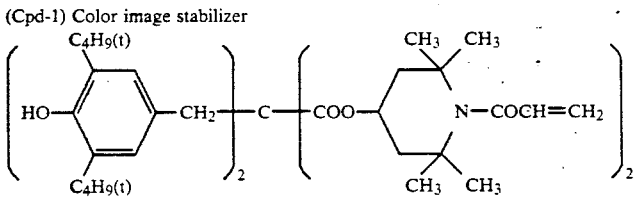
(Cpd-3) Color image stabilizer
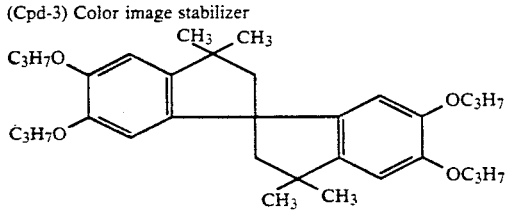
(Cpd-4) Color image stabilizer
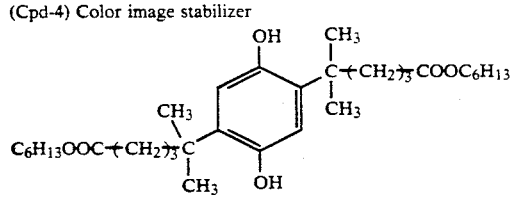
(Cpd-5) Color mixing inhibitor
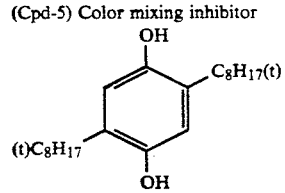
(Cpd-6) Color image stabilizer
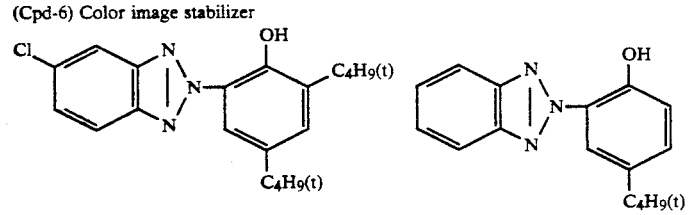

-continued
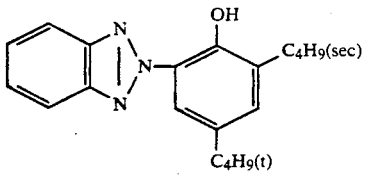
2:4:4 mixture (by weight)
(Cpd-7) Color image stabilizer
$$\text{-}(CH_2-\underset{\underset{CONHC_4H_9(t)}{|}}{CH})_n\text{-}$$
Average MW 60,000
(UV-1) Ultraviolet light absorber
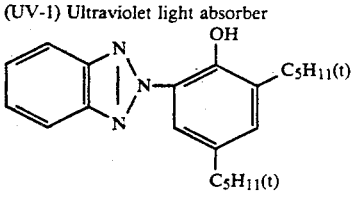
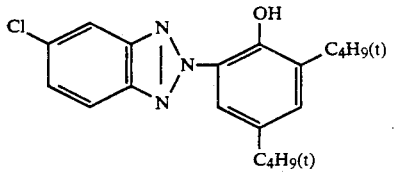
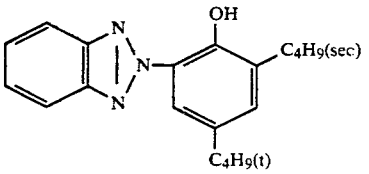
4:2:4 mixture (by weight)
(Solv-1) Solvent
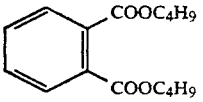
(Solv-2) Solvent
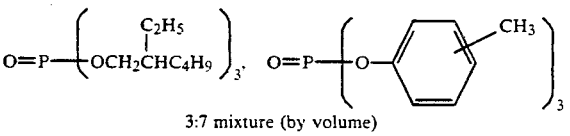
3:7 mixture (by volume)
(Solv-3) Solvent
$O{=}P\text{-}(O-C_9H_{19}(iso))_3$
(Solv-4) Solvent
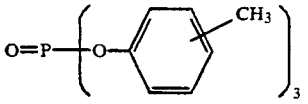
(Solv-5) Solvent
$$(CH_2)_8(COOC_8H_{17})_2$$
(Solv-6) Solvent
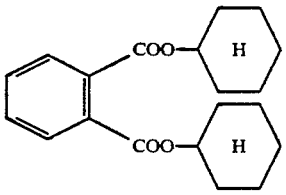
(Solv-7)

-continued

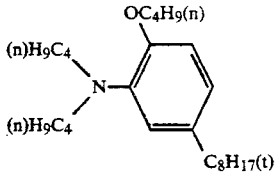

The photographic material was exposed through an optical wedge and then subjected to the following stages:

| Processing Stage | Temperature (°C.) | Processing Time |
|---|---|---|
| Color development | 35 | 45 sec. |
| Bleaching-fixing | 35 | 45 sec. |
| Rinsing (1) | 35 | 30 sec. |
| Rinsing (2) | 35 | 30 sec. |
| Rinsing (3) | 35 | 30 sec. |
| Drying | 75 | 60 sec. |
| Color developing solution | | |
| Water | | 800 ml |
| Ethylenediamine-N,N,N',N'-tetra-methylenephosphonic acid | | 3.0 g |
| Triethanolamine | | 8.0 g |
| Sodium chloride | | 1.4 g |
| Potassium carbonate | | 25 g |
| N-ethyl-N-(β-methanesulfonamido-ethyl)-3-methyl-4-aminoaniline sulfate | | 5.0 g |
| N,N-Bis(carboxymethyl)hydrazine | | 5.0 g |
| Fluorescent brightener (WHITEX 4B, a product of Sumitomo Chemical Co., Ltd.) | | 1.0 g |
| Add water | | 1000 ml |
| pH (25° C.) | | 10.05 |
| Bleach-fix solution | | |
| Water | | 700 ml |
| Ammonium thiosulfate aqueous solution (700 g/l) | | 100 ml |
| Ammonium sulfite | | 18 g |
| Ethylenediaminetetraacetic acid iron(III) ammonium dihydrate | | 55 g |
| Disodium ethylenediaminetetraacetate | | 3 g |
| Ammonium bromide | | 40 g |
| Glacial acetic acid | | 8 g |
| Add water | | 1000 ml |
| pH (25° C.) | | 5.5 |

Rinsing water

Tap water was treated with an ion exchange resin to reduce the content of .each of calcium and magnesium to 3 ppm or lower (electrical conductivity at 25° C.: 5 μs/cm).

The thus-prepared sample was referred to as sample A. The procedure of the preparation of the sample A was repeated except that magenta couplers in the third layer were used in combination with colored stain inhibitors as shown in Table 1. The colored stain inhibitors were incorporated to the layer with the magenta couplers. The other samples were similarly prepared.

The magenta reflection density (stain) of the non-image area of each of the developed samples was measured. Thereafter, the magenta reflection density (stain) of the non-image area was again measured after each sample was left to stand at 80° C. and RH of 70% for 3 days and for 6 days, respectively. The increment in stain density is shown in Table 1.

It is apparent from Table 1 that only the samples containing the couplers having an elimination group represented by formula (I) according to the present invention in combination with the inhibitors of the present invention, have peculiarly an excellent effect for preventing the colored stain of magenta from being formed. Though the colored stain inhibitors of the present invention have certainly an effect on the conventional two equivalent 5-pyrazolone magenta couplers, the colored stain is formed with the passage of time during long-term storage. Further, large amounts of the inhibitors must be used to obtain the same effect un the case of 80° C./70% for 3 days, whereas when the combinations of the present invention are used, the colored stain is substantially prevented from being formed even in the case of 80° C./70% for 6 days. Further, amounts of the compounds to be used are small.

TABLE 1

| Sample | Magenta coupler | Colored stain inhibitor | Added amount (mol % based on coupler) | Increment in magenta density 80° C./70% 3 days | 80° C./70% 6 days | Remarks |
|---|---|---|---|---|---|---|
| A | Comparative Coupler (a) | — | — | 0.07 | 0.15 | Comparative Example |
| $A_1$ | Comparative Coupler (a) | I-8 | 50 | 0.02 | 0.07 | Comparative Example |
| $A_2$ | Comparative Coupler (a) | I-29 | " | 0.03 | 0.07 | Comparative Example |
| $A_3$ | Comparative Coupler (a) | I-30 | " | 0.03 | 0.08 | Comparative Example |
| $A_4$ | Comparative Coupler (a) | Comparative Compound (a) | " | 0.06 | 0.14 | Comparative Example |
| $A_5$ | Comparative Coupler (a) | Comparative Compound (b) | " | 0.06 | 0.13 | Comparative Example |
| $A_6$ | Comparative Coupler (b) | — | — | 0.09 | 0.20 | Comparative Example |
| $A_7$ | Comparative Coupler (b) | I-67 | 50 | 0.02 | 0.10 | Comparative Example |
| $A_8$ | Comparative Coupler (b) | I-83 | " | 0.03 | 0.11 | Comparative Example |
| $A_9$ | Comparative Coupler (b) | I-84 | " | 0.03 | 0.10 | Comparative Example |

TABLE 1-continued

| | | | | | | |
|---|---|---|---|---|---|---|
| $A_{10}$ | Comparative Coupler (b) | Comparative Compound (a) | " | 0.07 | 0.18 | Comparative Example |
| $A_{11}$ | Comparative Coupler (c) | — | — | 0.12 | 0.25 | Comparative Example |
| $A_{12}$ | Comparative Coupler (c) | II-1 | 50 | 0.05 | 0.09 | Comparative Example |
| $A_{13}$ | Comparative Coupler (c) | II-3 | " | 0.05 | 0.10 | Comparative Example |
| $A_{14}$ | Comparative Coupler (c) | II-5 | " | 0.04 | 0.11 | Comparative Example |
| $A_{15}$ | Comparative Coupler (d) | — | — | 0.08 | 0.17 | Comparative Example |
| $A_{16}$ | Comparative Coupler (d) | III-1 | 50 | 0.03 | 0.09 | Comparative Example |
| $A_{17}$ | Comparative Coupler (d) | III-8 | " | 0.03 | 0.10 | Comparative Example |
| $A_{18}$ | Comparative Coupler (d) | III-22 | " | 0.07 | 0.10 | Comparative Example |
| $A_{19}$ | Comparative Coupler (d) | Comparative Compound (b) | " | 0.07 | 0.15 | Comparative Example |
| $A_{20}$ | Comparative Coupler (e) | — | — | 0.14 | 0.27 | Comparative Example |
| $A_{21}$ | Comparative Coupler (e) | III-24 | 50 | 0.03 | 0.10 | Comparative Example |
| $A_{22}$ | Comparative Coupler (e) | III-37 | " | 0.04 | 0.11 | Comparative Example |
| $A_{23}$ | Comparative Coupler (e) | III-59 | " | 0.03 | 0.10 | Comparative Example |
| $A_{24}$ | Comparative Coupler (f) | — | — | 0.16 | 0.30 | Comparative Example |
| $A_{25}$ | Comparative Coupler (f) | I-3/III-3 | 50/50 | 0.02 | 0.07 | Comparative Example |
| $A_{26}$ | Comparative Coupler (f) | II-1/III-59 | " | 0.03 | 0.09 | Comparative Example |
| $A_{27}$ | M-2 | — | — | 0.15 | 0.26 | Comparative Example |
| $A_{28}$ | " | Comparative Compound (a) | 50 | 0.14 | 0.25 | Comparative Example |
| $A_{29}$ | " | Comparative Compound (b) | " | 0.10 | 0.21 | Comparative Example |
| $A_{30}$ | " | I-47 | 30 | 0.01 | 0.02 | Invention |
| $A_{31}$ | " | I-49 | " | 0.01 | 0.02 | " |
| $A_{32}$ | " | I-72 | " | 0.01 | 0.02 | " |
| $A_{33}$ | " | III-22 | " | 0.02 | 0.03 | " |
| $A_{34}$ | " | I-47/III-1 | 30/30 | 0.01 | 0.01 | " |
| $A_{35}$ | M-3 | — | — | 0.14 | 0.24 | Comparative Example |
| $A_{36}$ | M-3 | I-24 | 30 | 0.01 | 0.02 | Invention |
| $A_{37}$ | " | II-1 | 50 | 0.01 | 0.02 | " |
| $A_{38}$ | " | III-34 | — | 0.02 | 0.03 | " |
| $A_{39}$ | M-12 | — | — | 0.15 | 0.27 | Comparative Example |
| $A_{40}$ | " | I-7 | 30 | 0.02 | 0.03 | Invention |
| $A_{41}$ | " | I-21 | " | 0.02 | 0.03 | " |
| $A_{42}$ | " | I-27 | " | 0.01 | 0.02 | " |
| $A_{43}$ | " | I-43 | " | 0.01 | 0.02 | " |
| $A_{44}$ | M-21 | — | — | 0.18 | 0.34 | Comparative Example |
| $A_{45}$ | " | II-1 | 50 | 0.01 | 0.02 | Invention |
| $A_{46}$ | " | III-45 | 30 | 0.02 | 0.03 | " |
| $A_{47}$ | " | III-48 | " | 0.01 | 0.02 | " |
| $A_{48}$ | " | III-61 | " | 0.01 | 0.02 | " |
| $A_{49}$ | M-21 | III-65 | 30 | 0.02 | 0.02 | Invention |
| $A_{50}$ | " | III-66 | " | 0.01 | 0.02 | " |
| $A_{51}$ | M-32 | — | — | 0.19 | 0.33 | Comparative Example |
| $A_{52}$ | " | I-39 | 30 | 0.02 | 0.02 | Invention |
| $A_{53}$ | " | I-68 | " | 0.01 | 0.02 | " |
| $A_{54}$ | " | I-90 | " | 0.02 | 0.03 | " |

Comparative Coupler (a)

TABLE 1-continued
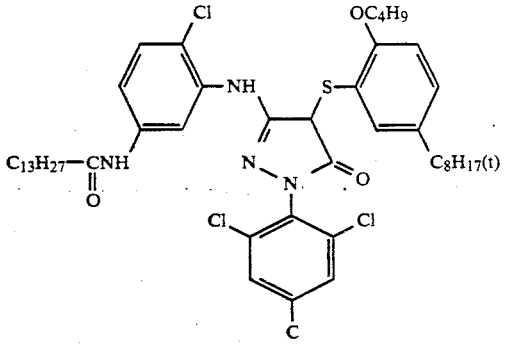
Coupler described in European Patent Laid-Open Nos. 255,722, 258,662 and 230,048 and U.S. Pat. No. 4,483,918
Comparative Coupler (b)
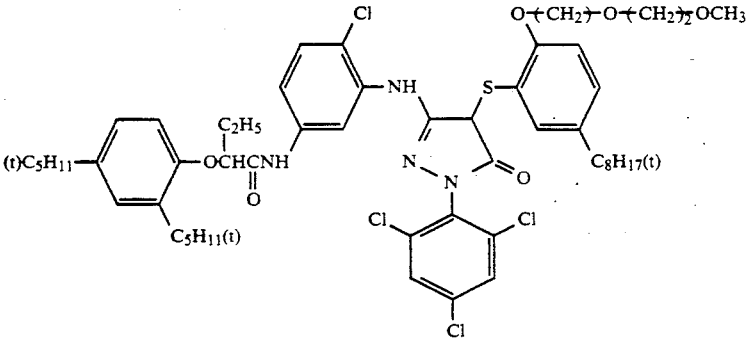
Coupler described in European Patent Laid-Open Nos. 255,722 and 258,662
Comparative Coupler (c)
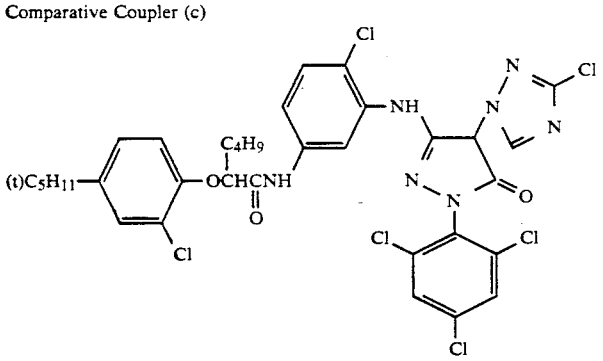
Coupler described in European Patent Laid-Open Nos. 255,722 and 258,662
Comparative Coupler (d)
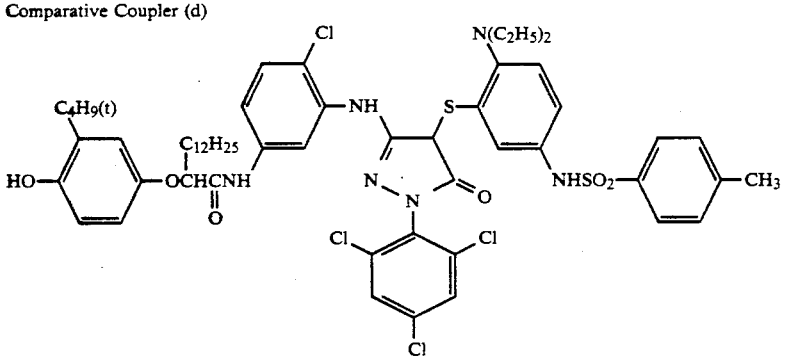
Coupler described in European Patent Laid-Open Nos. 230,048
Comparative Coupler (e)

TABLE 1-continued

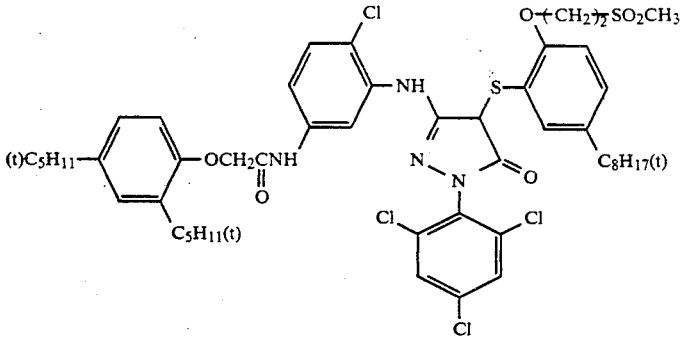

Coupler described in European Patent Laid-Open No. 230,048

Comparative Coupler (f)

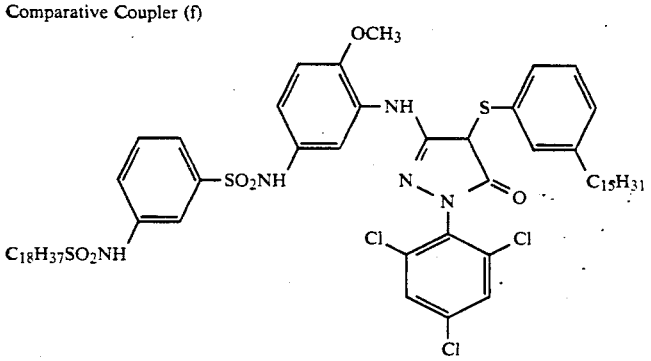

Coupler described in U.S. Pat. No. 4,483,918

Comparative compound (a)

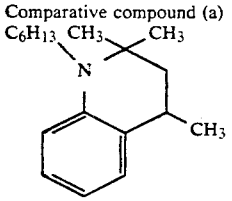

Compound described in U.S. Pat. No. 4,483,918

Comparative compound (b)

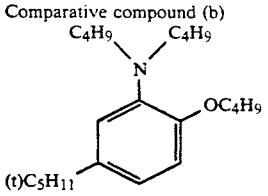

Compound described in U.S. Pat. No. 4,483,918

EXAMPLE 2

Both sides of a paper support were laminated with polyethylene. The resulting support was coated with the following layers to prepare a multi-layer photographic paper having the layer structure described hereinbelow. Coating solutions were prepared in the following manner.

Preparation of coating solution for the first layer 19.1 g of yellow coupler (ExY), 4.4 g of color image stabilizer (Cpd-1) and 1.8 g of color image stabilizer (Cpd-7) were dissolved in 27.2 ml of ethyl acetate, 4.1 g of solvent (Sol 3) and 4.1 g of solvent (Solv-6). The resulting solution was emulsified and dispersed in 185 ml of a 10% aqueous gelatin solution containing 8 ml of 10% sodium dodecylbenzenesulfonate. $5.0\times10^{-4}$ mol (per mol of silver) of the following blue-sensitive sensitizing dye was added to a sulfur-sensitized silver chlorobromide emulsion [a 1:3 (by molar ratio in terms of Ag) mixture of an emulsion (silver bromide: 80.0 mol%, cube, average grain size: 0.85μ, a coefficient of variation: 0.08) and an emulsion (silver bromide: 80.0%, cube, average grain size: 0.62μ, a coefficient of variation: 0.07)] to prepare an emulsion. The emulsion and the above emulsified dispersion were mixed and dissolved. A coating solution for the first layer was prepared so as to give the following composition. Coating solutions for the second layer to the seventh layer were prepared in the same way as in the coating solution for the first layer. As the hardening agent for gelatin, the sodium salt of 1-oxy-3,5-dichloro-s-triazine was used for each layer.

The following spectral sensitizing dyes were used for the following layers.

Blue-sensitive emulsion layer

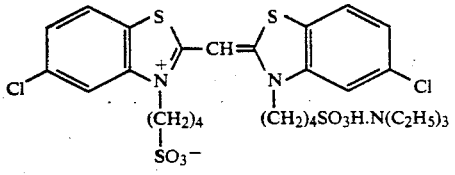

($5.0 \times 10^{-4}$ mol per mol of silver halide)

Green-sensitive emulsion layer

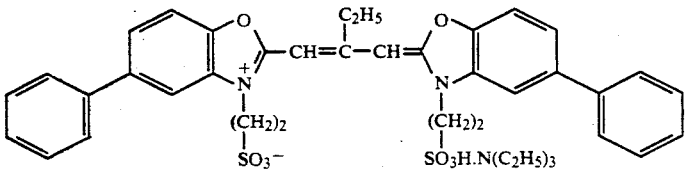

($4.0 \times 10^{-4}$ mol per mol of silver halide)

and

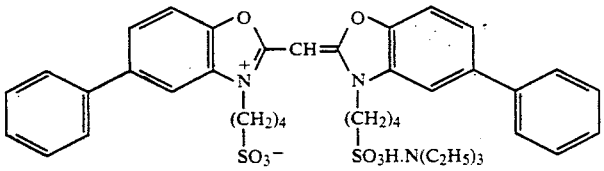

($7.0 \times 10^{-5}$ mol per mol of silver halide)

Red-sensitive emulsion layer

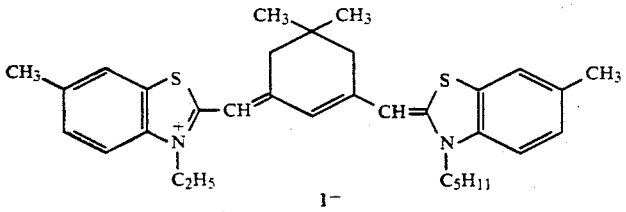

($0.9 \times 10^{-4}$ mol per mol of silver halide)

$2.6\times10^{-3}$ mol of the following compound per mol of silver halide was added to the red-sensitive emulsion layer:

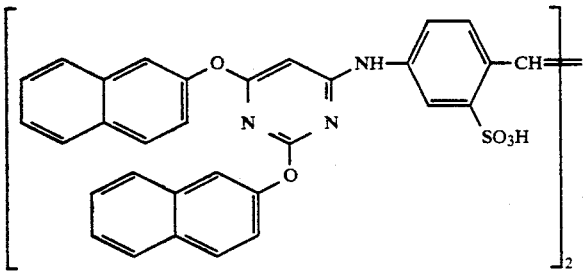

$4.0\times10^{-6}$ mol, $3.0\times10^{-5}$ mol and $1.0\times10^{-5}$ mol of 1-(5-methylureidophenyl)-5-mercaptotetrazole per mol of silver halide was added to the blue-sensitive emulsion layer, the green-sensitive emulsion layer and the red-sensitive emulsion layer, respectively. $8\times10^{-3}$ mol, $2\times10^{-2}$ mol and $2\times10^{-2}$ mol of 2-methyl-5-t-octylhydroquinone per mol of silver halide was added to the blue-sensitive emulsion layer, the green-sensitive emulsion layer and the red-sensitive emulsion layer, respectively.

Further, $1.2\times10^{-2}$ mol and $1.1\times10^{-2}$ mol of 4-hydroxy-6-methyl-1,3,3a,7-tetrazaindene per mol of silver halide was added to the blue-sensitive emulsion layer and the green-sensitive emulsion layer, respectively.

The following dyes were added to the emulsion layers to prevent irradiation:

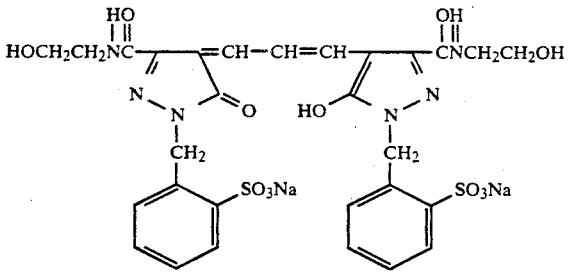

and

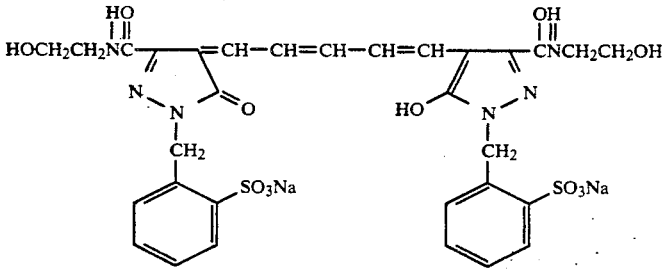

Layer Structure

Each layer had the following composition. Numerals represent coating weight (g/m$^2$). The amount of the silver halide emulsions are represented by coating weight in terms of silver.

Support

Polyethylene-laminated paper

[The polyethylene on the side of the first layer contains white pigment ($TiO_2$) and bluish dye (ultramarine)]

| | |
|---|---|
| First layer (blue-sensitive layer) | |
| The above-described silver chlorobromide emulsion [AgBr: 80 mol %) | 0.26 |
| Gelatin | 1.83 |
| Yellow coupler (ExY) | 0.83 |
| Color image stabilizer (Cpd-1) | 0.19 |
| Color image stabilizer (Cpd-7) | 0.08 |
| Solvent (Solv-3) | 0.18 |
| Solvent (Solv-6) | 0.18 |
| Second Layer (color mixing inhibiting layer) | |
| Gelatin | 0.99 |
| Color mixing inhibitor (Cpd-6) | 0.08 |
| Solvent (Solv-1) | 0.16 |
| Solvent (Solv-4) | 0.08 |
| Third layer (green-sensitive layer) | |
| Silver chlorobromide emulsion [a 1:1 (by Ag molar ratio) mixture of emulsion (AgBr: 90 mol %, cube, average grain size: 0.47μ, a coefficient of variation: 0.12) and emulsion (AgBr: 90 mol %, cube, average grain size: 0.36μ, a coefficient of variation: 0.09) | 0.16 |
| Gelatin | 1.79 |
| Magenta coupler [comparative coupler(g)] | 0.32 |
| Color image stabilizer (Cpd-3) | 0.20 |
| Color image stabilizer (Cpd-4) | 0.01 |
| Solvent (Solv-2) | 0.65 |
| Fourth layer (ultraviolet light absorbing layer) | |
| Gelatin | 1.58 |
| Ultraviolet light absorber (UV-1) | 0.47 |
| Color mixing inhibitor (Cpd-5) | 0.05 |
| Solvent (Solv-5) | 0.24 |
| Fifth layer (red-sensitive layer) | |
| Silver chlorobromide emulsion [a 1:2 (by Ag molar ratio) mixture of emulsion (AgBr: 70 mol %, cube, average grain size: 0.49μ, a coefficient of variation: 0.08) and emulsion (AgBr: 70 mol %, cube, average grain size: 0.34μ, a coefficient of variation: 0.10) | 0.23 |
| Gelatin | 1.34 |
| Cyan coupler (ExC) | 0.30 |
| Color image stabilizer (Cpd-6) | 0.17 |
| Color image stabilizer (Cpd-7) | 0.40 |
| Solvent (Solv-6) | 0.20 |
| Sixth layer (ultraviolet light absorbing layer) | |
| Gelatin | 0.53 |
| Ultraviolet light absorber (UV-1) | 0.16 |
| Color mixing inhibitor (Cpd-5) | 0.02 |
| Solvent (Solv-5) | 0.08 |

-continued

| Seventh layer (protective layer) | |
|---|---|
| Gelatin | 1.33 |
| Acrylic-modified copolymer of polyvinyl alcohol (a degree of modification: 17%) | 0.17 |
| Liquid paraffin | 0.03 |

(Cpd-1) Color image stabilizer

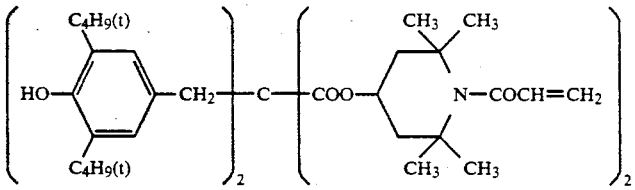

(Cpd-3) Color image stabilizer

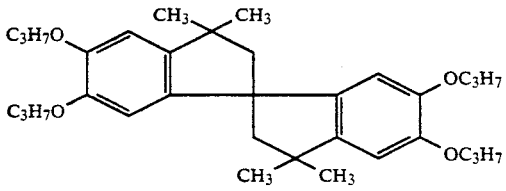

(Cpd-4) Color image stabilizer

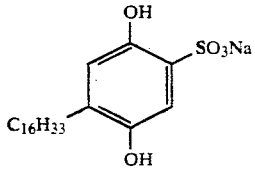

(Cpd-5) Color mixing inhibitor

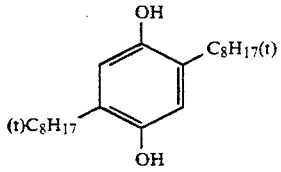

(Cpd-6) Color image stabilizer

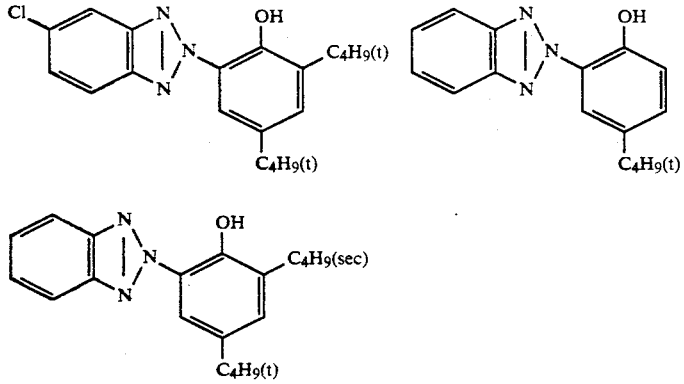

2:4:4 mixture (by weight)

(Cpd-7) Color image stabilizer

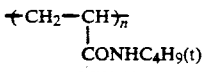

Average MW 80,000

(UV-1) Ultraviolet light absorber

-continued
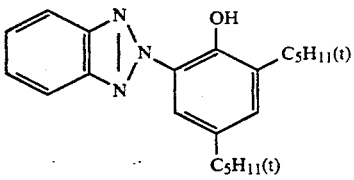
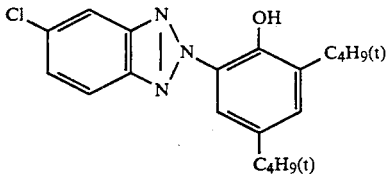
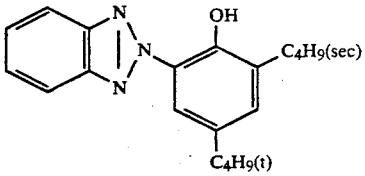
4:2:4 mixture (by weight)
(Solv-1) Solvent
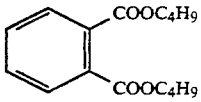
(Solv-2) Solvent
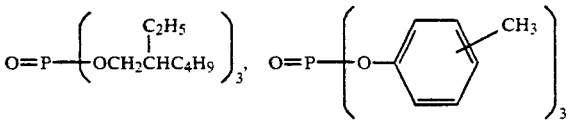
2:1 mixture (by weight)
(Solv-3) Solvent
$O{=}P{+}O{-}C_9H_{19}(iso))_3$
(Solv-4) Solvent
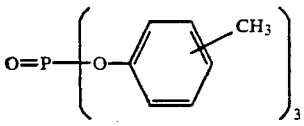
(Solv-5) Solvent
$$\begin{array}{l} COOC_8H_7 \\ | \\ (CH_2)_8 \\ | \\ COOC_8H_7 \end{array}$$
(Solv-6) Solvent
$$C_8H_{17}\underset{\underset{O}{\backslash\,/}}{CH\,CH}(CH_2)_7COOC_8H_{17}$$
(ExY) Yellow coupler -continued

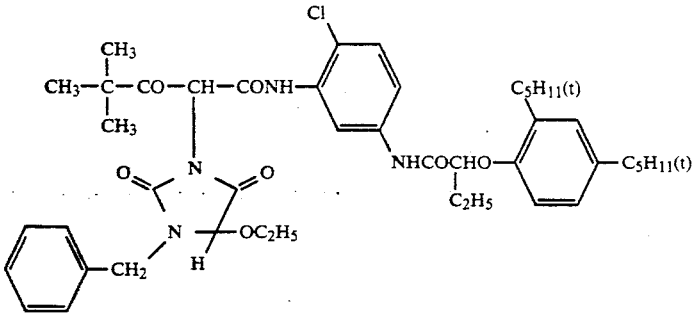

(ExC) Cyan coupler

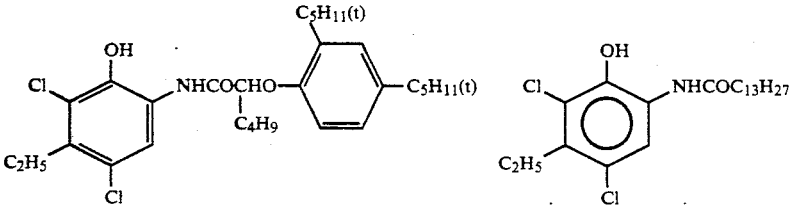

1:1 mixture (by molar ratio)

The above-described photographic material was exposed through an optical wedge and then subjected to the following processing stages:

| Processing Stage | Temperature (°C.) | Processing Time |
|---|---|---|
| Color development | 37 | 3 min. 30 sec. |
| Bleach-fix | 33 | 1 min. 30 sec. |
| Rinsing | 24 to 34 | 3 min. |
| Drying | 70 to 80 | 1 min. |

Each processing solution has the following composition:

| Color developing solution | |
|---|---|
| Water | 800 ml |
| Diethylenetriaminepentaacetic acid | 1.0 g |
| Nitrilotriacetic acid | 2.0 g |
| 1-Hydroxyethylidene-1,1-diphosphonic acid (60% aqueous solution) | 1.0 ml |
| Benzyl alcohol | 15 ml |
| Diethylene glycol | 10 ml |
| Sodium sulfite | 2.0 g |
| Potassium bromide | 1.0 g |
| Potassium carbonate | 30 g |
| N-Ethyl-N-(β-methanesulfonamidoethyl)-3-methyl-4-aminoaniline sulfate | 4.5 g |

-continued

| | |
|---|---|
| Hydroxylamine sulfate | 3.0 g |
| Fluorescent brightener (WHITEX 4, a product of Sumitomo Chemical Co., Ltd.) | 1.0 g |
| Add water to make | 1000 ml |
| pH (25° C.) | 10.25 |
| Bleach-fix solution | |
| Water | 400 ml |
| Ammonium thiosulfate (70% aqueous solution) | 150 ml |
| Sodium sulfite | 18 g |
| Ethylenediaminetetraacetic acid iron(III) ammonium | 55 g |
| Disodium ethylenediaminetetraacetate | 5 g |
| Add water to make | 1000 ml |
| pH (25° C.) | 6.70 |

The thus-obtained sample was referred to as sample B. The procedure of the preparation of the sample B was repeated except that combinations of magenta couplers in the third layer and colored stain inhibitors as given in Table 2 were used to prepare the other samples. The colored stain inhibitors were incorporated into the layer with the couplers.

In the same way as in Example 1, each of the developed samples was tested. The increment in the stain density after 80° C./70% RH for 6 days was measured. The results are shown in Table 2.

TABLE 2

| Sample | Magenta coupler | Colored stain inhibitor | Added amount (mol % based on Coupler) | Increment in magenta density (80° C./70% 6 days) | Remarks |
|---|---|---|---|---|---|
| B | Comparative Coupler (g) | — | — | 0.31 | Comparative Example |
| $B_1$ | Comparative Coupler (g) | I-1 | 30 | 0.07 | Comparative Example |
| $B_2$ | Comparative Coupler (g) | I-18 | " | 0.08 | Comparative Example |
| $B_3$ | Comparative Coupler (g) | I-23 | " | 0.07 | Comparative Example |
| $B_4$ | Comparative Coupler (g) | I-30 | " | 0.09 | Comparative Example |
| $B_5$ | Comparative Coupler (g) | I-77 | " | 0.07 | Comparative Example |
| $B_6$ | Comparative | II-3 | " | 0.08 | Comparative |

TABLE 2-continued

| | | | | | |
|---|---|---|---|---|---|
| | Coupler (g) | | | | Example |
| $B_7$ | Comparative Coupler (g) | III-1 | " | 0.07 | Comparative Example |
| $B_8$ | Comparative Coupler (g) | III-64 | " | 0.09 | Comparative Example |
| $B_9$ | Comparative Coupler (h) | — | — | 0.32 | Comparative Example |
| $B_{10}$ | Comparative Coupler (h) | I-5 | 30 | 0.09 | Comparative Example |
| $B_{11}$ | Comparative Coupler (h) | I-33 | " | 0.07 | Comparative Example |
| $B_{12}$ | Comparative Coupler (h) | I-41 | " | 0.10 | Comparative Example |
| $B_{13}$ | Comparative Coupler (h) | III-3 | 30 | 0.08 | Comparative Example |
| $B_{14}$ | Comparative Coupler (h) | III-55 | " | 0.09 | Comparative Example |
| $B_{15}$ | M-1 | — | — | 0.25 | Comparative Example |
| $B_{16}$ | " | I-47 | 30 | 0.02 | Invention |
| $B_{17}$ | " | I-48 | " | 0.03 | " |
| $B_{18}$ | " | III-1 | 30 | 0.02 | " |
| $B_{19}$ | " | III-28 | " | 0.02 | " |
| $B_{20}$ | M-2 | — | — | 0.26 | Comparative Example |
| $B_{21}$ | " | I-16 | 30 | 0.02 | Invention |
| $B_{22}$ | " | I-28 | " | 0.03 | " |
| $B_{23}$ | " | I-41 | " | 0.03 | " |
| $B_{24}$ | " | I-47 | " | 0.02 | " |
| $B_{25}$ | " | I-49 | " | 0.03 | " |
| $B_{26}$ | " | II-1 | " | 0.03 | " |
| $B_{27}$ | M-2 | III-1 | 30 | 0.02 | Invention |
| $B_{28}$ | " | III-37 | " | 0.03 | " |
| $B_{29}$ | " | I-47/III-1 | 30/30 | 0.01 | " |

Comparative coupler (g)

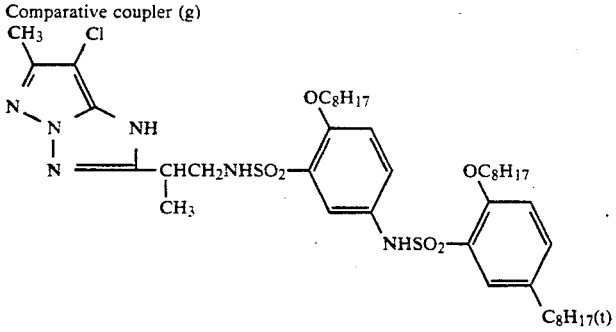

Coupler described in European Patent Laid-Open Nos. 255722, 258662, 230048 and 228655 and U.S. Pat. No. 4,704,350.

Comparative coupler (h)

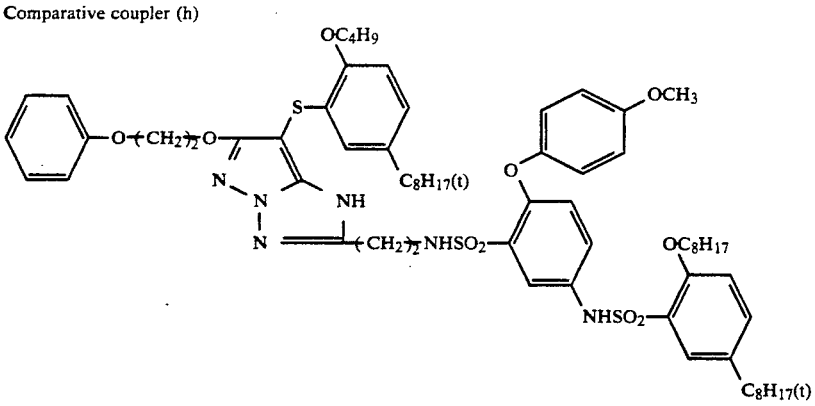

Coupler described in European Patent Laid-Open No. 230048.

It is apparent from Table 2 that only the combinations of the present invention have peculiarly an excellent effect of preventing colored stain from being formed.

EXAMPLE 3

Both sides of a paper support were laminated with polyethylene. The support was coated with the following layers to prepare a multi-layer photographic paper having the layer structure described hereinbelow. The coating solutions were prepared in the following manner.

Preparation of coating solution for first layer 60.0 g of yellow coupler (ExY) and 28.0 g of anti-fading agent (Cpd-1) were dissolved in 150 ml of ethyl acetate, 1.0 ml of solvent (Solv-3), and 3.0 ml of solvent (Solv-4). The resulting solution was added to 450 cc of a 10% aqueous gelatin solution containing sodium dodecylbenzenesulfonate. The mixture was dispersed by means of an ultrasonic homogenizer. The dispersion was mixed with 420 g of a silver chlorobromide emulsion (silver bromide 0.7 mol %) containing the following blue sensitive sensitizing dye and dissolved to prepare a coating solution for the first layer. In the same way as in the coating solution for the first layer, coating solutions for the second layer to the seventh layer were prepared As the hardening agent for gelation, 1,2-bis(-vinylsulfonyl)ethane was used for each layer.

The following spectral sensitizing dye were used for the following layers:

Blue-sensitive emulsion layer
- Anhydro-5,5'-dichloro-3,3'-disulfoethylthiacyanine hydroxide Green-sensitive emulsion layer:
- Anhydro-9-ethyl-5,5'-diphenyl-3,3'-di-sulfoethyloxacarbocyanine hydroxide Red-sensitive emulsion layer:
- 3,3'-Diethyl-5-methoxy-9,9'-(2,2'-di-methyl-1,3-propano)thiacarbocyanine iodide The following stabilizers were used for each emulsion layer:

A 7:2:1 (by molar ratio) mixture of the following A, B and C:
- A: 1-(2-acetamino-phenyl-5-mercaptotetrazole
- B: 1-phenyl-5-mercaptotetrazole
- C: 1-(p methoxyphenyl)-5-mercaptotetrazole The following compounds were used as irradiation preventing dyes:

[3-Carboxy-5-hydroxy 4-(3-(3 carboxy-5-oxo-1-(2,5-disulfonatophenyl)-2-pyrazoline-4-ylidene)- 1-propenyl)-1-pyrazolyl]benzene-2,5-disulfonate disodium salt.

N,N'-(4,8-Dihydroxy-9,10-dioxo-3,7-disulfonatoanthracene-1,5-diyl)bis(aminomethanesulfonate) tetrasodium salt.

[3-Cyano-5-hydroxy-4-(3-(3-(3-cyano-5-oxo-1-(4-sulfonatophenyl)-2-pyrazoline-4-ylidene)-1-pentanyl)-1-pyrazolyl]benzene-4-sulfonate sodium salt.

Layer structure

Each layer has the following composition. Numerals represent coating weight (g/m$^2$). The amounts of the silver halide emulsions are represented by coating weight in terms of silver.

Support

Paper support (both sides thereof being laminated with polyethylene)

| | |
|---|---|
| First layer (blue-sensitive layer) | |
| The above-described silver chlorobromide emulsion (AgBr: 0.7 mol %, cube, grain size: 0.9μ) | 0.29 |
| Gelatin | 1.80 |
| Yellow coupler (ExY) | 0.60 |

-continued

| | |
|---|---|
| Anti-fading agent (Cpd-1) | 0.28 |
| Solvent (Solv-3) | 0.01 |
| Solvent (Solv-4) | 0.03 |
| Second layer (Color mixing inhibiting layer) | |
| Gelatin | 0.80 |
| Color mixing inhibitor (Cpd-2) | 0.055 |
| Solvent (Solv-1) | 0.03 |
| Solvent (Solv-2) | 0.015 |
| Third layer (green-sensitive layer) | |
| Silver chlorobromide emulsion (AgBr: 0.7 mol %, cube, grain size: 0.45μ) | 0.305 |
| Gelatin | 1.40 |
| Magenta coupler (M-2) | 0.67 |
| Anti-fading agent (Cpd-3) | 0.23 |
| Anti-fading agent (Cpd-4) | 0.11 |
| Solvent (Solv-1) | 0.20 |
| Solvent (Solv-2) | 0.02 |
| Fourth layer (color mixing inhibiting layer) | |
| Gelatin | 1.70 |
| Color mixing inhibitor (Cpd-2) | 0.065 |
| Ultraviolet light absorber (UV-1) | 0.45 |
| Ultraviolet light absorber (UV-2) | 0.23 |
| Solvent (Solv-1) | 0.05 |
| Solvent (Solv-2) | 0.05 |
| Fifth layer (red-sensitive layer) | |
| Silver chlorobromide emulsion (AgBr: 4 mol %, cube, grain size: 0.5μ) | 0.21 |
| Gelatin | 1.80 |
| Cyan coupler (ExC-1) | 0.26 |
| Cyan coupler (ExC-2) | 0.12 |
| Color mixing inhibitor (Cpd-1) | 0.20 |
| Solvent (Solv-1) | 0.16 |
| Solvent (Solv-2) | 0.09 |
| Sixth layer (ultraviolet light absorbing layer) | |
| Gelatin | 0.70 |
| Ultraviolet light absorber (UV-1) | 0.26 |
| Ultraviolet light absorber (UV-2) | 0.07 |
| Solvent (Solv-1) | 0.30 |
| Solvent (Solv-2) | 0.09 |
| Seventh layer (protective layer) | 1.07 |
| Gelatin | |

(ExY) yellow coupler
α-Pivaloyl-α-(3-benzyl-1-hydantoinyl)-2-chloro-5-[β-(dodecylsulfonyl)butylamido]acetanilide (ExC-1) cyan coupler
2-Pentafluorobenzamido-4-chloro-5-[2-(2,4-di-tert-amylphenoxy)-3-methylbutylamidophenol (ExC-2) cyan coupler
2,4-Dichloro-3-methyl-6-[α-(2,4-di-tert-amylphenoxy)butylamido]phenol (Cpd-1) Anti-fading agent
2,5-Di-tert-amylphenyl-3,5-di-tert-butylhydroxy benzoate (Cpd-2) color mixing inhibitor
2,5-Di-tert-octylhydroquinone (Cpd-3) Anti fading agent
1,4-Di-tert-amyl-2,5-dioctyloxybenzene (Cpd-4) Anti-fading agent
2,2'-methylenebis(4-methyl-6-tert-butylphenol)

(Cpd-5)
p-(p-Toluenesulfonamido)-phenyl-dodeone (Solv-3) Solvent
Di-(i-nonyl) phthalate (Solv-4) solvent
N,N-Diethylcarbonamido-methoxy-2,4-di-t-amylbenzene (UV-1) ultraviolet light absorber
2-(2-Hydroxy-3,5-di-tert-amylphenyl)benzotriazole (UV-2) ultraviolet light absorber
2-(2-Hydroxy-3,5-di-tert-butylphenyl)benzotriazole (Solv-1) solvent
Di-(2-ethylhexyl) phthalate
(Solv-2) solvent
Dibutyl phthalate The above photographic material was exposed through an optical wedge and then subjected to the following processing stages.

| Processing Stage | Temperature (°C.) | Processing Time |
|---|---|---|
| Color development | 35 | 45 sec. |
| Bleach-fix | 30 to 36 | 45 sec. |
| Stabilization (1) | 30 to 37 | 20 sec. |
| Stabilization (2) | 30 to 37 | 20 sec. |
| Stabilization (3) | 30 to 37 | 20 sec. |
| Stabilization (4) | 30 to 37 | 30 sec. |
| Drying | 70 to 85 | 60 sec. |

A four tank countercurrent system of stabilization (4)→(1) was used.

Each processing solution had the following composition:

| | |
|---|---|
| Color developing solution | |
| Water | 800 ml |
| Ethylenediaminetetraacetic acid | 2.0 g |
| Triethanolamine | 8.0 g |
| Sodium chloride | 1.4 g |
| Potassium carbonate | 25 g |
| N-Ethyl-N-(β-methanesulfonamido-ethyl)-3-methyl-4-aminoaniline sulfate | 5.0 g |
| N,N-Diethylhydroxylamine | 4.2 g |
| 5,6-Dihydroxybenzene-1,2,4-trisulfonic acid | 0.3 g |
| Fluorescent brightener (4,4'-diamino-stilbene type) | 2.0 g |
| Add water to make | 1000 ml |
| pH (25° C.) | 10.10 |
| Bleach-fix solution | |
| Water | 400 m |
| Ammonium thiosulfate (70% aqueous solution) | 100 ml |
| Sodium sulfite | 18 g |
| Ethylenediaminetetraacetic acid iron(III) ammonium | 55 g |
| Disodium ethylenediaminetetraacetate | 3 g |
| Glacial acetic acid | 8 g |
| Add water to make | 1000 ml |
| pH (25° C.) | 5.5 |
| Stabilizing solution | |
| Formalin (37% aqueous solution) | 0.1 g |
| Formalin-sulfurous acid adduct | 0.7 g |
| 5-Chloro-2-methyl-4-isothiazoline-3-one | 0.02 g |
| 2-Methyl-4-isothiazoline-3-one | 0.01 g |
| Copper sulfate | 0.005 g |
| Add water to make | 1000 ml |
| pH (25° C.) | 4.0 |

The thus-obtained sample was referred to as sample C. The procedure of the preparation of the sample C was repeated except that 30 mol % (based on the amount of the coupler) of each of the compounds I-47 and III-1 of the present invention was added to the third layer to prepare sample $C_1$.

Sample D and sample $D_1$ were prepared in the following manner.

A paper support (both sides thereof being laminated with polyethylene) was coated with the following layers to prepare a multi-layer color photographic material having the following layer structure. The coating solutions were prepared in the following manner.

Preparation of coating solution for first layer 60.0 g of yellow coupler (ExY) and 28.0 g of anti-fading agent (Cpd-1) were dissolved in 150 ml of ethyl acetate, 3 ml of solvent (Solv-1), and 1.5 ml of solvent (Solv-2). The resulting solution was added to 450 cc of a 10% aqueous gelatin solution containing sodium dodecylbenzenesulfonate. The mixture was dispersed by means of an ultrasonic homogenizer. The dispersion was mixed and dissolved in 420 g of silver chlorobromide emulsion (silver bromide 90.0 mol %) containing the following blue-sensitive sensitizing dye to prepare a coating solution for the first layer. In the same way as in the coating solution for the first layer, coating solutions for the second layer to the seventh layer were prepared. As the hardening agent for gelatin, there was used 1,2-bis(vinylsulfonyl)ethane for each layer.

The following spectral sensitizing dyes were used for the following layers:

Blue-sensitive emulsion layer:
Anhydro-5-methoxy 5'-methyl 3,3'-di-sulfopropyl selenacyanine hydroxide Green-sensitive emulsion layer:
Anhydro 9-ethyl-5,5'-diphenyl-3,3'-di-sulfoethyloxacarbocyanine hydroxide Red-sensitive emulsion layer:
3,3'-Diethyl 5-methoxy-9,9'-(2,2'-dimethyl 1,3-propano)thiacarbocyanine iodide The following compound was used as the stabilizer for each emulsion layer:
1-Methyl-2-mercapto-5-acetylamino-1,3,4-triazole The following compounds were used as irradiation preventing dyes:
[3-Carboxy-5-hydroxy-4-(3-(3-carboxy-5-oxo-1-(2,5-disulfonatophenyl) 2-pyrazoline-4-ylidene)- 1-propenyl)-1-pyrazolyl]-benzene-2,5-disulfonate disodium salt
N,N-(4,8-Dihydroxy-9,10-dioxo-3,7-disulfonatoanthracene-1,5-diyl) bis(aminomethanesulfonate) tetrasodium salt Layer structure Each layer has the following composition. Numerals represent coating weight (g/m²). The amounts of silver halide emulsions are represented by the coating weight in terms of silver.

Support

Paper support (both side thereof being laminated with polyethylene)

| | |
|---|---|
| First layer (blue-sensitive layer) | |
| Silver halide emulsion (Br: 90%) | 0.29 |
| Gelatin | 1.80 |
| Yellow coupler (ExY) | 0.60 |
| Anti-fading agent (Cpd-1) | 0.28 |
| Solvent (Solv-1) | 0.03 |
| Solvent (Solv-2) | 0.015 |
| Second layer (Color mixing inhibiting layer) | |
| Gelatin | 0.80 |
| Color mixing inhibitor (Cpd-2) | 0.055 |
| Solvent (Solv-1) | 0.03 |
| Solvent (Solv-2) | 0.015 |
| Third layer (green-sensitive layer) | |
| Silver halide emulsion (Br: 74%) | 0.305 |
| Gelatin | 1.40 |
| Magenta coupler (M-1) | 0.67 |
| Anti-fading agent (Cpd-3) | 0.23 |
| Anti-fading agent (Cpd-4) | 0.11 |
| Solvent (Solv-1) | 0.20 |

-continued

| | |
|---|---|
| Solvent (Solv-2) | 0.02 |
| Fourth layer (color mixing inhibiting layer) | |
| Gelatin | 1.70 |
| Color mixing inhibitor (Cpd-2) | 0.065 |
| Ultraviolet light absorber (UV-1) | 0.45 |
| Ultraviolet light absorber (UV-2) | 0.23 |
| Solvent (Solv-1) | 0.05 |
| Solvent (Solv-2) | 0.05 |
| Fifth layer (red-sensitive layer) | |
| Silver halide emulsion (Br: 74%) | 0.21 |
| Gelatin | 1.80 |
| Cyan coupler (ExC-1) | 0.26 |
| Cyan coupler (ExC-2) | 0.12 |
| Anti-fading agent (Cpd-1) | 0.20 |
| Solvent (Solv-1) | 0.16 |
| Solvent (Solv-2) | 0.09 |
| Sixth layer (ultraviolet light absorbing layer) | |
| Gelatin | 0.70 |
| Ultraviolet light absorber (UV-1) | 0.26 |
| Ultraviolet light absorber (UV-2) | 0.07 |
| Solvent (Solv-1) | 0.30 |
| Solvent (Solv-2) | 0.09 |
| Seventh layer (protective layer) | 1.07 |
| Gelatin | |

(ExY) yellow coupler
α-Pivalyl-α-(3-benzyl-1-hydantoinyl)-2-chloro-5-[γ-(2.4-di-tert amylphenoxy]butylamido]acetanilide
(ExC-1) cyan coupler
2-Pentafluorobenzamido-4-chloro-5-[2-(2,4-di-tert-amylphenoxy)3-methylbutylamidophenol
(ExC-2) cyan coupler
2,4-Dichloro-3-methyl-6-[α-(2,4 di-tert-amylphenoxy)butylamido]phenol
(Cpd-1) anti-fading agent
2,5-Di-tert-amylphenyl-3,5-di-tert-butylhydroxy benzoate
(Cpd-2) color mixing inhibitor
2,5-Di-tert-octylhydroquinone
(Cpd 3) anti-fading agent
1,4-Di-tert-amyl-2,5-dioctyloxybenzene
(Cpd-4) anti-fading agent
2,2'-Methylenebis(4-methyl-6-tert-butylphenol)
(UV-1) ultraviolet light absorber
2 (2-Hydroxy-3,5-di-tert-amylphenyl)benzotriazole
(UV-2) ultraviolet light absorber
2-(2-Hydroxy-3,5-di-tert-butylphenyl)benzotriazole
(Solv-1) solvent
Dibutyl phthalate The above photographic material was exposed through an optical wedge and then subjected to the development of Example 2 to prepare sample D.

The procedure for the preparation of Sample D was repeated except that 30 mol % (based on the amount of magenta coupler) of each of the compounds I-49 and III-1 of the present invention was added to the third layer to prepare sample $D_1$. In the same way as in Example 2, these samples were tested to examine the increment in the colored stain after allowing to stand at 80° C. and 70% for 6 days. Samples C and D formed colored stain, while the samples $C_1$ and $D_1$ formed substantially no colored stain.

According to the present invention, there can be obtained a color photograph which scarcely form colored stain (particularly magenta stain) after development.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support and at least one silver halide emulsion layer on the support, wherein said material contains (i) at least one 5-pyrazolone coupler is selected from the group consisting of couplers represented by formulas (II) or (III):

wherein $L_1$ and $L_2$ are the same or different groups and each represents independently a substituted or an unsubstituted methylene or ethylene group; m and n are each 0 or 1; Y represents $R_1$ or $ZR_2$; $R_1$ represents a substituted or an unsubstituted aryl or heterocyclic group or a secondary or a tertiary alkyl group represented by formulas (II) and (III):

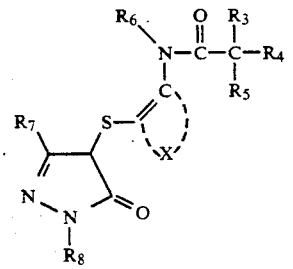

(II)

$R_3$ and $R_4$ each represents independently a halogen atom, $R_2$ or $Z_1R_b$; $Z_1$ represents an oxygen atom, a sulfur atom or $—NR_c$; $R_2$ represents a substituted or an unsubstituted alkyl, aryl or heterocyclic group; $R_5$ represents a hydrogen atom, a halogen atom, a substituted or an unsubstituted alkyl, aryl or heterocyclic group or $Z_1R_b$; $R_6$ and $R_c$ each represents independently a hydrogen atom or these groups set forth in the definition of $R_2$ above; $R_b$ is a substituted or an unsubstituted alkyl, aryl or heterocyclic group; $R_3$ may be combined together with $R_4$ and/or $R_5$ to form one or two carbon atom rings or heterocyclic rings and these rings may be optionally substituted; and X is an atomic group composed of atoms selected from the group consisting of carbon, oxygen and sulfur atoms to form an unsaturated five-membered to seven-membered ring which may be optionally substituted or condensed with another ring; $R_7$ represents an aniline group, an acylamino group, an ureido group, a carbamoyl group, an alkoxy group, an aryloxycarbonyl group, an alkoxycarbonyl group or a N-heterocyclic group, and $R_8$ represents a substituted or an unsubstituted aryl group;

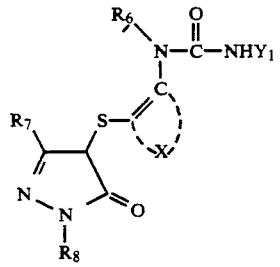

(III)

wherein $Y_1$ represents a substituted or an unsubstituted alkyl, aryl or heterocyclic group, and $R_6$, $R_7$, $R_8$ and X are as defined above; and (ii) at least one compound selected from the group consisting of compounds represented by formulas (AI), (AII) and (AIII):

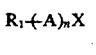

(AI)

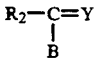

(AII)

wherein $R_1$ and $R_2$ each represents an aliphatic group, an aromatic group or a heterocyclic ring; X represents a group which is eliminated by the reaction with an aromatic amine developing agent; A represents a group which forms a chemical bond by the reaction with the aromatic amine developing agent; n is 0 or 1; B represents a hydrogen atom, an aliphatic group, an aromatic group, a heterocyclic group, an acyl group or a sulfonyl group; Y represents a group which accelerates the addition of the aromatic amine developing agent to the compound having the formula (AII); and $R_1$ and X, or Y and $R_2$ or B may be combined together to form a ring structure,

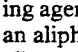

(AIII)

wherein R represents an aliphatic group, an aromatic group or a heterocyclic group; and Z represents a nucleophilic group or a group which is decomposed in the photographic material to release a nucleophilic group.

2. The silver halide color photographic light-sensitive material of claim 1, wherein a compound having the formula (AI) or (AII) is used in combination with a compound having the formula (AIII).

3. The silver halide color photographic light-sensitive material of claim 1, wherein a compound of formula (AI) is selected from the group consisting of compounds having the formulas (AI-a), (AI-b), (AI-c) and (AI-d):

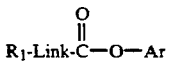

(AI-a)

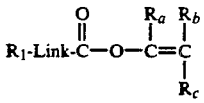

(AI-b)

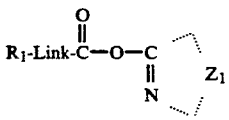

(AI-c)

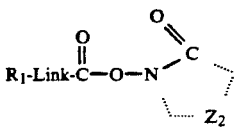

(AI-d)

wherein $R_1$ is the same as those set forth in $R_1$ of formula (AI); "Link" is a single bond or —O—; Ar is an aromatic group; $R_a$, $R_b$ and $R_c$ may be the same or different groups and each independently represents a hydrogen atom, an aliphatic group, an aromatic group, a heterocyclic group, an alkoxy group, an aryloxy group, a heterocyclic oxy group, a carboxyl group, an alkylthio group, an arylthio group, a heterocyclic thio group, an amino group, an alkylamino group, an acylamino group, a sulfonamido group, an acyl group, a sulfonyl group, an alkoxycarbonyl group, a sulfo group, a hydroxy group, an acyloxy group, an ureido group, a urethane group, a carbamoyl group or a sulfamoyl group; $R_a$ and $R_b$, or $R_b$ and $R_c$ may be combined together to form a five-membered to a seven-membered heterocyclic ring, said heterocyclic ring may be optionally substituted, may form a spiro ring or a bicyclo ring, or may be condensed with an aromatic ring.

4. The silver halide color photographic light-sensitive material of claim 1, wherein the compound of formula (AIII) is represented by formula (AIII-a):

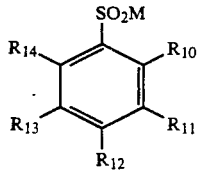

(AIII-a)

wherein M is an atom or an atomic group capable of forming an inorganic: salt or an organic salt, or a group of the following formulas:

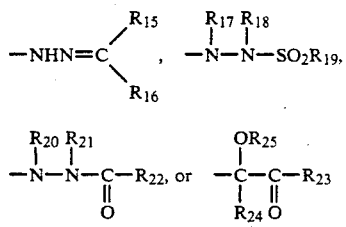

wherein $R_{15}$ and $R_{16}$ may be the same or different groups and each independently represents a hydrogen atom, an aliphatic group, an aromatic group or a heterocyclic group, or $R_{15}$ and $R_{16}$ may be combined together to form a five-membered to a seven-membered ring; $R_{17}$, $R_{18}$, $R_{20}$ and $R_{21}$ may be the same or different groups and each independently represents a hydrogen atom, an aliphatic group, an aromatic group, a heterocyclic group, an acyl group, an alkoxycarbonyl group, a sulfonyl group, an ureido group or a urethane group with the proviso that at least one of $R_{17}$ and $R_{18}$ and at least one of $R_{20}$ and $R_{21}$ are a hydrogen atom; and $R_{19}$ and $R_{22}$ each represents a hydrogen atom, an aliphatic group, an aromatic group or a heterocyclic group, and $R_{19}$ is further an alkylamino group, an arylamino group, an alkoxy group, an aryloxy group, an acyl group, an alkoxycarbonyl group or an aryloxycarbonyl group; at least two groups of $R_{17}$, $R_{18}$ and $R_{19}$ may be combined together to form a five-membered to a seven-membered ring; at least two groups of $R_{20}$, $R_{21}$ and $R_{22}$ may be combined together to form a five-membered to a seven membered ring; $R_{23}$ represents a hydrogen atom, an aliphatic group, an aromatic group or a heterocyclic group; $R_{24}$ is a hydrogen atom, an aliphatic group, an aromatic group, a halogen atom, an acyloxy group or a sulfonyl group; and $R_{25}$ is a hydrogen atom or a hydrolyzable group; $R_{10}$, $R_{11}$, $R_{12}$, $R_{13}$ and $R_{14}$ may be the same or different groups and each represents a hydrogen atom, an aliphatic group, an aromatic group, a heterocyclic group, a halogen atom, $—SR_{26}—$, $—OR_{26}$, $$—\underset{\underset{R_{27}}{|}}{N}—R_{26},$$

an acyl group, an alkoxycarbonyl group, an aryloxycarbonyl group, a sulfonyl group, a sulfonamido group, a sulfamoyl group, an ureido group, a urethane group, a carbamoyl group, a sulfo group, a carboxyl group, a nitro group, a cyano group, an alkoxalyl group, an aryloxalyl group, a sulfonyloxy group, $—P(OR_{26})_2$, $$—\overset{\overset{O}{\|}}{P}(R_{26})_2, \quad —\overset{\overset{S}{\|}}{P}(R_{26})_2,$$

$—P(OR_{26})_2$ or a formyl group; $R_{26}$ and $R_{27}$ are each a hydrogen atom, an aliphatic group, an alkoxy group or an aromatic group.

5. The silver halide color photographic light-sensitive material of claim 1, wherein the 5-pyrazolone coupler is present in an amount of $2\times10^{-3}$ to $5\times10^{-1}$ mol per mol of silver in the emulsion layer.

6. The silver halide color photographic light-sensitive material of claim 1, wherein the compounds having the formulas (AI), (AII) and (AIII) are present in an amount of $1\times10^{-2}$ to 10 mol per mol of the coupler.

7. The silver halide color photographic light-sensitive material of claim 1, wherein at least 90 mol % of the entire silver halide constituting the silver halide grains in the silver halide emulsion is composed of silver chloride.

8. The silver halide color photographic light-sensitive material of claim 1, wherein said 5-pyrazolone coupler is in the form selected from the group consisting of a monomer, an oligomer and a polymer.

9. A color photograph obtained from a silver halide color photographic light sensitive material comprising a support having thereon at least one 5-pyrazolone coupler as defined in claim 1 and at least one silver halide emulsion layer, wherein the photograph comprises (i) a magenta dye formed by an oxidation reaction of said coupler with a color developing agent, and (ii) at least one compound selected from the group consisting of compounds represented by formula (AI), (AII) and (AIII) defined in claim 1.

* * * * *